US007115356B2

(12) United States Patent
Toyoda et al.

(10) Patent No.: US 7,115,356 B2
(45) Date of Patent: Oct. 3, 2006

(54) SILVER HALIDE COLOR PHOTOSENSITIVE MATERIAL

(75) Inventors: Masayoshi Toyoda, Minami-Ashigara (JP); Junichiro Hosokawa, Minami-Ashigara (JP); Takanori Hioki, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/947,173

(22) Filed: Sep. 23, 2004

(65) Prior Publication Data

US 2005/0112512 A1 May 26, 2005

(30) Foreign Application Priority Data

Sep. 24, 2003 (JP) ..... 2003-331819

(51) Int. Cl.
*G03C 1/46* (2006.01)
*G03C 1/005* (2006.01)
*G03C 1/495* (2006.01)

(52) U.S. Cl. ..... 430/502; 430/503; 430/506; 430/567; 430/505; 430/508; 430/955

(58) Field of Classification Search ..... 430/502, 430/503, 506, 567, 505, 508, 955
See application file for complete search history.

(56) References Cited

U.S. PATENT DOCUMENTS 6,197,488 B1 3/2001 Allway et al.
6,319,660 B1 11/2001 Allway et al.
6,350,564 B1 2/2002 Bringley et al.
6,426,180 B1 7/2002 Bringley et al.
6,844,146 B1 * 1/2005 Hosokawa et al. ..... 430/566
2003/0175627 A1 9/2003 Hosokawa et al.
2003/0198905 A1 10/2003 Hosokawa et al.

FOREIGN PATENT DOCUMENTS

JP 62-27740 A 2/1987

* cited by examiner

*Primary Examiner*—Geraldine Letscher
(74) *Attorney, Agent, or Firm*—Sughrue Mion, PLLC

(57) ABSTRACT

A silver halide color photosensitive material of less than 320 ISO speed, comprising at least two red-sensitive emulsion layers, at least two green-sensitive emulsion layers, at least one blue-sensitive emulsion layer and at least one nonsensitive layer, wherein silver halide tabular grains of 0.15 μm or less grain thickness are contained in an amount of 50% or more in respective layers with the highest speed among the green- and red-sensitive emulsion layers; wherein the total dry film thickness of the material on the emulsion layer side thereof is 24 μm or less; and wherein the compound (A) is contained in at least one silver halide emulsion layer or the nonsensitive layer.

Compound (A): heterocyclic compound having one or more heteroatoms, which heterocyclic compound is capable of substantially increasing the sensitivity of silver halide color photosensitive material by addition thereof as compared with that exhibited when the compound is not added.

9 Claims, No Drawings

SILVER HALIDE COLOR PHOTOSENSITIVE MATERIAL

CROSS-REFERENCE TO RELATED APPLICATIONS

This application is based upon and claims the benefit of priority from prior Japanese Patent Application No. 2003-331819, filed Sep. 24, 2003, the entire contents of which are incorporated herein by reference.

BACKGROUND OF THE INVENTION

1. Field of the Invention

The present invention relates to a silver halide color photosensitive material capable of realizing an extremely high image quality excelling in graininess and in bright acuity.

2. Description of the Related Art

In recent years, photosensitive materials of high photographic speed are placed on the market in quick succession in accordance with the progress of technology relating to photosensitive materials for photographing. Accordingly, the photographed areas are expanding to night scenes, dark indoor space, etc.

However, with respect to such photosensitive materials of high photographic speed, it is difficult to obtain satisfactory image quality when the print size is large. For example, in professional photographic fields such as those in business, it is highly important to realize excellent graininess for enhancing the print quality. On the market of such fields, the ratio of handling of large-size prints is high, and from this viewpoint as well, graininess is critically important.

Further, the magnification ratio at printing must be high for preparing large-size prints, so that excellent bright acuity in broad frequency domain is simultaneously important.

Various techniques for sensitivity enhancement have been studied (see, for example, Jpn. Pat. Appln. KOKAI Publication No. (hereinafter referred to as JP-A-) 2003-156823 and JP-A-2000-194085). These however on their own cannot attain excellent graininess.

Graininess improvement to a certain level can be achieved by combining the technology for sensitivity enhancement with techniques involving the use of coupler of low activity, use of DIR compound, reduction of the dimension of silver halide grains, etc. However, the use of couplers of low activity in large amounts is attended by harmful effects, such as strong influence of variations of processing solution composition. The use of DIR compounds leads to a change of the level of interlayer effect, making compatibility with color reproduction difficult. The reduction of the dimension of silver halide grains leads to an intensification of light scattering, making it difficult to attain an enhancement of image quality involving bright acuity.

On the other hand, improvement of bright acuity to a certain level can be achieved by combining the technology for sensitivity enhancement with irradiation neutralizing dyes. However, improvement of graininess cannot be attained thereby.

BRIEF SUMMARY OF THE INVENTION

The task of the present invention is to provide a silver halide color photosensitive material capable of realizing an extremely high image quality excelling in graininess and in bright acuity.

It has been found that the problem of the present invention can be resolved by the following means.

Specifically, (1) A silver halide color photosensitive material of less than 320 ISO speed, comprising a support and, superimposed thereon, at least two red-sensitive silver halide emulsion layers of different sensitivities, at least two green-sensitive silver halide emulsion layers of different sensitivities, at least one blue-sensitive silver halide emulsion layer and at least one nonsensitive layer, wherein silver halide tabular grains of 0.15 μm or less grain thickness are contained in an amount of 50% or more based on the total number of silver halide grains in respective layers with the highest speed among the green-sensitive silver halide emulsion layers and red-sensitive silver halide emulsion layers; wherein the total dry film thickness of the photosensitive material on the emulsion layer side thereof is 24 μm or less; and wherein the below defined compound (A) is contained in at least one silver halide emulsion layer or the nonsensitive layer of the photosensitive material.

Compound (A): heterocyclic compound having one or more heteroatoms, which heterocyclic compound is capable of substantially increasing the sensitivity of silver halide color photosensitive material by addition thereof as compared with that exhibited when the compound is not added.

(2) The silver halide color photosensitive material according to item (1) above, wherein the total dry film thickness of the photosensitive material on the emulsion layer side thereof is 22 μm or less.

(3) The silver halide color photosensitive material according to item (1) or (2) above, wherein the coating amount of silver is 5.0 $g/m^2$ or less.

(4) The silver halide color photosensitive material according to any of items (1) to (3) above, wherein the support at its side opposite to the side having the emulsion layers is provided with at least one back layer containing a hydrophilic binder, the total dry thickness thereof being in the range of 6 to 15 μm.

(5) The silver halide color photosensitive material according to any of items (1) to (4) above, wherein the green-sensitive silver halide emulsion layers have a center-of-gravity sensitivity wavelength ($\lambda_G$) of spectral sensitivity distribution satisfying the relationship 520 nm$<\lambda_G\leqq$580 nm, and wherein the red-sensitive silver halide emulsion layers have a center-of-gravity wavelength ($\lambda_{-R}$) of spectral sensitivity distribution of intensity of interlayer effect exerted thereupon by other silver halide emulsion layers in the range of 500 nm to 600 nm, the center-of-gravity wavelength ($\lambda_{-R}$) satisfying the relationship 500 nm$<\lambda_{-R}<$560 nm, and wherein the difference of $\lambda_G-\lambda_{-R}$ is 5 nm or greater.

(6) The silver halide color photosensitive material according to any of items (1) to (5) above, wherein the compound (A) is a compound unreactive with developing agent oxidation products provided that when the compound (A) is a heterocyclic compound having one or two heteroatoms, and is a compound reactive with developing agent oxidation products provided that when the compound (A) is a heterocyclic compound having three or more heteroatoms.

(7) The silver halide color photosensitive material according to any of items (1) to (6) above, wherein the compound (A) is represented by the following general formula (I):

General formula (I)

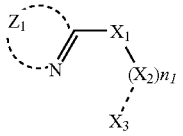

Where $Z_1$ represents a group for forming a heterocycle having one or two heteroatoms including the nitrogen atom of the formula; each of $X_1$ and $X_2$ independently represents a sulfur atom, an oxygen atom, a nitrogen atom (N(Va)) or a carbon atom (C(Vb)(Vc)), each of Va, Vb and Vc independently represents a hydrogen atom or a substituent; $n_1$ is 0, 1, 2 or 3, a plurality of $X_2$ may be the same or different when $n_1$ is 2 or greater; $X_3$ represents a sulfur atom, an oxygen atom or a nitrogen atom; and the bond between $X_2$ and $X_3$ is single or double, wherein $X_3$ may further have a substituent or a charge.

(8) The silver halide color photosensitive material according to any of items (1) to (6) above, wherein the compound (A) is represented by the following general formula (II):

General formula (II)

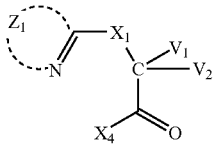

Where $Z_1$ represents a group for forming a heterocycle having one or two heteroatoms including the nitrogen atom of the formula; $X_1$ represents a sulfur atom, an oxygen atom, a nitrogen atom (N(Va)) or a carbon atom (C(Vb)(Vc)), each of Va, Vb and Vc independently represents a hydrogen atom or a substituent; $X_4$ represents a sulfur atom (S(Vd)), an oxygen atom (O(Ve)) or a nitrogen atom (N(Vf)(Vg)), each of Vd, Ve, Vf and Vg independently represents a hydrogen atom, a substituent or a negative charge; and each of $V_1$ and $V_2$ independently represents a hydrogen atom or a substituent.

(9) The silver halide color photosensitive material according any of items (1) to (6) above, wherein the compound (A) is represented by the following general formula (M) or general formula (C):

General formula (M)

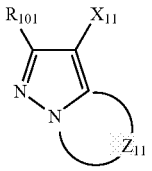

Where $R_{101}$ represents a hydrogen atom or a substituent; $Z_{11}$ represents a nonmetallic atom group required for forming a 5-membered azole ring containing 2 to 4 nitrogen atoms, which azole ring may have substituents (including a condensed ring); and $X_{11}$ represents a hydrogen atom or a substituent.

General formula (C)

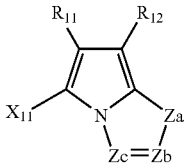

Where Za represents —NH— or —CH($R_3$)—; each of Zb and Zc independently represents —C($R_{14}$)═ or —N═, provided that when Za is —NH—, at least one of Zb and Zc is —N═ and that when Za is —CH($R_{13}$)—, both of Zb and Zc are —N═; each of $R_{11}$, $R_{12}$ and $R_{13}$ independently represents electron withdrawing groups whose Hammett substituent constant op value is in the range of 0.2 to 1.0; $R_{14}$ represents a hydrogen atom or a substituent, provided that when there are two $R_{14}$'s in the formula, they may be identical with or different from each other; and $X_{11}$ represents a hydrogen atom or a substituent.

The present invention has enabled obtaining a silver halide color photosensitive material capable of realizing an extremely high image quality excelling in graininess and in bright acuity.

DETAILED DESCRIPTION OF THE INVENTION

The ISO speed of the silver halide color photosensitive material according to the present invention is less than 320, preferably less than 240. The ISO speed, although its lower value is not limited as long as photographic sensitivity can be ensured, is preferably 50 or above.

The coating amount of silver (total coating amount of silver attributed to silver halides, colloidal silver and other relevant material) of the silver halide color photosensitive material according to the present invention is 9.0 g/m$^2$ or less, more preferably 7.0 g/m$^2$ or less, and still more preferably 5.0 g/m$^2$ or less. Although there is no lower limit with respect to the coating amount of silver, it is preferred that the coating amount of silver be about 2 g/m$^2$ or more from the viewpoint that incommensurateness would lead to difficulty in processing.

The total thickness of the silver halide color photosensitive material on its side having the emulsion layers is 24 μm or less, preferably 22 μm or less, and still more preferably 20 μm or less. A preferred lower limit of the total coating thickness in the dry state, although it varies depending on the number of layers constituting the silver halide color photosensitive material, the size of grains contained in the emulsion layers, etc., is 10 μm or more. Herein, the total coating thickness in the dry state refers to measurement by contact type film thickness gauge (K-402BSTAND, manufactured by Anritsu Electric Co., Ltd.) with respect to samples conditioned at 25° C. in 55% humidity for two days. The sum of dry coating thicknesses of all hydrophilic colloid layers on emulsion layer having side (namely, total coating thickness in the dry state) can be calculated as the difference between the thickness of dry sample and the thickness after removing of emulsion-layer-having side coating layers from the support.

In the silver halide color photosensitive material according to the present invention, it is preferred that the green-sensitive silver halide emulsion layers have a center-of-gravity (weight-average) sensitivity wavelength ($\lambda_G$) of spectral sensitivity distribution satisfying the relationship 520 nm<$\lambda_G$≦580 nm, and that the red-sensitive silver halide emulsion layers have a center-of-gravity (weight-average) wavelength ($\lambda_{-R}$) of spectral sensitivity distribution of intensity of interlayer effect exerted thereupon by other silver halide emulsion layers in the range of 500 nm to 600 nm, the center-of-gravity wavelength ($\lambda_{-R}$) satisfying the relationship 500 nm<$\lambda_{-R}$<560 nm, and that the difference of $\lambda_G-\lambda_{-R}$ is 5 nm or greater. More preferably, the difference of $\lambda_G-\lambda_{-R}$ is 10 nm or greater.

$$\lambda_G = \frac{\int_{500}^{600} \lambda S_G(\lambda)\, d\lambda}{\int_{500}^{600} S_G(\lambda)\, d\lambda}$$

In the formula, $S_G(\lambda)$ represents a spectral sensitivity distribution curve of green-sensitive silver halide emulsion layers. The $S_G$ at specified wavelength $\lambda$ is expressed as the inverse number of exposure intensity at which the magenta density becomes fog+0.5 at the time of exposure of specified wavelength.

For exerting the above interlayer effect on the red-sensitive layers within a specified wavelength region, it is preferred to dispose a separate interlayer effect donor layer containing silver halide grains, which has been subjected to given spectral sensitization.

For realizing the spectral sensitivity desired in the present invention, the center-of-gravity sensitivity wavelength of the interlayer effect donor layer is preferably set for 510 to 540 nm.

The above center-of-gravity wavelength of wavelength distribution of magnitude of interlayer effect exerted on red-sensitive silver halide emulsion layers by other silver halide emulsion layers at 500 nm to 600 nm ($\lambda_{-R}$) can be determined by the method described in Jpn. Pat. Appln. KOKOKU Publication No. (hereinafter referred to as JP-B-) 3-10287.

In the present invention, it is preferred that the center-of-gravity wavelength $\lambda_R$ of red-sensitive layers be 630 nm or less. Herein, the center-of-gravity wavelength $\lambda_R$ of red-sensitive layers is defined by the formula (I).

$$\lambda_R = \frac{\int_{550}^{700} \lambda S_R(\lambda)\, d\lambda}{\int_{550}^{700} S_R(\lambda)\, d\lambda} \quad \text{(I)}$$

In the formula, $S_R(\lambda)$ represents a spectral sensitivity distribution curve of red-sensitive layers. The $S_R$ at specified wavelength $\lambda$ is expressed as the inverse number of exposure intensity at which the cyan density becomes fog+0.5 at the time of exposure of specified wavelength.

Compounds which react with developing agent oxidation products obtained by development to thereby release a development inhibitor or a precursor thereof are used as the material for exerting the interlayer effect. For example, use can be made of DIR (development inhibitor releasing) couplers, DIR hydroquinone and couplers capable of releasing DIR hydroquinone or a precursor thereof. When the development inhibitor has a high diffusivity, the development inhibiting effect can be exerted irrespective of the position of the donor layer in the interlayer multilayer structure. However, there also occurs a development inhibiting effect in nonintended directions. Therefore, for correcting this, it is preferred that the donor layer be colored (for example, coloring is made into the same color as that of the layer on which undesirable development inhibitor effect is exerted). For causing the photosensitive material of the present invention to obtain desirable spectral sensitivity, it is preferred that the donor layer capable of exerting the interlayer effect realize magenta color formation.

In the present invention, when any specified moiety is referred to as "group", it is meant that the moiety per se may be unsubstituted or have one or more (up to possible largest number) substituents. For example, the "alkyl group" refers to a substituted or unsubstituted alkyl group. The substituents which can be employed in the compounds of the present invention are not limited irrespective of the existence of substitution.

When these substituents are referred to as W, the substituents represented by W are not particularly limited. As such, there can be mentioned, for example, halogen atoms, alkyl groups (including a cycloalkyl group, a bicycloalkyl group and a tricycloalkyl group), alkenyl groups (including a cycloalkenyl group and a bicycloalkenyl group), alkynyl groups, aryl groups, heterocyclic groups, a cyano group, a hydroxyl group, a nitro group, a carboxyl group, alkoxy groups, aryloxy groups, a silyloxy group, heterocyclic oxy groups, acyloxy groups, a carbamoyloxy group, alkoxycarbonyloxy groups, aryloxycarbonyloxy groups, amino groups (including alkylamino groups, arylamino groups and heterocyclic amino groups), an ammonio group, acylamino groups, an aminocarbonylamino group, alkoxycarbonylamino groups, aryloxycarbonylamino groups, a sulfamoylamino group, alkyl- or arylsulfonylamino group, a mercapto group, alkylthio groups, arylthio groups, heterocyclic thio groups, a sulfamoyl group, a sulfo group, alkyl- or arylsulfinyl groups, alkyl- or arylsulfonyl groups, acyl groups, aryloxycarbonyl groups, alkoxycarbonyl groups, a carbamoyl group, aryl- or heterocyclic azo groups, an imido group, a phosphino group, a phosphinyl group, a phosphinyloxy group, a phosphinylamino group, a phosphono group, a silyl group, a hydrazino group, a ureido group, a borate group (—$B(OH)_2$), a phosphato group (—$OPO(OH)_2$), a sulfato group (—$OSO_3H$) and other common substituents.

More specifically, W can represent any of halogen atoms (e.g., a fluorine atom, a chlorine atom, a bromine atom and an iodine atom); alkyl groups [each being a linear, branched or cyclic substituted or unsubstituted alkyl group, and including an alkyl group (preferably an alkyl group having 1 to 30 carbon atoms, such as methyl, ethyl, n-propyl, isopropyl, t-butyl, n-octyl, eicosyl, 2-chloroethyl, 2-cyanoethyl or 2-ethylhexyl), a cycloalkyl group (preferably a substituted or unsubstituted cycloalkyl group having 3 to 30 carbon atoms, such as cyclohexyl, cyclopentyl or 4-n-dodecylcyclohexyl), a bicycloalkyl group (preferably a substituted or unsubstituted bicycloalkyl group having 5 to 30 carbon atoms, which is a monovalent group corresponding to a bicycloalkane having 5 to 30 carbon atoms from which one hydrogen atom is removed, such as bicyclo[1,2,2]heptan-2-yl or bicyclo[2,2,2]octan-3-yl), and a tricyclo or more cycle structure; the alkyl contained in the following substituents (for example, alkyl of alkylthio group) means the alkyl group of this concept, which however further includes an alkenyl group and an alkynyl group]; alkenyl groups [each being a linear, branched or cyclic substituted or unsubstituted alkenyl group, and including an alkenyl group (preferably a substituted or unsubstituted alkenyl group having 2 to 30 carbon atoms, such as vinyl, allyl, pulenyl, geranyl or oleyl), a cycloalkenyl group (preferably a substituted or unsubstituted cycloalkenyl group having 3 to 30 carbon atoms, which is a monovalent group corresponding to a cycloalkene having 3 to 30 carbon atoms from which one hydrogen atom is removed, such as 2-cyclopenten-1-yl or 2-cyclohexen-1-yl), and a bicycloalkenyl group (substituted or unsubstituted bicycloalkenyl group, preferably a substituted or unsubstituted bicycloalkenyl group having 5 to 30 carbon atoms, which is a monovalent group corresponding to a bicycloalkene having one double bond from which one hydrogen atom is removed, such as bicyclo[2,2,1]hept-2-en-1-yl or bicyclo[2,2,2]oct-2-en-4-yl)]; alkynyl groups (preferably a substituted or unsubstituted alkynyl group having 2 to 30 carbon atoms, such as ethynyl, propargyl or trimethylsilylethynyl); aryl groups (preferably a substituted or unsubstituted aryl group having 6 to 30 carbon atoms, such as phenyl, p-tolyl, naphthyl, m-chlorophenyl or o-hexadecanoylaminophenyl); heterocyclic groups (preferably a monovalent group corresponding to a 5- or 6-membered substituted or unsubstituted aromatic or nonaromatic heterocyclic compound from which one hydrogen atom is removed (the monovalent group may be condensed with a benzene ring, etc.), more preferably a 5- or 6-membered aromatic heterocyclic group having 3 to 30 carbon atoms, such as 2-furyl, 2-thienyl, 2-pyrimidinyl or 2-benzothiazolyl (the heterocyclic group may be a cationic heterocyclic group such as 1-methyl-2-pyridinio or 1-methyl-2-quinolinio)); a cyano group; a hydroxyl group; a nitro group; a carboxyl group; alkoxy groups (preferably a substituted or unsubstituted alkoxy group having 1 to 30 carbon atoms, such as methoxy, ethoxy, isopropoxy, t-butoxy, n-octyloxy or 2-methoxyethoxy); aryloxy groups (preferably a substituted or unsubstituted aryloxy group having 6 to 30 carbon atoms, such as phenoxy, 2-methylphenoxy, 4-t-butylphenoxy, 3-nitrophenoxy or 2-tetradecanoylaminophenoxy); silyloxy groups (preferably a silyloxy group having 3 to 20 carbon atoms, such as trimethylsilyloxy or t-butyldimethylsilyloxy); heterocyclic oxy groups (preferably a substituted or unsubstituted heterocyclic oxy group having 2 to 30 carbon atoms, such as 1-phenyltetrazol-5-oxy or 2-tetrahydropyranyloxy); acyloxy groups (preferably a formyloxy group, a substituted or unsubstituted alkylcarbonyloxy group having 2 to 30 carbon atoms or a substituted or unsubstituted arylcarbonyloxy group having 7 to 30 carbon atoms, such as formyloxy, acetyloxy, pivaloyloxy, stearoyloxy, benzoyloxy or p-methoxyphenylcarbonyloxy); carbamoyloxy groups (preferably a substituted or unsubstituted carbamoyloxy group having 1 to 30 carbon atoms, such as N,N-dimethylcarbamoyloxy, N,N-diethylcarbamoyloxy, morpholinocarbonyloxy, N,N-di-n-octylaminocarbonyloxy or N-n-octylcarbamoyloxy); alkoxycarbonyloxy groups (preferably a substituted or unsubstituted alkoxycarbonyloxy group having 2 to 30 carbon atoms, such as methoxycarbonyloxy, ethoxycarbonyloxy, t-butoxycarbonyloxy or n-octylcarbonyloxy); aryloxycarbonyloxy groups (preferably a substituted or unsubstituted aryloxycarbonyloxy group having 7 to 30 carbon atoms, such as phenoxycarbonyloxy, p-methoxyphenoxycarbonyloxy or p-n-hexadecyloxyphenoxycarbonyloxy); amino groups (preferably an amino group, a substituted or unsubstituted alkylamino group having 1 to 30 carbon atoms or a substituted or unsubstituted arylamino group having 6 to 30 carbon atoms, such as amino, methylamino, dimethylamino, anilino, N-methylanilino or diphenylamino); ammonio groups (preferably an ammonio group or an ammonio group substituted with a substituted or unsubstituted alkyl, aryl or heterocycle having 1 to 30 carbon atoms, such as trimethylammonio, triethylammonio or diphenylmethylammonio), acylamino groups (preferably an formylamino group, a substituted or unsubstituted alkylcarbonylamino group having 1 to 30 carbon atoms or a substituted or unsubstituted arylcarbonylamino group having 6 to 30 carbon atoms, such as formylamino, acetylamino, pivaloylamino, lauroylamino, benzoylamino or 3,4,5-tri-n-octyloxyphenylcarbonylamino); aminocarbonylamino groups (preferably a substituted or unsubstituted aminocarbonylamino group having 1 to 30 carbon atoms, such as carbamoylamino, N,N-dimethylaminocarbonylamino, N,N-diethylaminocarbonylamino or morpholinocarbonylamino); alkoxycarbonylamino groups (preferably a substituted or unsubstituted alkoxycarbonylamino group having 2 to 30 carbon atoms, such as methoxycarbonylamino, ethoxycarbonylamino, t-butoxycarbonylamino, n-octadecyloxycarbonylamino or N-methyl-methoxycarbonylamino); aryloxycarbonylamino groups (preferably a substituted or unsubstituted aryloxycarbonylamino group having 7 to 30 carbon atoms, such as phenoxycarbonylamino, p-chlorophenoxycarbonylamino or m-n-octyloxyphenoxycarbonylamino); sulfamoylamino groups (preferably a substituted or unsubstituted sulfamoylamino group having 0 to 30 carbon atoms, such as sulfamoylamino, N,N-dimethylaminosulfonylamino or N-n-octylaminosulfonylamino); alkyl- or arylsulfonylamino groups (preferably a substituted or unsubstituted alkylsulfonylamino group having 1 to 30 carbon atoms or a substituted or unsubstituted arylsulfonylamino group having 6 to 30 carbon atoms, such as methylsulfonylamino, butylsulfonylamino, phenylsulfonylamino, 2,3,5-trichlorophenylsulfonylamino or p-methylphenylsulfonylamino); a mercapto group; alkylthio groups (preferably a substituted or unsubstituted alkylthio group having 1 to 30 carbon atoms, such as methylthio, ethylthio or n-hexadecylthio); arylthio groups (preferably a substituted or unsubstituted arylthio group having 6 to 30 carbon atoms, such as phenylthio, p-chlorophenylthio or m-methoxyphenylthio); heterocyclic thio groups (preferably a substituted or unsubstituted heterocyclic thio group having 2 to 30 carbon atoms, such as 2-benzothiazolylthio or 1-phenyltetrazol-5-ylthio); sulfamoyl groups (preferably a substituted or unsubstituted sulfamoyl group having 0 to 30 carbon atoms, such as N-ethylsulfamoyl, N-(3-dodecyloxypropyl)sulfamoyl, N,N-dimethylsulfamoyl, N-acetylsulfamoyl, N-benzoylsulfamoyl or N-(N'-phenylcarbamoyl)sulfamoyl); a sulfo group; alkyl- or arylsulfinyl groups (preferably a substituted or unsubstituted alkylsulfinyl group having 1 to 30 carbon atoms or a substituted or unsubstituted arylsulfinyl group having 6 to 30 carbon atoms, such as methylsulfinyl, ethylsulfinyl, phenylsulfinyl or p-methylphenylsulfinyl); alkyl- or arylsulfonyl groups (preferably a substituted or unsubstituted alkylsulfonyl group having 1 to 30 carbon atoms or a substituted or unsubstituted arylsulfonyl group having 6 to 30 carbon atoms, such as methylsulfonyl, ethylsulfonyl, phenylsulfonyl or p-methylphenylsulfonyl); acyl groups (preferably a formyl group, a substituted or unsubstituted alkylcarbonyl group having 2 to 30 carbon atoms, a substituted or unsubstituted arylcarbonyl group having 7 to 30 carbon atoms or a substituted or unsubstituted heterocyclic carbonyl group having 4 to 30 carbon atoms wherein carbonyl is bonded with carbon atom thereof, such as acetyl, pivaloyl, 2-chloroacetyl, stearoyl, benzoyl, p-n-octyloxyphenylcarbonyl, 2-pyridylcarbonyl or 2-furylcarbonyl); aryloxycarbonyl groups (preferably a substituted or unsubstituted aryloxycarbonyl group having 7 to 30 carbon atoms, such as phenoxycarbonyl, o-chlorophenoxycarbonyl, m-nitrophenoxycarbonyl or p-t-butylphenoxycarbonyl); alkoxycarbonyl groups (preferably a substituted or unsubstituted alkoxycarbonyl group having 2 to 30 carbon atoms, such as methoxycarbonyl, ethoxycarbonyl, t-butoxycarbonyl or n-octadecyloxycarbonyl); carbamoyl groups (preferably a substituted or unsubstituted carbamoyl group having 1 to 30 carbon atoms, such as carbamoyl, N-methylcarbamoyl, N,N-dimethylcarbamoyl, N,N-di-n-octylcarbamoyl or N-(methylsulfonyl)carbamoyl); aryl- or heterocyclic azo groups (preferably a substituted or unsubstituted arylazo group having 6 to 30 carbon atoms or a substituted or unsubstituted heterocyclic azo group having 3 to 30 carbon atoms, such as phenylazo, p-chlorophenylazo or 5-ethylthio-1,3,4-thiadiazol-2-ylazo); imido groups (preferably N-succinimido or N-phthalimido); phosphino groups (preferably a substituted or unsubstituted phosphino group having 2 to 30 carbon atoms, such as dimethylphosphino, diphenylphosphino or methylphenoxyphosphino); phosphinyl groups (preferably a substituted or unsubstituted phosphinyl group having 2 to 30 carbon atoms, such as phosphinyl, dioctyloxyphosphinyl or diethoxyphosphinyl); phosphinyloxy groups (preferably a substituted or unsubstituted phosphinyloxy group having 2 to 30 carbon atoms, such as diphenoxyphosphinyloxy or dioctyloxyphosphinyloxy); phosphinylamino groups (preferably a substituted or unsubstituted phosphinylamino group having 2 to 30 carbon atoms, such as dimethoxyphosphinylamino or dimethylaminophosphinylamino); a phospho group; silyl groups (preferably a substituted or unsubstituted silyl group having 3 to 30 carbon atoms, such as trimethylsilyl, t-butyldimethylsilyl or phenyldimethylsilyl); hydrazino groups (preferably a substituted or unsubstituted hydrazino group having 0 to 30 carbon atoms, such as trimethylhydrazino); and ureido groups (preferably a substituted or unsubstituted ureido group having 0 to 30 carbon atoms, such as N,N-dimethylureido).

Two W's can cooperate with each other to thereby form a ring (any of aromatic or nonaromatic hydrocarbon rings and heterocycles (these can be combined into polycyclic condensed rings), for example, a benzene ring, a naphthalene ring, an anthracene ring, a phenanthrene ring, a fluorene ring, a triphenylene ring, a naphthacene ring, a biphenyl ring, a pyrrole ring, a furan ring, a thiophene ring, an imidazole ring, an oxazole ring, a thiazole ring, a pyridine ring, a pyrazine ring, a pyrimidine ring, a pyridazine ring, an indolizine ring, an indole ring, a benzofuran ring, a benzothiophene ring, an isobenzofuran ring, a quinolizine ring, a quinoline ring, a phthalazine ring, a naphthylidine ring, a quinoxaline ring, a quinoxazoline ring, an isoquinoline ring, a carbazole ring, a phenanthridine ring, an acridine ring, a phenanthroline ring, a thianthrene ring, a chromene ring, a xanthene ring, a phenoxathine ring, a phenothiazine ring or a phenazine ring).

With respect to those having hydrogen atoms among the above substituents W, the hydrogen atoms may be replaced with the above substituents. Examples of such hydrogen having substituents include a —$CONHSO_2$— group (sulfonylcarbamoyl or carbonylsulfamoyl), a —CONHCO— group (carbonylcarbamoyl) and a —$SO_2NHSO_2$— group (sulfonylsulfamoyl).

More specifically, examples of such hydrogen having substituents include an alkylcarbonylaminosulfonyl group (e.g., acetylaminosulfonyl), an arylcarbonylaminosulfonyl group (e.g., benzoylaminosulfonyl), an alkylsulfonylaminocarbonyl group (e.g., methylsulfonylaminocarbonyl) and an arylsulfonylaminocarbonyl group (e.g., p-methylphenylsulfonylaminocarbonyl).

Heterocyclic compounds having at least one heteroatom for use in the present invention, compound (A), will be described below. Compounds which can preferably be employed in the present invention are those not reactive with developing agent oxidation products with respect to heterocyclic compounds having one or two heteroatoms, and are those reactive with developing agent oxidation products with respect to heterocyclic compounds having three or more heteroatoms. These will be described below.

First, the heterocyclic compounds having one or two heteroatoms for use in the present invention will be described. Heteroatom refers to atoms other than carbon and hydrogen atoms. Heterocycle refers to a cyclic compound having at least one heteroatom. The heteroatom of the "heterocycle having one or two heteroatoms" refers to only atoms as constituents of a heterocyclic ring system, and does not mean atoms positioned outside the ring system and atoms as parts of further substituents of the ring system.

With respect to polynuclear heterocycles, only those wherein the number of heteroatoms in all the ring systems is 1 or 2 are included. For example, 1,3,4,6-tetrazaindene is not included therein because the number of heteroatoms is 4.

Although any heterocyclic compounds satisfying the above requirements can be employed, the heteroatom is preferably a nitrogen atom, a sulfur atom, an oxygen atom, a selenium atom, a tellurium atom, a phosphorus atom, a silicon atom or a boron atom. More preferably, the heteroatom is a nitrogen atom, a sulfur atom, an oxygen atom or a selenium atom. Further more preferably, the heteroatom is a nitrogen atom, a sulfur atom or an oxygen atom. Most preferably, the heteroatom is a nitrogen atom or a sulfur atom.

Although the number of members of heterocycles is not limited, a 3- to 8-membered ring is preferred. A 5- to 7-membered ring is more preferred. A 5- or 6-membered ring is most preferred.

Although the heterocycles may be saturated or unsaturated, those having at least one unsaturated moiety are preferred. Those having at least two unsaturated moieties are more preferred. Stated in another way, although the heterocycle may be any of aromatic, pseudo-aromatic and nonaromatic heterocycles, aromatic and pseudo-aromatic heterocycles are preferred.

Examples of these heterocycles include a pyrrole ring, a thiophene ring, a furan ring, an imidazole ring, a pyrazole ring, a thiazole ring, an isothiazole ring, an oxazole ring, an isooxazole ring, a pyridine ring, a pyrazine ring, a pyrimidine ring, a pyridazine ring and an indolizine ring; resulting from benzo ring condensation thereof, an indole ring, a benzofuran ring, a benzothiophene ring, an isobenzofuran ring, a quinolizine ring, a quinoline ring, a phthalazine ring, a quinoxaline ring, an isoquinoline ring, a carbazole ring, a phenanthridine ring, a phenanthroline ring and an acridine ring; and resulting from partial or complete saturation thereof, a pyrrolidine ring, a pyrroline ring and an imidazoline ring.

Representative examples of heterocycles will be shown below.

(aa-1)

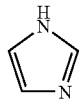

(aa-2)

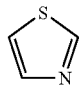

-continued
(aa-3)
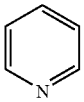
(aa-4)
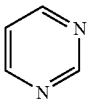
(aa-5)
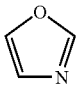
(aa-6)
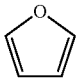
(aa-7)
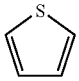
(aa-8)
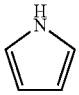
(aa-9)
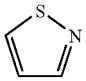
(aa-10)
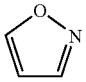
(aa-11)
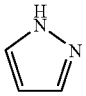
(aa-12)
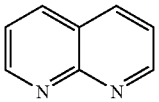
(aa-13)
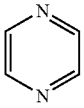
(aa-14)
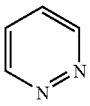
(aa-15)
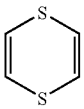
(aa-16)
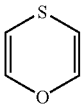
-continued
(aa-17)
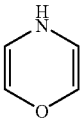
(aa-18)
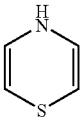
As the heterocycles resulting from benzene ring condensation, for example, the following can be shown.
(ab-1)
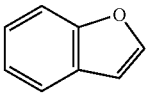
(ab-2)
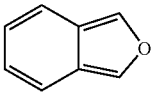
(ab-3)
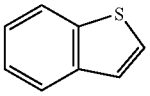
(ab-4)
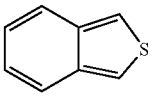
(ab-5)
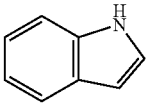
(ab-6)
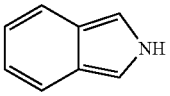
(ab-7)
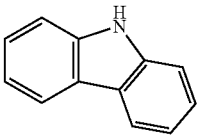
(ab-8)
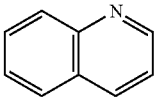
(ab-9)
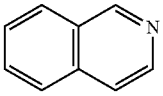
(ab-10)
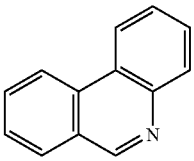

-continued
(ab-11)
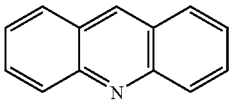
(ab-12)
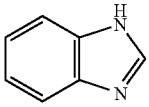
(ab-13)
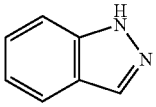
(ab-14)
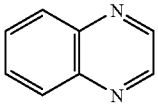
(ab-15)
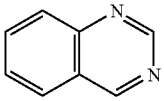
(ab-16)
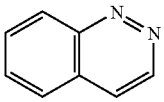
(ab-17)
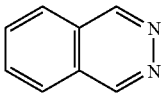
(ab-18)
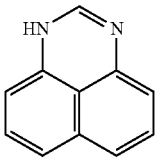
(ab-19)
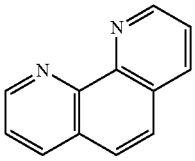
(ab-20)
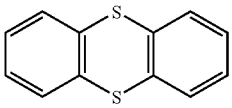
(ab-21)
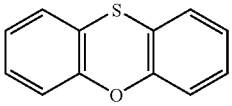
(ab-22)
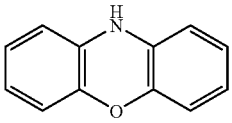
-continued
(ab-23)
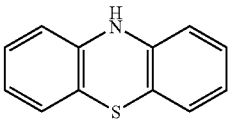
(ab-24)
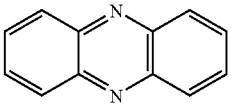
(ab-25)
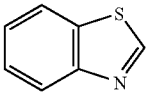
(ab-26)
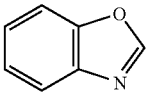
(ab-27)
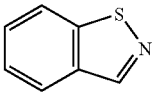
(ab-28)
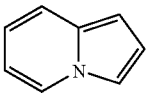
(ab-29)
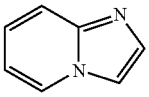
As the heterocycles resulting from partial or complete saturation, for example, the following can be shown.
(ac-1)
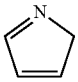
(ac-2)
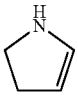
(ac-3)
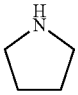
(ac-4)
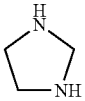
(ac-5)
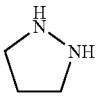
(ac-6)
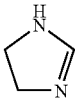

-continued (ac-7)

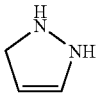

(ac-8)

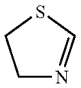

(ac-9)

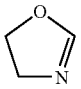

(ac-10)

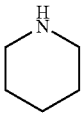

(ac-11)

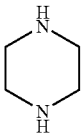

(ac-12)

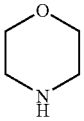

(ac-13)

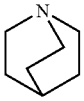

(ac-14)

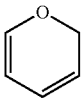

(ac-15)

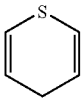

(ac-16)

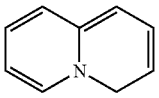

(ac-17)

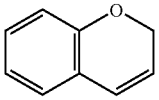

(ac-18)

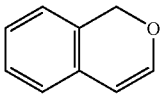

(ac-19)

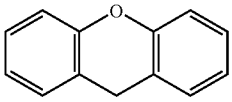

Furthermore, the following heterocycles can be used.

(ad-1)

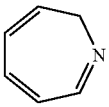

(ad-2)

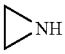

(ad-3)

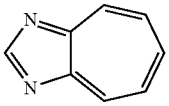

(ad-4)

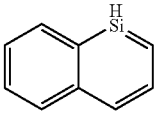

(ad-5)

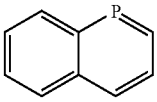

(ad-6)

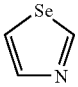

(ad-7)

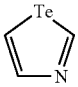

(ad-8)

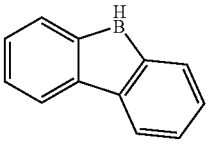

These heterocycles, unless contrary to the definition of "heterocycle having one or two heteroatoms", may have any substituents or may be in the form of any condensed ring. As the substituents, there can be mentioned the aforementioned W. The tertiary nitrogen atom contained in heterocycles may be substituted into a quaternary nitrogen. Moreover, any other tautomeric structures which can be drawn with respect to heterocycles are chemically equivalent to each other.

With respect to the heterocycles having one or two heteroatoms, it is preferred that free thiol (—SH) and thiocarbonyl (>C═S) be in unsubstituted form.

Among the heterocycles, heterocycles (aa-1) to (aa-4) are preferred. With respect to heterocycles (aa-2), heterocycle with benzene ring condensed thereto (ab-25) is more preferred.

Although the heterocyclic compounds having one or two heteroatoms may react or may not react with oxidizing developing agents, preferred use can be made of heterocyclic compounds which do not react with oxidizing developing agents.

That is, heterocyclic compounds which induce no marked (less than 5 to 10%) direct chemical reaction or redox reaction with oxidizing developing agents are preferred. Further, those which are not couplers, being incapable of reacting with oxidizing developing agents to form dyes or other products are preferred.

The reactivity (CRV) of compounds of the present invention with oxidizing developing agents is determined in the following manner.

Test sensitive material (A) was exposed to white light and processed in the same manner as described in Example 1 except that the processing time in color development step was changed to 1 min 30 sec. The magenta density and cyan density of the sensitive material were measured, and the respective differences from the magenta density and cyan density of sensitive material containing none of compounds of the present invention were calculated.

Test Sensitive Material (A)

(Support) Cellulose Triacetate

| | |
|---|---|
| (Emulsion layer) | |
| Em-A in terms of Ag | 1.07 $g/m^2$ |
| Gelatin | 2.33 $g/m^2$ |
| ExC-1 | 0.76 $g/m^2$ |
| ExC-4 | 0.42 $g/m^2$ |
| Tricresyl phosphate | 0.62 $g/m^2$ |
| Compound of invention | $3.9 \times 10^{-4}$ $mol/m^2$ |
| (Protective layer) | |
| Gelatin | 2.00 $g/m^2$ |
| H-1 | 0.33 $g/m^2$ |
| B-1 (diam. 1.7 μm) | 0.10 $g/m^2$ |
| B-2 (diam. 1.7 μm) | 0.30 $g/m^2$ |
| B-3 | 0.10 $g/m^2$ |

The characteristics of emulsion Em-A and structural formulae of compounds employed in the above test sensitive material (A) were specified in Example 1 described later.

Among the heterocyclic compounds having one or two heteroatoms, those of the following general formula (I) are more preferred.

General formula (I)

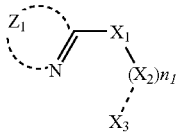

In the general formula (I), $Z_1$ represents a group for forming a heterocycle having one or two heteroatoms including the nitrogen atom of the formula. $X_1$ represents a sulfur atom, an oxygen atom, a nitrogen atom (N(Va)) or a carbon atom (C(Vb)(Vc)). Each of Va, Vb and Vc represents a hydrogen atom or a substituent. $X_2$ has the same meaning as that of $X_1$. $n_1$ is 0, 1, 2 or 3. When $n_1$ is 2 or greater, $X_2$ becomes multiple. It is not necessary for the multiple groups to be identical with each other. $X_3$ represents a sulfur atom, an oxygen atom or a nitrogen atom. The bond between $X_2$ and $X_3$ is single or double. Accordingly, $X_3$ may further have a substituent or a charge.

Among the heterocyclic compounds having one or two heteroatoms, those of the following general formula (II) are most preferred.

General formula (II)

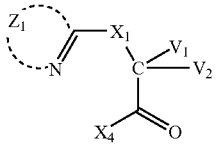

In the general formula (II), $Z_1$ and $X_1$ are as defined in the general formula (I). $X_4$ represents a sulfur atom (S(Vd)), an oxygen atom (O(Ve)) or a nitrogen atom (N(Vf)(Vg)). Each of Vd, Ve, Vf and Vg represents a hydrogen atom, a substituent or a negative charge. Each of $V_1$ and $V_2$ represents a hydrogen atom or a substituent.

The general formula (I) and general formula (II) will be described in detail below.

As the heterocycles formed by $Z_1$, there can preferably be mentioned those set forth above with respect to (aa-1) to (aa-18), (ab-1) to (ab-29), (ac-1) to (ac-19) and (ad-1) to (ad-8), and preferred examples thereof are also the same. These heterocycles, unless contrary to the definition of "heterocycle having one or two heteroatoms", may further have any substituents (for example, aforementioned W) or may be in the form of any condensed ring.

$X_1$ preferably represents a sulfur atom, an oxygen atom or a nitrogen atom, more preferably a sulfur atom or a nitrogen atom, and most preferably a sulfur atom. As the substituent represented by Va, Vb and Vc, there can be mentioned the aforementioned W, and preferred substituents are an alkyl group, an aryl group and a heterocyclic group. $X_2$ preferably represents a carbon atom. $n_1$ is preferably 0, 1 or 2, more preferably 2. $X_3$ preferably represents an oxygen atom. The valence of $X_3$ changes depending on whether the bond between $X_2$ and $X_3$ is single or double. For example, when the bond between $X_2$ and $X_3$ is double and $X_3$ is an oxygen atom, $X_3$ represents a carbonyl group. On the other hand, when the bond between $X_2$ and $X_3$ is single and $X_3$ is an oxygen atom, $X_3$ represents, for example, a hydroxyl group, an alkoxy group, an oxygen atom having a negative charge or the like.

$X_4$ preferably represents an oxygen atom. As the substituents represented by Vd, Ve, Vf and Vg, there can be mentioned those aforementioned as being represented by W. Vd, Ve and at least one of Vf and Vg preferably represent hydrogen atoms and negative charges. As the substituent represented by $V_1$ and $V_2$, there can be mentioned the aforementioned W. At least one of $V_1$ and $V_2$ is preferably not a hydrogen atom, representing a substituent.

As the substituents, there can preferably be mentioned, for example, a halogen atom (e.g., a chlorine atom, a bromine atom or a fluorine atom); an alkyl group (having 1 to 60 carbon atoms, such as methyl, ethyl, propyl, isobutyl, t-butyl, t-octyl, 1-ethylhexyl, nonyl, undecyl, pentadecyl, n-hexadecyl or 3-decanamidopropyl); an alkenyl group (having 2 to 60 carbon atoms, such as vinyl, allyl or oleyl); a cycloalkyl group (having 5 to 60 carbon atoms, such as cyclopentyl, cyclohexyl, 4-t-butylcyclohexyl, 1-indanyl or cyclododecyl); an aryl group (having 6 to 60 carbon atoms, such as phenyl, p-tolyl or naphthyl); an acylamino group (having 2 to 60 carbon atoms, such as acetylamino, n-butanamido, octanoylamino, 2-hexyldecanamido, 2-(2',4'-di-t-amylphenoxy)butanamido, benzoylamino or nicotinamido); a sulfonamido group (having 1 to 60 carbon atoms, such as methanesulfonamido, octanesulfonamido or benzenesulfonamido); a ureido group (having 2 to 60 carbon atoms, such as decylaminocarbonylamino or di-n-octylaminocarbonylamino); a urethane group (having 2 to 60 carbon atoms, such as dodecyloxycarbonylamino, phenoxycarbonylamino or 2-ethylhexyloxycarbonylamino); an alkoxy group (having 1 to 60 carbon atoms, such as methoxy, ethoxy, butoxy, n-octyloxy, hexadecyloxy or methoxyethoxy); an aryloxy group (having 6 to 60 carbon atoms, such as phenoxy, 2,4-di-t-amylphenoxy, 4-t-octylphenoxy or naphthoxy); an alkylthio group (having 1 to 60 carbon atoms, such as methylthio, ethylthio, butylthio or hexadecylthio); an arylthio group (having 6 to 60 carbon atoms, such as phenylthio or 4-dodecyloxyphenylthio); an acyl group (having 1 to 60 carbon atoms, such as acetyl, benzoyl, butanoyl or dodecanoyl); a sulfonyl group (having 1 to 60 carbon atoms, such as methanesulfonyl, butanesulfonyl or toluenesulfonyl); a cyano group; a carbamoyl group (having 1 to 60 carbon atoms, such as N,N-dicyclohexylcarbamoyl); a sulfamoyl group (having 0 to 60 carbon atoms, such as N,N-dimethylsulfamoyl); a hydroxyl group; a sulfo group; a carboxyl group; a nitro group; an alkylamino group (having 1 to 60 carbon atoms, such as methylamino, diethylamino, octylamino or octadecylamino); an arylamino group (having 6 to 60 carbon atoms, such as phenylamino, naphthylaminor or N-methyl-N-phenylamino); a heterocyclic group (having 0 to 60 carbon atoms, preferably heterocyclic group wherein an atom selected from among a nitrogen atom, an oxygen atom and a sulfur atom is used as a heteroatom being a constituent of the ring, more preferably heterocyclic group wherein not only a heteroatom but also a carbon atom is used as constituent atoms of the ring, and especially heterocyclic group having a 3 to 8-, preferably 5 or 6-membered ring, such as heterocyclic groups listed above as being represented by W); and an acyloxy group (having 1 to 60 carbon atoms, such as formyloxy, acetyloxy, myristoyloxy or benzoyloxy).

Among these groups, the alkyl, cycloalkyl, aryl, acylamino, ureido, urethane, alkoxy, aryloxy, alkylthio, arylthio, acyl, sulfonyl, cyano, carbamoyl and sulfamoyl groups include those having substituents. Examples of such substituents include an alkyl group, a cycloalkyl group, an aryl group, an acylamino group, a ureido group, a urethane group, an alkoxy group, an aryloxy group, an alkylthio group, an arylthio group, an acyl group, a sulfonyl group, a cyano group, a carbamoyl group and a sulfamoyl group.

Among these substituents, an alkyl group, an aryl group, an alkoxy group and an aryloxy group are preferred. An alkyl group, an alkoxy group and an aryloxy group are more preferred. The most preferred substituent is a branched alkyl group.

The sum of carbon atoms of each of these substituents, although not particularly limited, is preferably in the range of 8 to 60, more preferably 10 to 57, still more preferably 12 to 55, and most preferably 16 to 53.

The compounds represented by the general formula (I) and general formula (II) are preferably those suitable for the following immobilization methods (1) to (7), more preferably immobilization method (1), (2) or (3), still more preferably immobilization method (1) or (2), and most preferably immobilization methods (1) and (2) simultaneously employed. That is, compounds simultaneously having'specified pKa and ballasting group can most preferably be employed.

The compounds of the present invention can contain, when required for neutralizing the charge thereof, a required number of required cations or anions. As representative cations, there can be mentioned inorganic cations such as proton ($H^+$), alkali metal ions (e.g., sodium ion, potassium ion and lithium ion) and alkaline earth metal ions (e.g., calcium ion); and organic ions such as ammonium ions (e.g., ammonium ion, tetraalkylammonium ion, triethylammonium ion, pyridinium ion, ethylpyridinium ion and 1,8-diazabicyclo[5,4,0]-7-undecenium ion). The anions can be inorganic anions or organic anions. As such, there can be mentioned halide anions (e.g., fluoride ion, chloride ion and iodide ion), substituted arylsulfonate ions (e.g., p-toluenesulfonate ion and p-chlorobenzenesulfonate ion), aryldisulfonate ions (e.g., 1,3-benzenedisulfonate ion, 1,5-naphthalenedisulfonate ion and 2,6-naphthalenedisulfonate ion), alkylsulfate ions (e.g., methylsulfate ion), sulfate ion, thiocyanate ion, perchlorate ion, tetrafluoroborate ion, picrate ion, acetate ion and trifluoromethanesulfonate ion. Further, use can be made of ionic polymers and other dyes having charges opposite to those of dyes. $CO_2^-$ and $SO_3^-$, when having a proton as a counter ion, can be indicated as $CO_2H$ and $SO_3H$, respectively.

In the present invention, it is preferred to use combinations of individual preferred compounds (especially combinations of individual most preferred compounds) mentioned above.

Among the heterocyclic compounds each having one or two heteroatoms according to the present invention, specified in the description of Best Mode for Carrying Out the Invention, especially preferred specific examples will be shown below, which however in no way limit the scope of the invention.

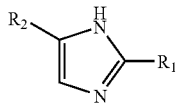

(a-1): $R_1$, $R_2$ = H
(a-2): $R_1$ = $CH_3$, $R_2$ = H
(a-3): $R_1$ = n-$C_3H_7$, $R_2$ = H
(a-4): $R_1$ = $SCH_3$, $R_2$ = H
(a-5): $R_1$ = H, $R_2$ = $CH_3$
(a-6): $R_1$ = H, $R_2$ = $CH_2CH_2NH_2$
(a-7): $R_1$ = H, $R_2$ = $CH_2CH(NH_2)CO_2H$)

(a-8)

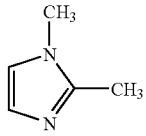

(a-9)

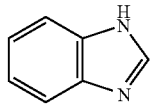

(a-10)

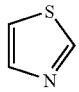

(a-11)

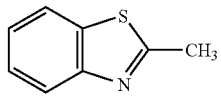

(a-12)

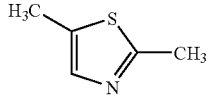

(a-13)

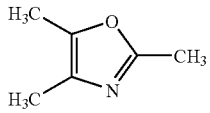

(a-14)

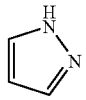

(a-15)

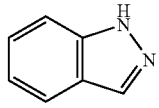

-continued (a-16)

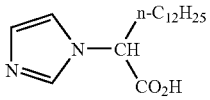

(a-17)

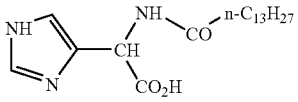

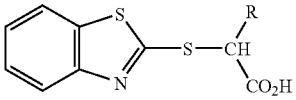

(a-18): R = n-$C_{12}H_{25}$
(a-19): R = n-$C_{16}H_{33}$ (a-20)

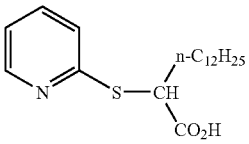

(a-21)

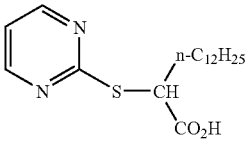

With respect to the heterocyclic compounds each having one or two heteroatoms according to the present invention, although as aforementioned those not reactive with developing agent oxidation products are preferred, those reactive with developing agent oxidation products include compounds of the following general formulae.

(III-1)

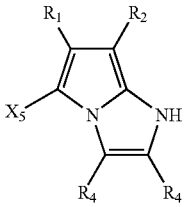

(III-2)

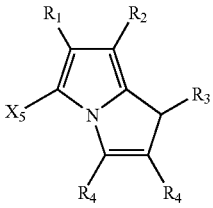

(III-3)

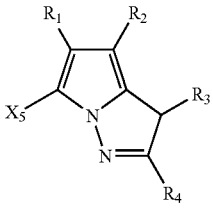

-continued (III-4)

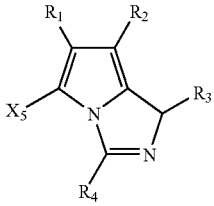

In the general formulae (III-1) to (III-4), each of $R_1$, $R_2$ and $R_3$ independently represents electron withdrawing groups whose Hammett substituent constant σp value is in the range of 0.2 to 1.0. $R_4$ represents a hydrogen atom or a substituent, provided that when there are two $R_4$'s in the formula, they may be identical with or different from each other. $X_5$ represents a hydrogen atom or a substituent. The groups represented by $R_1$, $R_2$ $R_3$, $R_4$ and $X_5$ are the same as those represented by $R_{11}$, $R_{12}$, $R_{13}$, $R_{14}$ and $X_{11}$ described later, respectively, and those preferred are also the same.

Among the heterocyclic compounds each having one or two heteroatoms which react with developing agent oxidation products, especially preferred specific examples will be shown below, which however naturally in no way limit the scope of the invention.

(a-22)

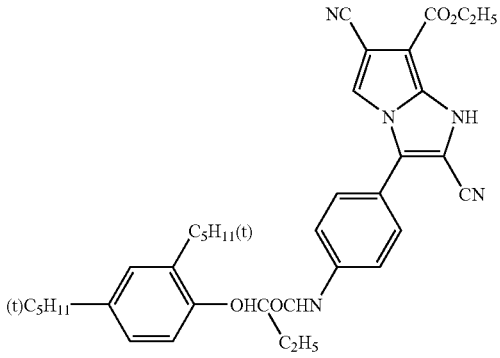

(a-23)

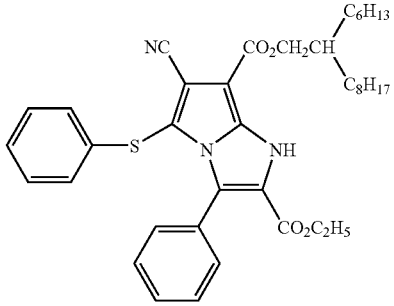

(a-24)

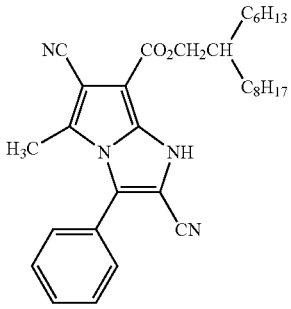

-continued (a-25)

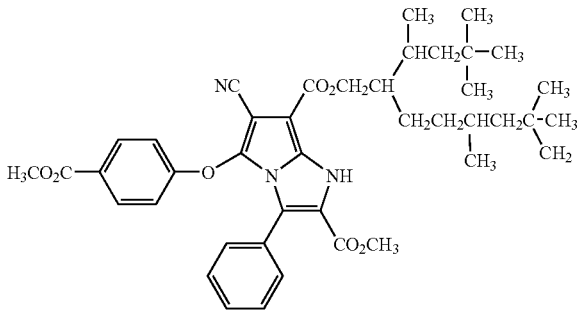

(a-26)

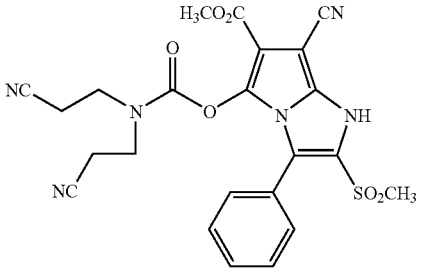

(a-27)

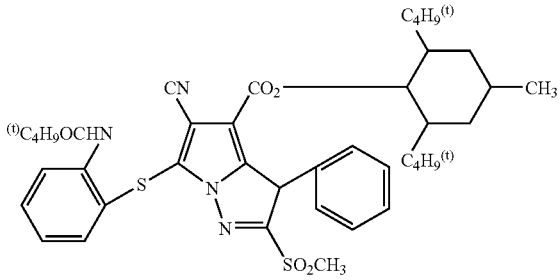

(a-28)

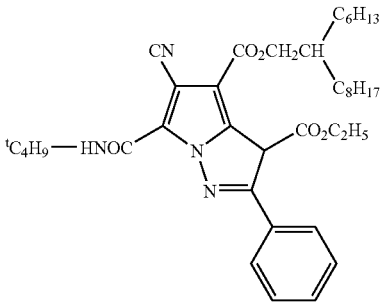

As the heterocyclic compounds each having one or two heteroatoms, use can be made of those described in, for example, "The Chemistry of Heterocyclic Compounds—A Series of Monographs" vol. 1–59, edited by Edward C. Taylor and Arnold Weissberger and published by John Wiley & Sons and "Heterocyclic Compounds" vol. 1–6, edited by Robert C. Elderfield and published by John Wiley & Sons. The heterocyclic compounds each having one or two heteroatoms can be synthesized by the processes described therein.

Synthetic Example: synthesis of compound (a-18)

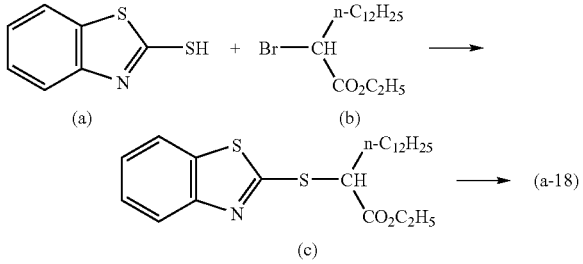

A mixture of 7.4 g of compound (a), 13.4 g of compound (b), 100 milliliters (hereinafter, milliliter also referred to as "mL") and 10 mL of dimethylacetamide was agitated at an internal temperature of 10° C. or below while cooling with ice. 6.1 mL of triethylamine was dropped into the mixture and agitated at room temperature for 2 hr. Thereafter, 200 mL of ethyl acetate was added to the reaction solution. Washing with a dilute aqueous NaOH solution and fractionation, washing with a dilute hydrochloric acid and fractionation and washing with a saturated saline solution and fractionation were sequentially performed, and the obtained ethyl acetate layer was dried over magnesium sulfate. Solvent was evaporated in vacuum, and the concentrate was purified through silica gel column chromatography (eluant: 19:1 hexane and ethyl acetate), thereby obtaining 16.2 g of compound (c) (yield 96%). A mixture of 14.8 g of compound (c), 2.8 g of NaOH, 50 mL of ethanol and 5 mL of water was agitated at room temperature for 2 hr, and 200 mL of water was added thereto. The mixture was washed with hexane and fractionated, and the hexane layer was removed. 200 mL of ethyl acetate together with dilute hydrochloric acid was added to the water layer and fractionated, and the water layer was removed. Further, the mixture was washed with a saturated saline solution and fractionated. The ethyl acetate layer was dried over magnesium sulfate and concentrated in vacuum until the amount of solvent became 30 mL. Hexane was added to the concentrate, and agitated. Precipitated crystal was collected by suction filtration and dried. Thus, 13.2 g of colorless crystal (a-18) (melting point 75 to 77° C.) was obtained (yield 96%).

The heterocyclic compounds each having three or more heteroatoms for use in the present invention will now be described. The heteroatom refers to an atom other than carbon and hydrogen atoms. The heterocycle refers to a cyclic compound having at least one heteroatom. In this aspect of the present invention, the heterocycle is a heterocyclic compound having three or more heteroatoms. The heteroatoms of the "heterocycle having three or more heteroatoms" refer to only atoms as constituents of a heterocyclic ring system, and do not mean atoms positioned outside the ring system, atoms separated through at least one nonconjugated single bond from the ring system and atoms as parts of further substituents of the ring system.

With respect to polynuclear heterocycles, only those wherein the number of heteroatoms in all the ring systems is 3 or more are included in the present invention. For example, with respect to 1H-pyrazolo[1,5-h][1,2,4]triazole, the number of heteroatoms is 4 and hence the compound is included in the heterocycles each having three or more heteroatoms according to the present invention.

The number of heteroatoms, although there is no particular upper limit, is preferably 10 or less, more preferably 8 or less, still more preferably 6 or less, and most preferably 4 or less.

Although any heterocyclic compounds satisfying the above requirements can be employed, the heteroatom is, preferably a nitrogen atom, a sulfur atom, an oxygen atom, a selenium atom, a tellurium atom, a phosphorus atom, a silicon atom or a boron atom. More preferably, the heteroatom is a nitrogen atom, a sulfur atom or an oxygen atom. Still more preferably, the heteroatom is a nitrogen atom or a sulfur atom. Most preferably, the heteroatom is a nitrogen atom.

Although the number of members of heterocycles is not limited, a 3- to 8-membered ring is preferred. A 5- to 7-membered ring is more preferred. A 5- or 6-membered ring is still more preferred. A 5-membered ring is most preferred Although the heterocycles may be saturated or unsaturated, those having at least one unsaturated moiety are preferred. Those having at least two unsaturated moieties are more preferred. Stated in another way, although the heterocycle may be any of aromatic, pseudo-aromatic and non-aromatic heterocycles, aromatic and pseudo-aromatic heterocycles are preferred.

The heterocycle is preferably a polynuclear heterocycle resulting from ring condensation, most preferably a heterocycle of two rings.

Although the heterocyclic compounds having three or more heteroatoms may react or may not react with oxidizing developing agents, preferred use can be made of heterocyclic compounds which react with oxidizing developing agents.

Compounds represented by the following general formula (M) or general formula (C) can most preferably be used as the heterocycle having three or more heteroatoms according to the present invention.

(M)

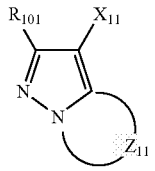

(C)

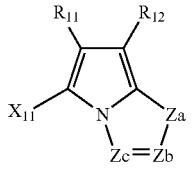

In the general formula (M), $R_{101}$ represents a hydrogen atom or a substituent. $Z_{11}$ represents a nonmetallic atom group required for forming a 5-membered azole ring containing 2 to 4 nitrogen atoms, which azole ring may have substituents (including a condensed ring). $X_{11}$ represents a hydrogen atom or a substituent.

In the general formula (C), Za represents —NH— or —CH($R_3$)—. Each of Zb and Zc independently represents —C($R_{14}$)═ or —N═, provided that when Za is —NH—, at least one of Zb and Zc is —N═ and that when Za is —CH($R_{13}$)—, both of Zb and Zc are —N═. Each of $R_{11}$, $R_{12}$ and $R_{13}$ independently represents electron withdrawing groups whose Hammett substituent constant σp value is in the range of 0.2 to 1.0. $R_{14}$ represents a hydrogen atom or a substituent, provided that when there are two $R_{14}$'s in the formula, they may be identical with or different from each other. $X_{11}$ represents a hydrogen atom or a substituent.

These compounds will be described in detail below. Among the skeletons represented by the formula (M), those preferred are 1H-pyrazolo[1,5-b][1,2,4]triazole and 1H-pyrazolo[5,1-c][1,2,4]triazole, respectively represented by the formulae (M-1) and (M-2).

(M-1)

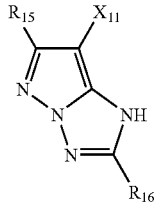

(M-2)

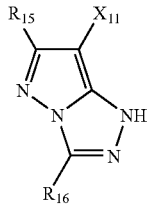

In the formulae, $R_{15}$ and $R_{16}$ represent substituents, and $X_{11}$ represents a hydrogen atom or a substituent.

The substituents $R_{15}$, $R_{16}$ and $X_{11}$ of the formulae (M-1) and (M-2) will be described in detail below.

As the substituent $R_{15}$, there can preferably be mentioned a halogen atom (e.g., a chlorine atom, a bromine atom or a fluorine atom); an alkyl group (having 1 to 60 carbon atoms, such as methyl, ethyl, propyl, isobutyl, t-butyl, t-octyl, 1-ethylhexyl, nonyl, undecyl, pentadecyl, n-hexadecyl or 3-decanamidopropyl); an alkenyl group (having 2 to 60 carbon atoms, such as vinyl, allyl or oleyl); a cycloalkyl group (having 5 to 60 carbon atoms, such as cyclopentyl, cyclohexyl, 4-t-butylcyclohexyl, 1-indanyl or cyclododecyl); an aryl group (having 6 to 60 carbon atoms, such as phenyl, p-tolyl or naphthyl); an acylamino group (having 2 to 60 carbon atoms, such as acetylamino, n-butanamido, octanoylamino, 2-hexyldecanamido, 2-(2',4'-di-t-amylphenoxy)butanamido, benzoylamino or nicotinamido); a sulfonamido group (having 1 to 60 carbon atoms, such as methanesulfonamido, octanesulfonamido or benzenesulfonamido); a ureido group (having 2 to 60 carbon atoms, such as decylaminocarbonylamino or di-n-octylaminocarbonylamino); a urethane group (having 2 to 60 carbon atoms, such as dodecyloxycarbonylamino, phenoxycarbonylamino or 2-ethylhexyloxycarbonylamino); an alkoxy group (having 1 to 60 carbon atoms, such as methoxy, ethoxy, butoxy, n-octyloxy, hexadecyloxy or methoxyethoxy); an aryloxy group (having 6 to 60 carbon atoms, such as phenoxy, 2,4-di-t-amylphenoxy, 4-t-octylphenoxy or naphthoxy); an alkylthio group (having 1 to 60 carbon atoms, such as methylthio, ethylthio, butylthio or hexadecylthio); an arylthio group (having 6 to 60 carbon atoms, such as phenylthio or 4-dodecyloxyphenylthio); an acyl group (having 1 to 60 carbon atoms, such as acetyl, benzoyl, butanoyl or dodecanoyl); a sulfonyl group (having 1 to 60 carbon atoms, such as methanesulfonyl, butanesulfonyl or toluenesulfonyl); a cyano group; a carbamoyl group (having 1 to 60 carbon atoms, such as N,N-dicyclohexylcarbamoyl); a sulfamoyl group (having 0 to 60 carbon atoms, such as N,N-dimethylsulfamoyl); a hydroxyl group; a sulfo group; a carboxyl group; a nitro group; an alkylamino group (having 1 to 60 carbon atoms, such as methylamino, diethylamino, octylamino or octadecylamino); an arylamino group (having 6 to 60 carbon atoms, such as phenylamino, naphthylaminor or N-methyl-N-phenylamino); a heterocyclic group (having 0 to 60 carbon atoms, preferably heterocyclic group wherein an atom selected from among a nitrogen atom, an oxygen atom and a sulfur atom is used as a heteroatom being a constituent of the ring, more preferably heterocyclic group wherein not only a heteroatom but also a carbon atom is used as constituent atoms of the ring, and especially heterocyclic group having a 3 to 8-, preferably 5 or 6-membered ring, such as heterocyclic groups listed below as being represented by $X_{11}$); or an acyloxy group (having 1 to 60 carbon atoms, such as formyloxy, acetyloxy, myristoyloxy or benzoyloxy).

Among these groups, the alkyl, cycloalkyl, aryl, acylamino, ureido, urethane, alkoxy, aryloxy, alkylthio, arylthio, acyl, sulfonyl, cyano, carbamoyl and sulfamoyl groups include those having substituents. Examples of such substituents include an alkyl group, a cycloalkyl group, an aryl group, an acylamino group, a ureido group, a urethane group, an alkoxy group, an aryloxy group, an alkylthio group, an arylthio group, an acyl group, a sulfonyl group, a cyano group, a carbamoyl group and a sulfamoyl group.

Among these substituents, an alkyl group, an aryl group, an alkoxy group and an aryloxy group are preferred as $R_{15}$. An alkyl group, an alkoxy group and an aryloxy group are more preferred. The most preferred substituent is a branched alkyl group.

It is preferred that $R_{16}$ represent substituents mentioned as being represented by $R_{12}$. More preferred substituents are an alkyl group, an aryl group, a heterocyclic group, an alkoxy group and an aryloxy group.

Still more preferred groups are an alkyl group and a substituted aryl group. The most preferred group is a substituted aryl group. The compounds of the general formulae (M-3) and (M-4) are preferred.

With respect to the substituents on the azole ring containing $R_{101}$, $X_{11}$, and $Z_{11}$ of the general formula (M), the sum of carbon atoms thereof, although not particularly limited, is preferably in the range of 13 to 60, more preferably 20 to 50 from the viewpoint that not only can the adsorption on emulsion grains be increased but also the sensitivity/graininess improving effect can be enhanced.

(M-3)

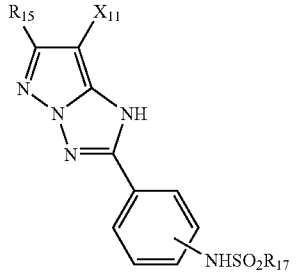

-continued (M-4)

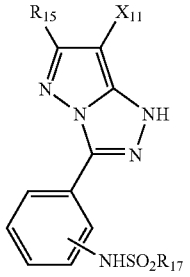

In the formulae, $R_{15}$ and $X_{11}$ are as defined in the general formulae (M-1) and (M-2). $R_{17}$ represents a substituent. As the substituents represented by $R_{17}$, there can preferably be mentioned those set forth above as examples of the $R_{15}$ substituents. As the $R_{17}$ substituents, there can more preferably be mentioned a substituted aryl group and a substituted or unsubstituted alkyl group. The substitution thereof is preferably accomplished by substituents mentioned above as examples of the $R_{15}$ substituents.

$X_{11}$ represents a hydrogen atom or a substituent. As the substituent, there can preferably be mentioned those set forth above as examples of the $R_{15}$ substituents. The substituent represented by $X_{11}$ is preferably an alkyl group, an alkoxycarbonyl group, a carbamoyl group or a group split off at the reaction with developing agent oxidation products. As this group, there can be mentioned, for example, a halogen atom (e.g., a fluorine atom, a chlorine atom or a bromine atom); an alkoxy group (e.g., ethoxy, methoxycarbonylmethoxy, carboxypropyloxy, methanesulfonylethoxy or perfluoropropoxy); an aryloxy group (e.g., 4-carboxyphenoxy, 4-(4-hydroxyphenylsulfonyl)phenoxy, 4-methanesulfonyl-3-carboxyphenoxy or 2-methanesulfonyl-4-acetylsulfamoylphenoxy); an acyloxy group (e.g., acetoxy or benzoyloxy); a sulfonyloxy group (e.g., methanesulfonyloxy or benzenesulfonyloxy); an acylamino group (e.g., heptafluorobutyrylamino); a sulfonamido group (e.g., methanesulfonamido); an alkoxycarbonyloxy group (e.g., ethoxycarbonyloxy); a carbamoyloxy group (e.g., diethylcarbamoyloxy, piperidinocarbonyloxy or morpholinocarbonyloxy); an alkylthio group (e.g., 2-carboxyethylthio); an arylthio group (e.g., 2-octyloxy-5-t-octylphenylthio or 2-(2,4-di-t-amylphenoxy)butyrylaminophenylthio); a heterocyclic thio group (e.g., 1-phenyltetrazolylthio or 2-benzimidazolylthio); a heterocyclic oxy group (e.g., 2-pyridyloxy or 5-nitro-2-pyridyloxy); a 5- or 6-membered nitrogenous heterocyclic group (e.g., 1-triazolyl, 1-imidazolyl, 1-pyrazolyl, 5-chloro-1-tetrazolyl, 1-benzotriazolyl, 2-phenylcarbamoyl-1-imidazolyl, 5,5-dimethylhydantoin-3-yl, 1-benzylhydantoin-3-yl, 5,5-dimethyloxazolidine-2,4-dion-3-yl or purine); or an azo group (e.g., 4-methoxyphenylazo or 4-pivaloylaminophenylazo).

The substituent represented by $X_{11}$ is preferably an alkyl group, an alkoxycarbonyl group, a carbamoyl group, a halogen atom, an alkoxy group, an aryloxy group, an alkyl- or arylthio group or a 5- or 6-membered nitrogenous heterocyclic group capable of bonding at a nitrogen atom with coupling activity. The substituent is more preferably an alkyl group, a carbamoyl group, a halogen atom, a substituted aryloxy group, a substituted arylthio group, an alkylthio group or a 1-pyrazolyl group.

The compounds of the above general formulae (M-1) and (M-2) preferably employed in the present invention may form a dimer or further polymer through $R_{11}$ or $R_{12}$, and may be bonded with a polymer chain. In the present invention, the general formula (M-1) is preferred, and the general formula (M-3) is more preferred.

Now, the general formula (C) will be described. The general formula (C) of the present invention can more specifically be any of the following general formulae (bc-3) to (bc-6).

(bc-3)

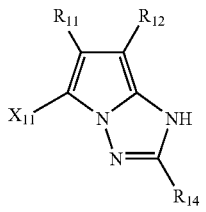

(bc-4)

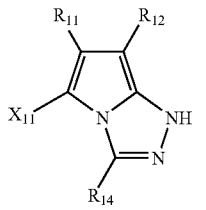

(bc-5)

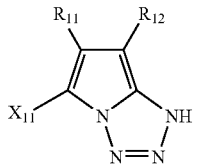

(bc-6)

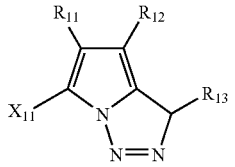

In the formulae, $R_{11}$ to $R_{14}$ and $X_{11}$ are as defined in the general formula (C).

In the present invention, the compounds of the general formulae (bc-3) and (bc-4) are preferred. The compounds of the general formula (bc-3) are more preferred.

In the general formula (C), the substituent represented by $R_{11}$, $R_{12}$ or $R_{13}$ is an electron withdrawing group whose Hammett substituent constant σp value is in the range of 0.20 to 1.0. Preferably, the σp value is in the range of 0.2 to 0.8. Hammett's rule is a rule of thumb advocated by L. P. Hammett in 1935 for quantitatively considering the effect of 15 substituents on the reaction or equilibrium of benzene derivatives, and the appropriateness thereof is now widely recognized. The substituent constant determined in the Hammett's rule involves σp value and σm value. These values can be found in a multiplicity of general publications, and are detailed in, for example, "Lange's Handbook of Chemistry" 12th edition by J. A. Dean, 1979 (Mc Graw-Hill), "Kagaku no Ryoiki" special issue, no. 122, p.p. 96 to 103, 1979 (Nankodo), and Chemical Review, vol. 91, pp. 165–195, 1991.

Although in the present invention, the substituents $R_{11}$, $R_{12}$ and $R_{13}$ are limited by the Hammett substituent constant values, this should not be construed as limitation to only substituents whose values are known from literature and can be found in the above publications, and should naturally be construed as including substituents whose values, even if unknown from literature, would be included in stated ranges when measured according to the Hammett's rule.

Examples of the electron withdrawing groups whose σp values are in the range of 0.2 to 1.0 include an acyl group, an alkoxycarbonyl group, an aryloxycarbonyl group, a carbamoyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group and the like. Groups capable of having further substituents among these substituents may have further substituents as mentioned later with respect to $R_{14}$.

Each of $R_{11}$, $R_{12}$ and $R_{13}$ preferably represents an acyl group, an alkoxycarbonyl group, an aryloxycarbonyl group, a carbamoyl group, a cyano group or a sulfonyl group; and more preferably represents a cyano group, an acyl group, an alkoxycarbonyl group, an aryloxycarbonyl group or a carbamoyl group.

In a preferred combination of $R_{11}$ and $R_{12}$, $R_{11}$ represents a cyano group while $R_{12}$ represents an alkoxycarbonyl group.

$R_{14}$ represents a hydrogen atom or a substituent. This substituent can be any of the substituents mentioned above as being represented as $R_{15}$.

Preferred examples of the substituents represented by $R_{14}$ include an alkyl group, an aryl group, a heterocyclic group, an alkoxy group, an aryloxy group and an acylamino group. The substituent represented by $R_{14}$ is more preferably an alkyl group or a substituted aryl group, and most preferably a substituted aryl group. The substitution can be accomplished by any of those mentioned above.

$X_{11}$ has the same meaning as in the general formula (M).

Specific examples of those which react with oxidizing developing agents among the heterocyclic compounds having three or more heteroatoms preferably employed in the present invention will be shown below, which however in no way limit the scope of the present invention.

(b-1)

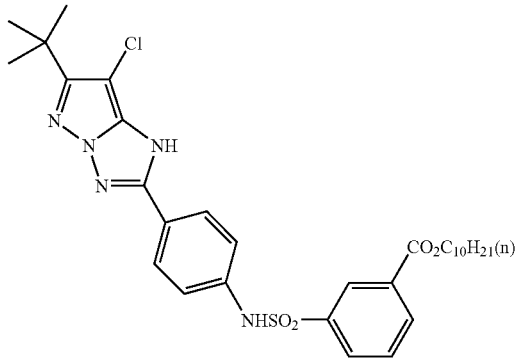

-continued
(b-2)
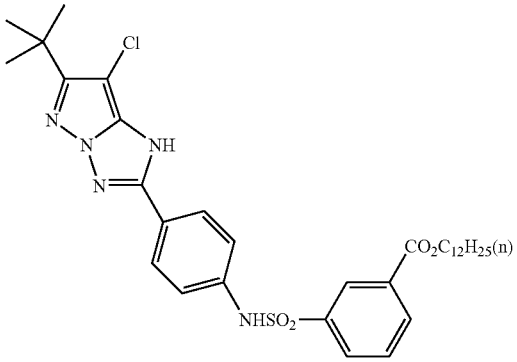
(b-3)
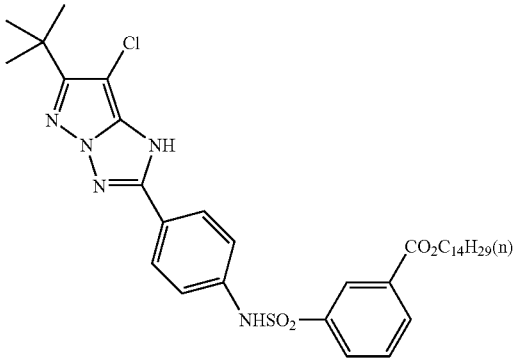
(b-4)
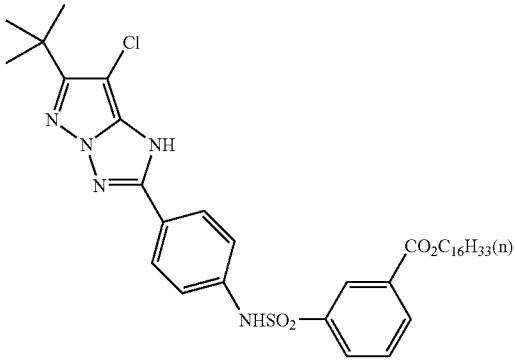
(b-5)
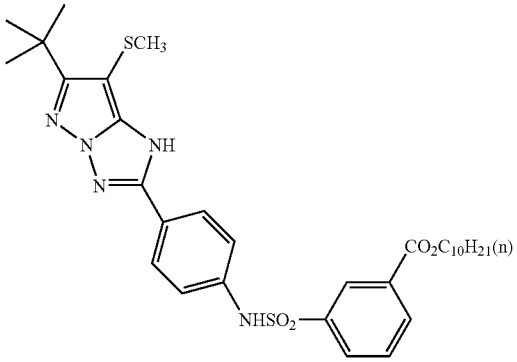
-continued
(b-6)
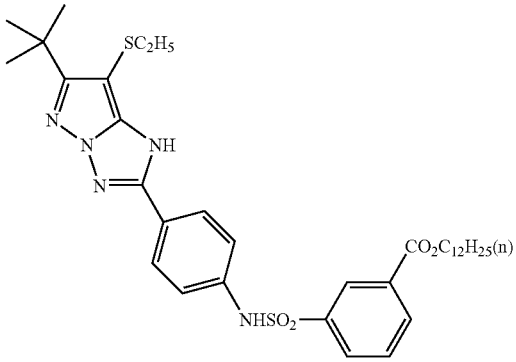
(b-7)
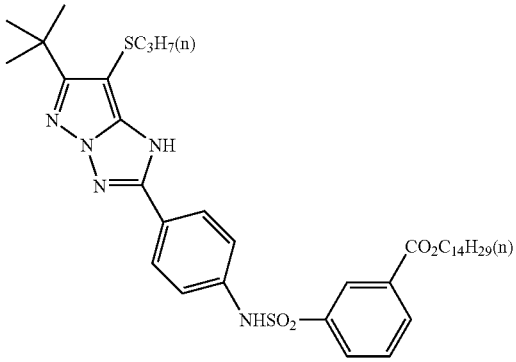
(b-8)
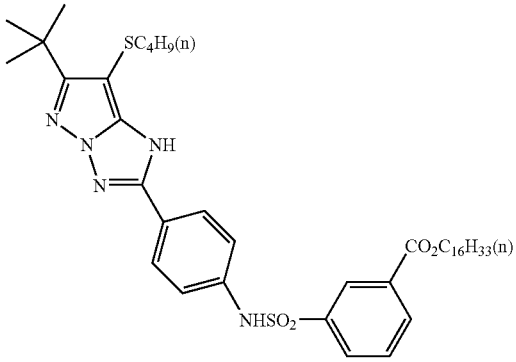
(b-9)
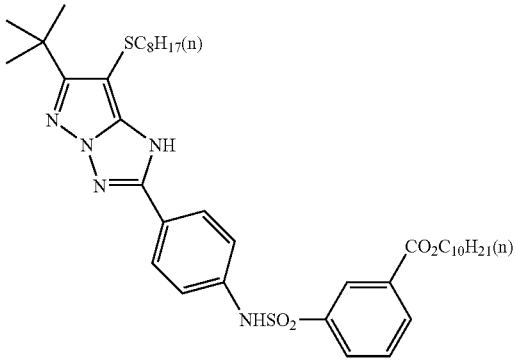

-continued
(b-10)
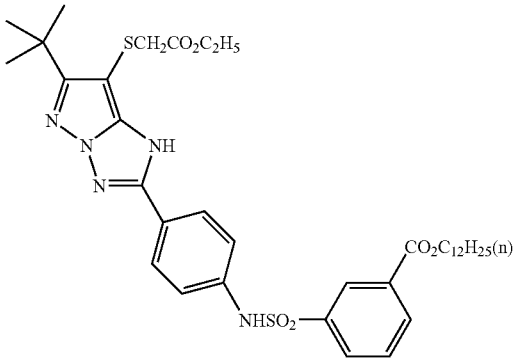
(b-11)
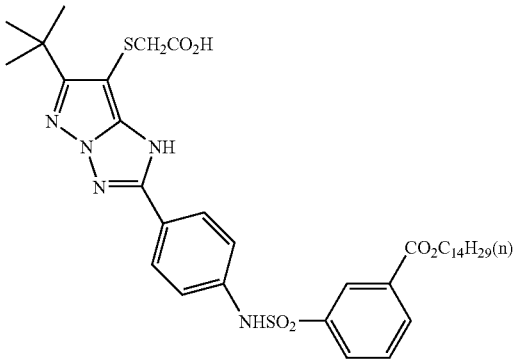
(b-12)
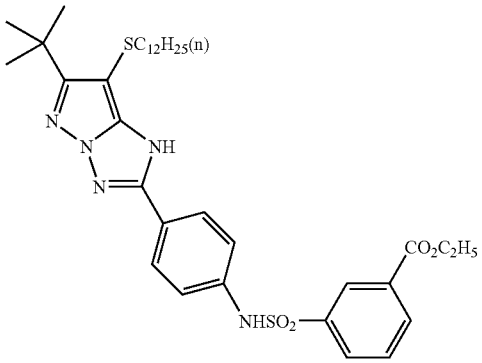
(b-13)
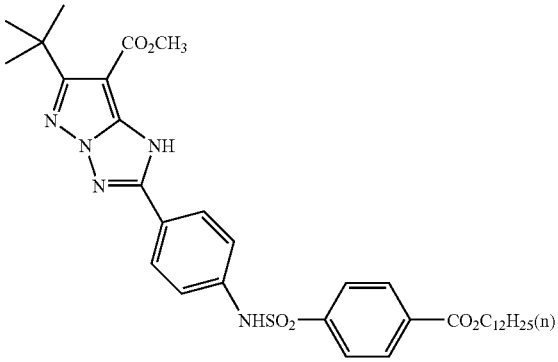
-continued
(b-14)
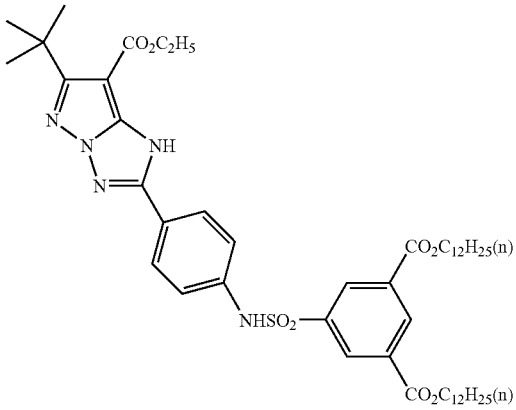
(b-15)
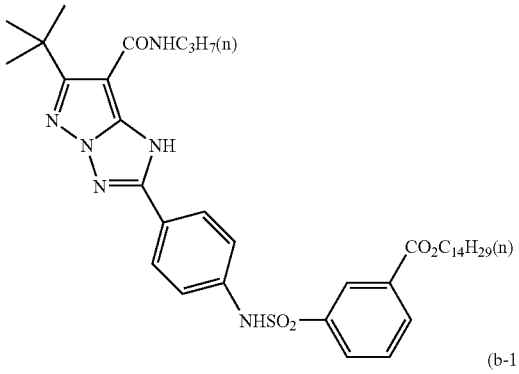
(b-16)
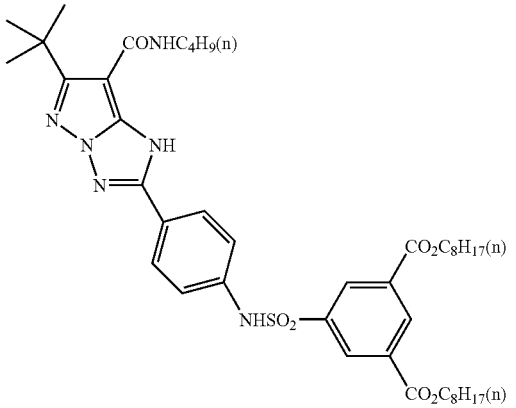
(b-17)
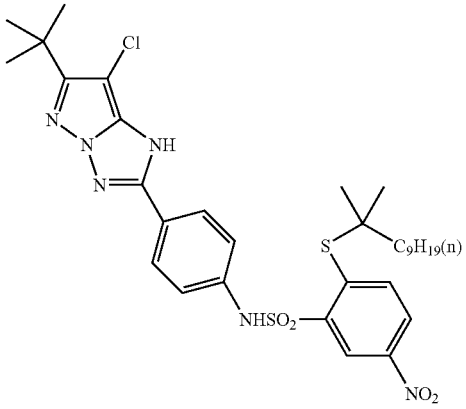

-continued
(b-18)
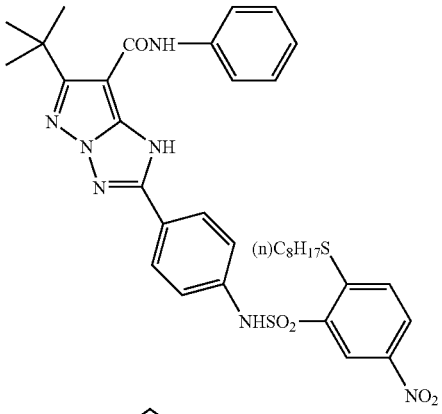
(b-19)
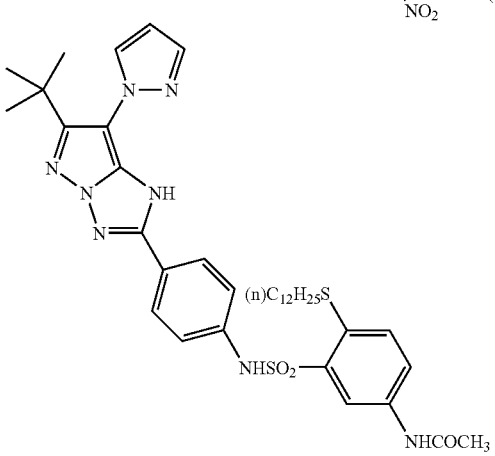
(b-20)
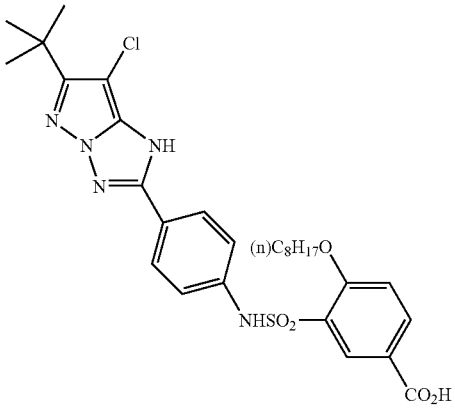
(b-21)
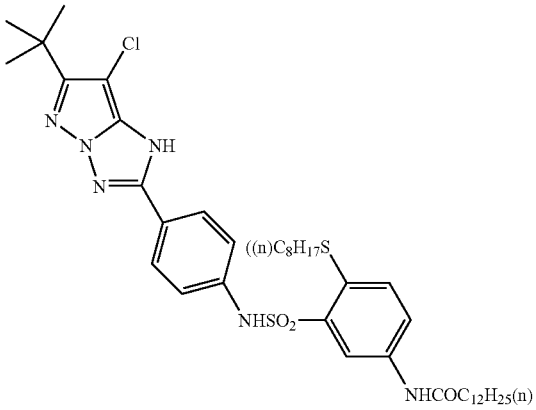
-continued
(b-22)
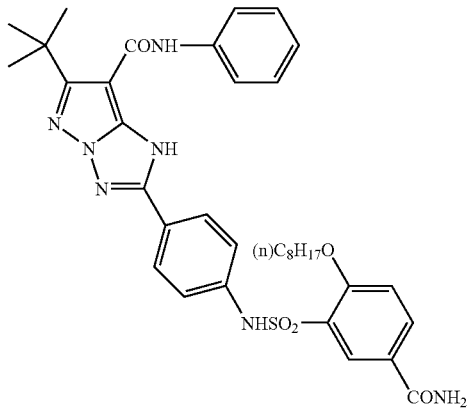
(b-23)
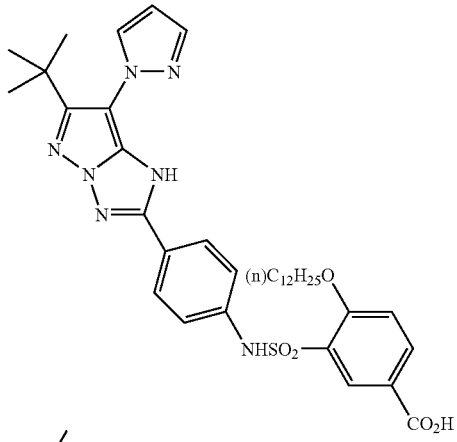
(b-24)
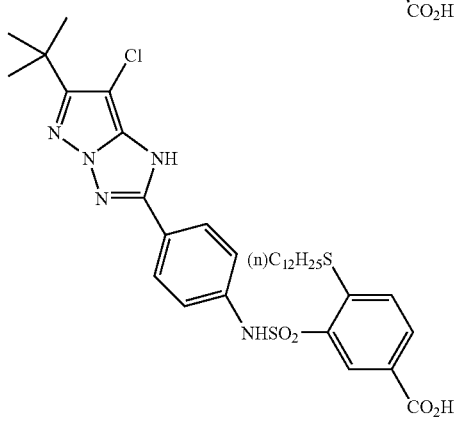
(b-25)
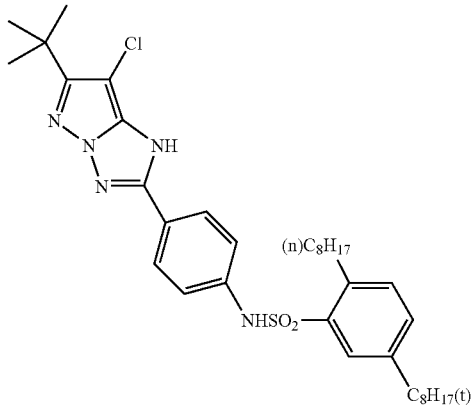

-continued
(b-26)
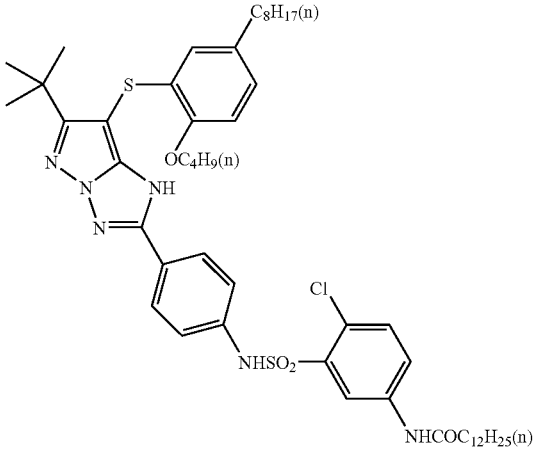
(b-27)
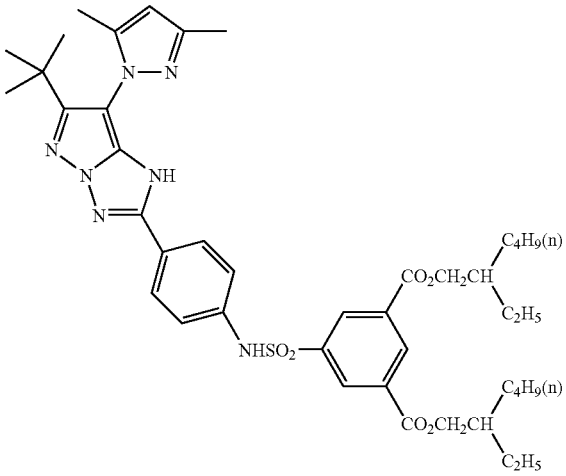
(b-28)
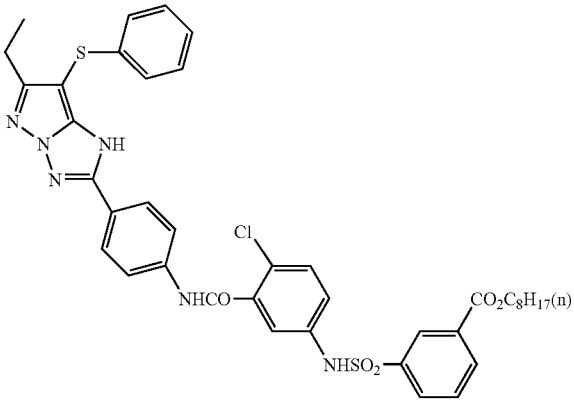
-continued
(b-29)
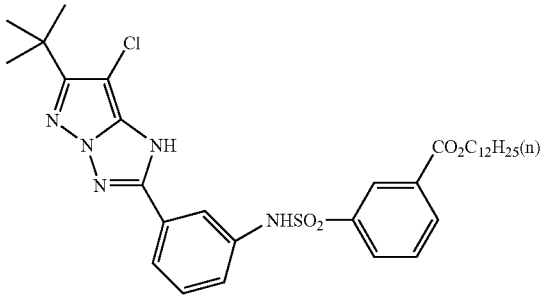
(b-30)
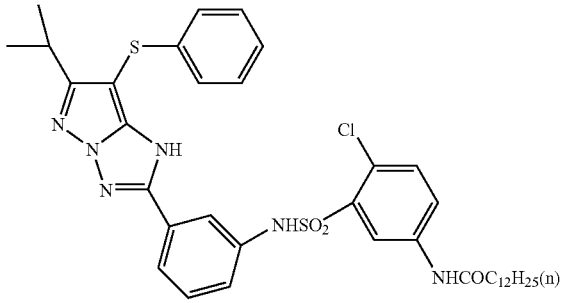
(b-31)
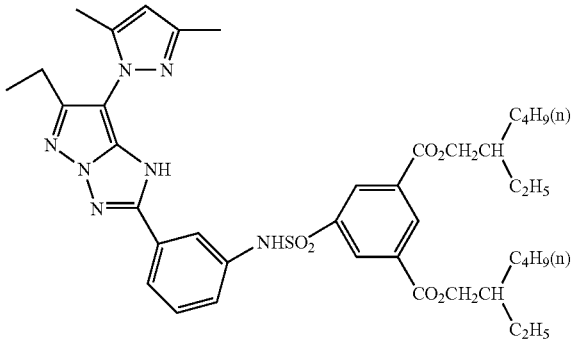
(b-32)
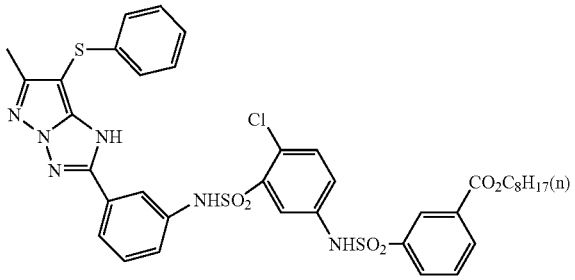

-continued
(b-33)
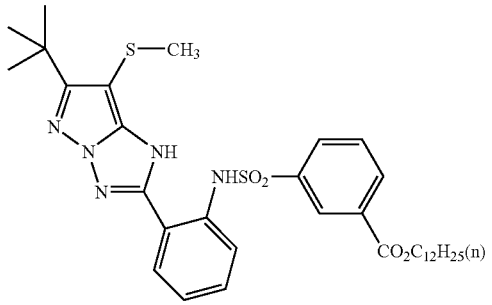
(b-34)
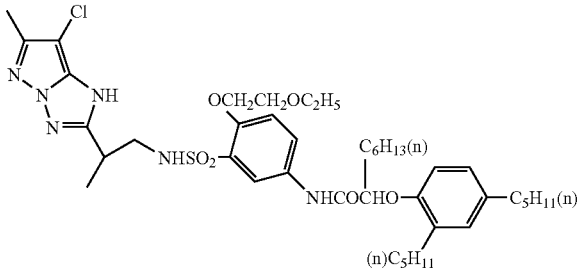
(b-35)
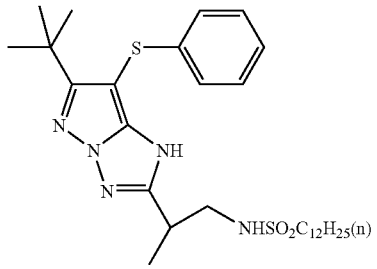
(b-36)
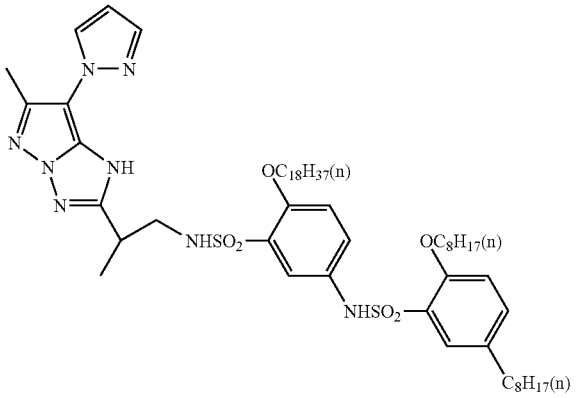
(b-37)
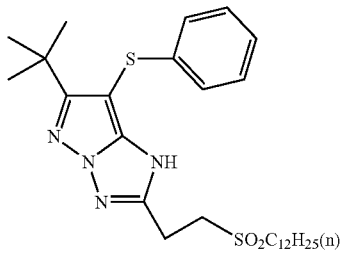
-continued
(b-38)
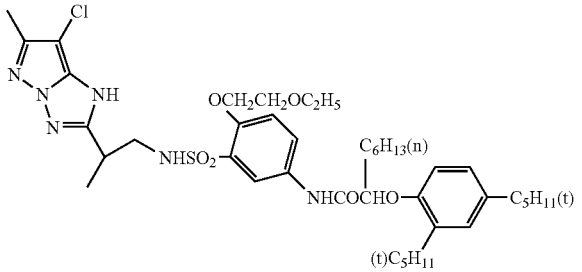
(b-39)
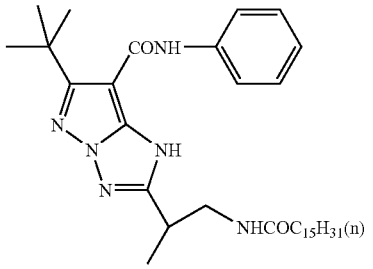
(b-40)
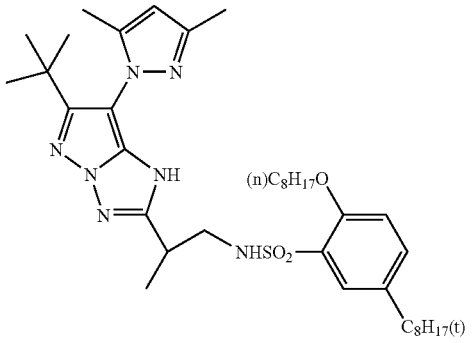
(b-41)
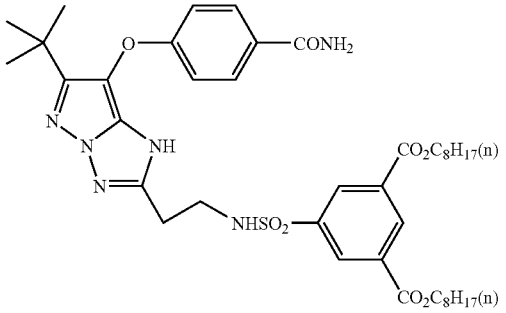
(b-42)
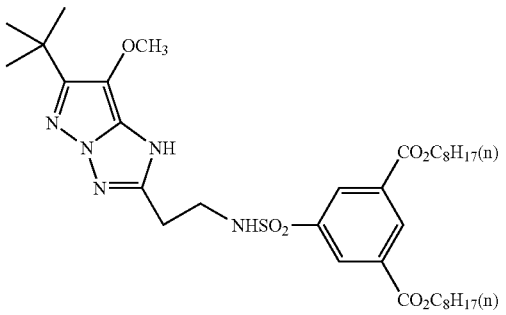

-continued
(b-43)
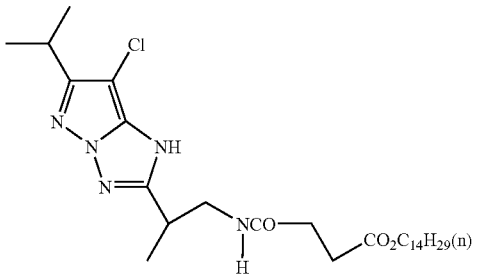
(b-44)
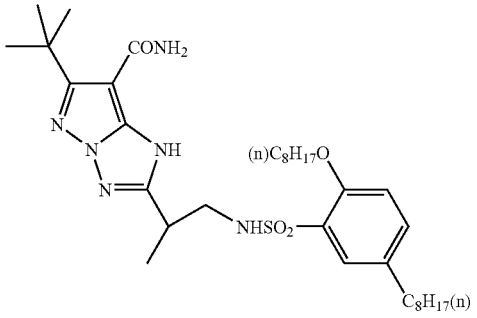
(b-45)
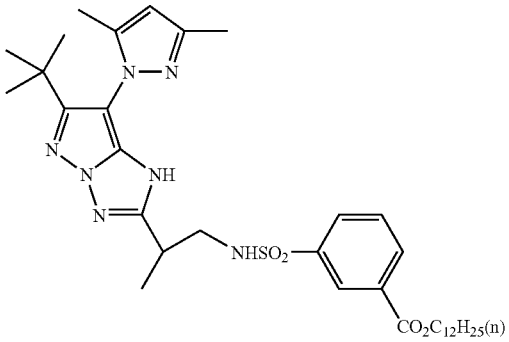
(b-46)
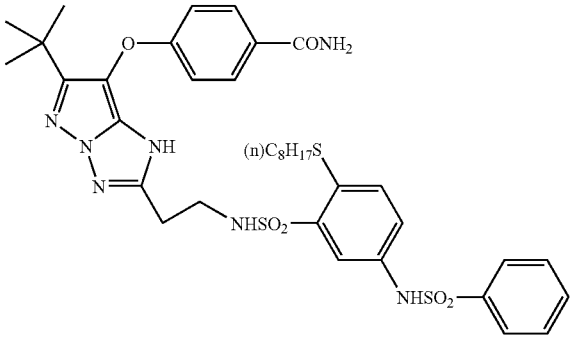
-continued
(b-47)
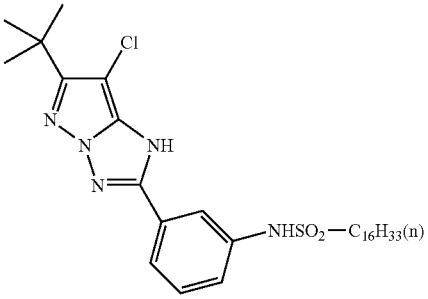
(b-48)
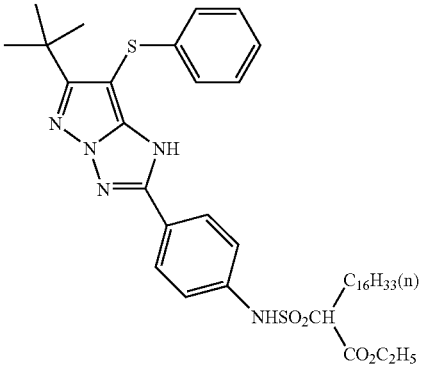
(b-49)
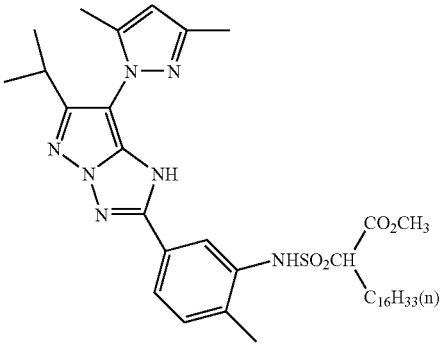
(b-50)
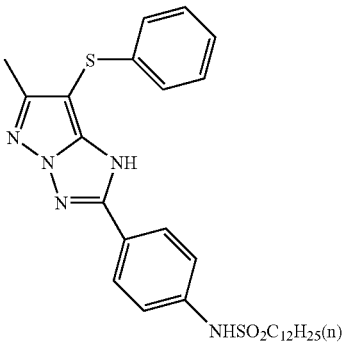

-continued
(b-51)
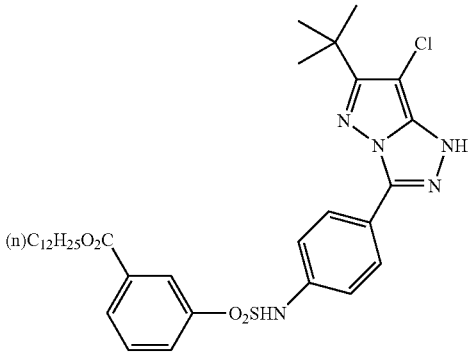
(b-52)
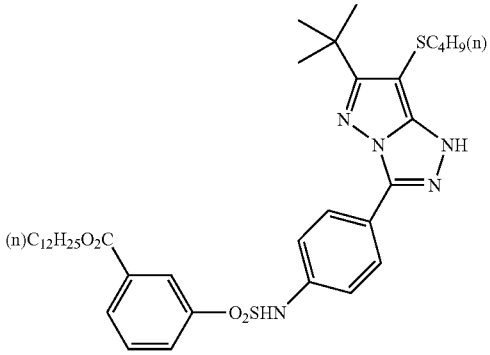
(b-53)
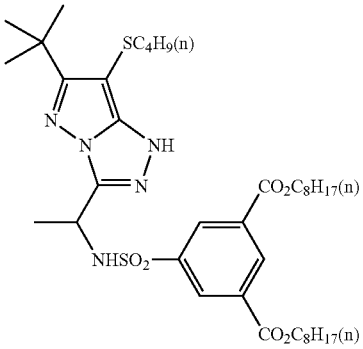
(b-54)
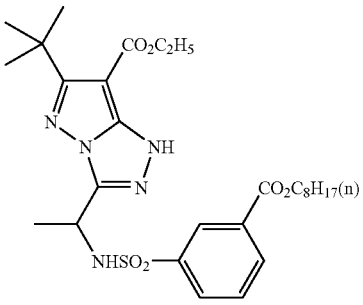
-continued
(b-55)
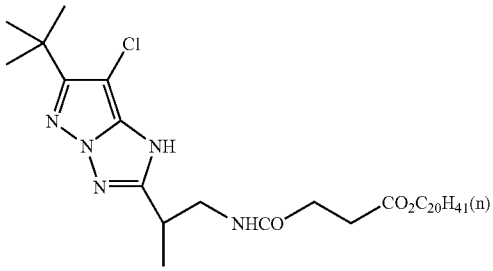
(b-56)
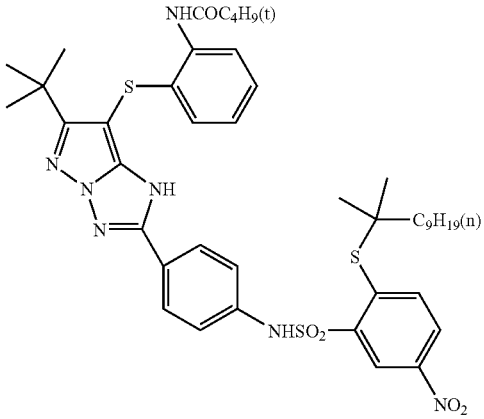
(b-57)
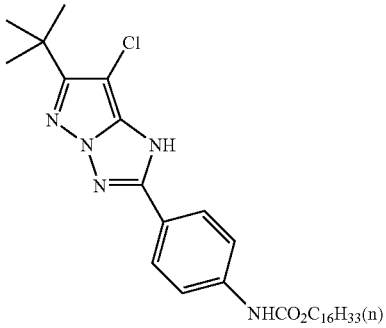
(b-58)
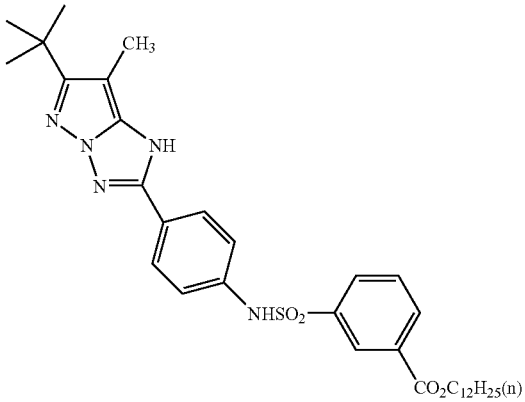

-continued
(b-59)
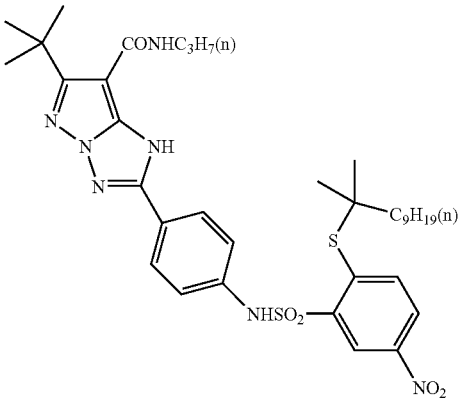
(b-60)
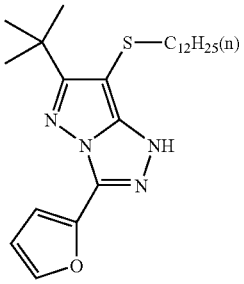
(b-61)
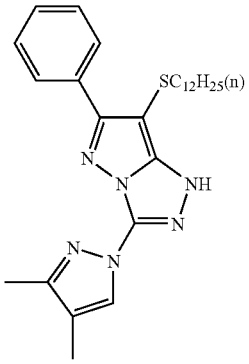
(b-62)
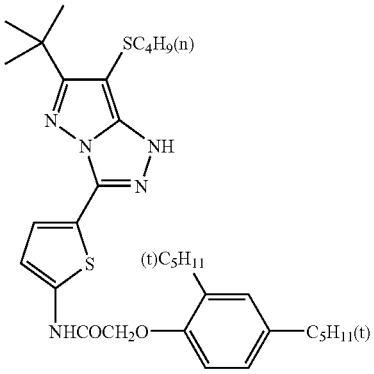
-continued
(b-63)
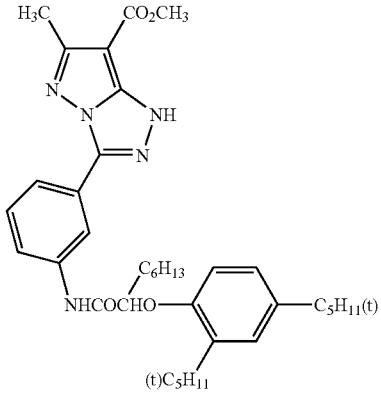
(b-64)
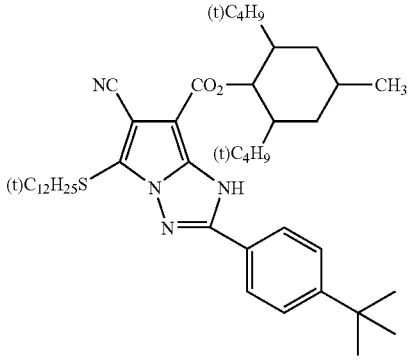
(b-65)
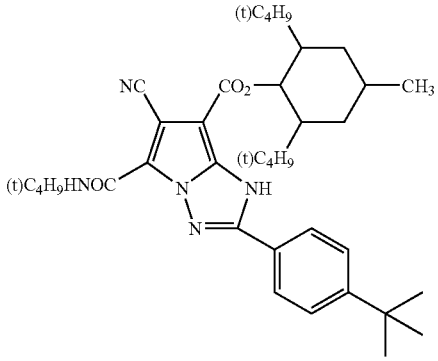
(b-66)
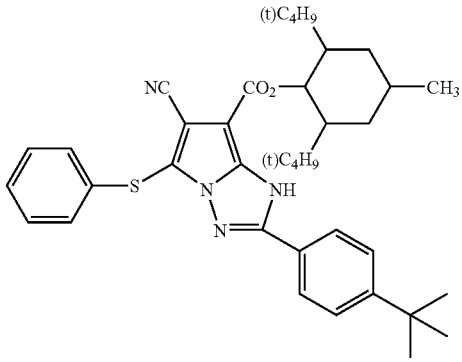

-continued
(b-67)
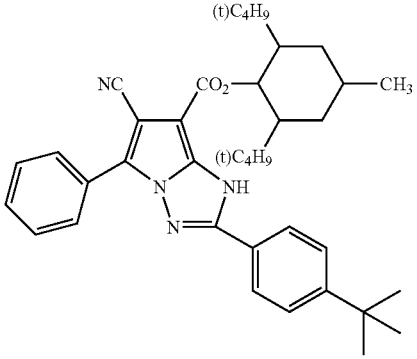
(b-68)
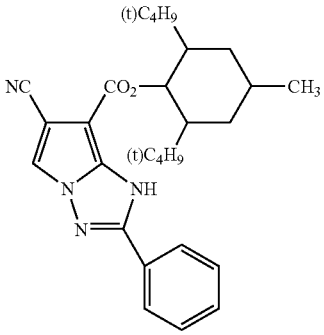
(b-69)
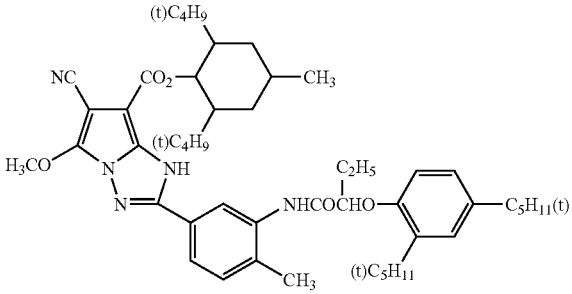
(b-70)
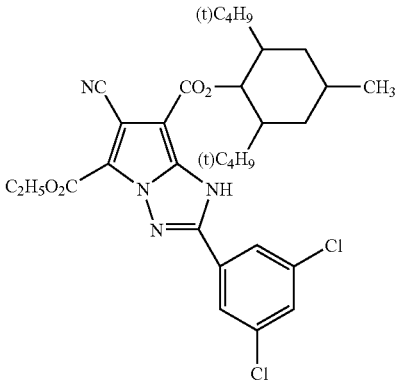
-continued
(b-71)
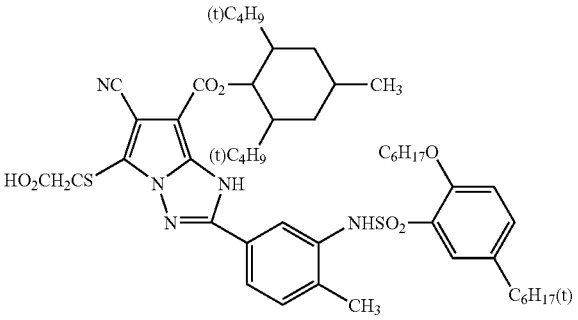
(b-72)
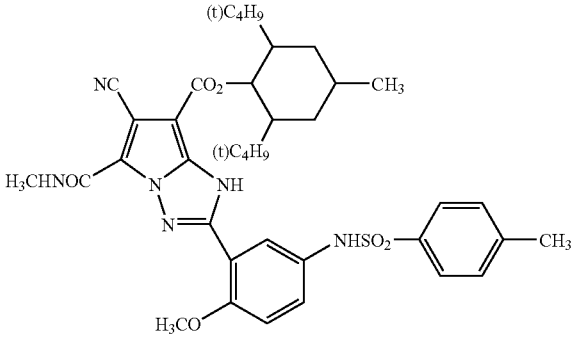
(b-73)
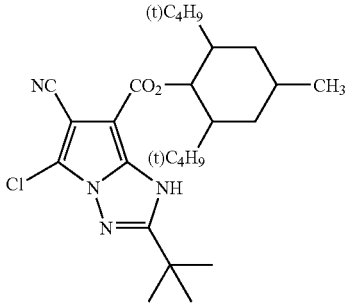
(b-74)
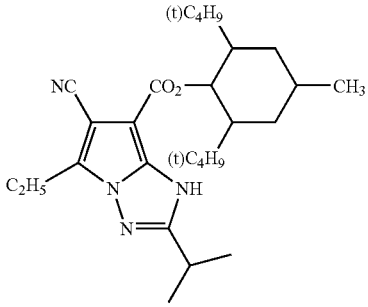
(b-75)
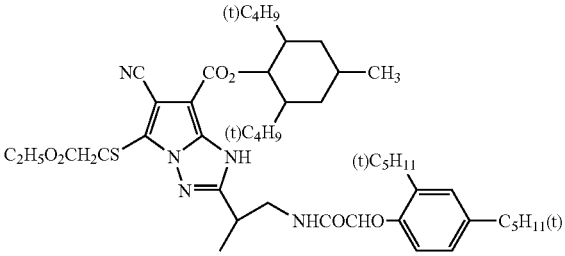

-continued
(b-76)
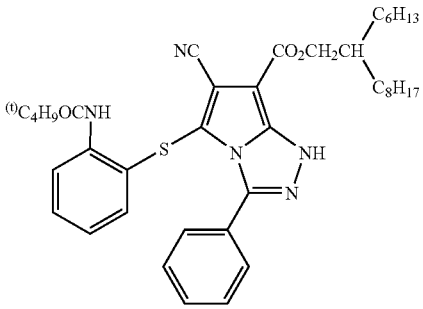
(b-77)
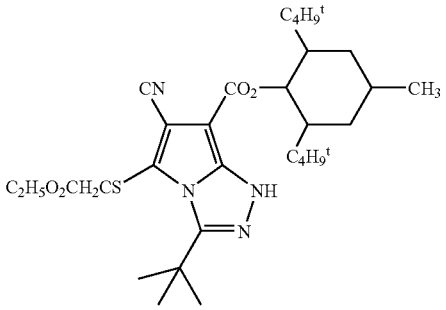
(b-78)
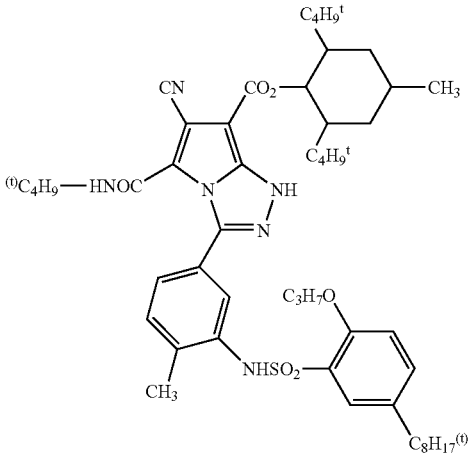
(b-79)
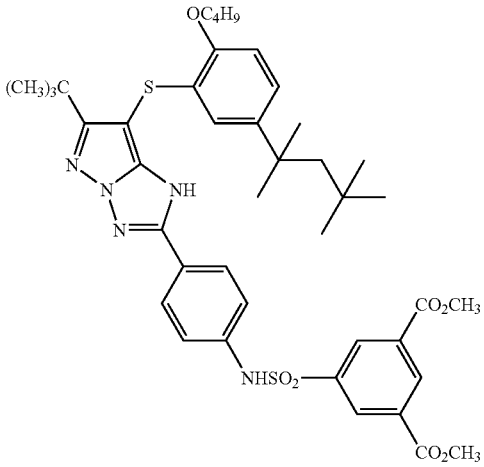
-continued
(b-80)
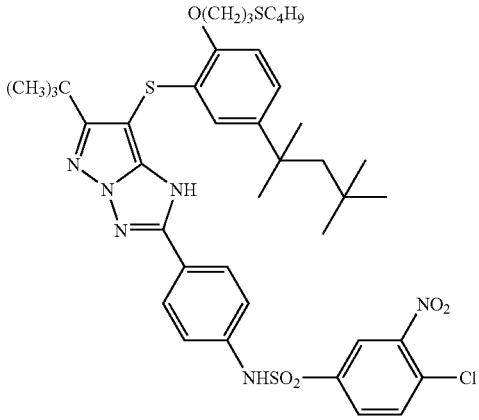
(b-81)
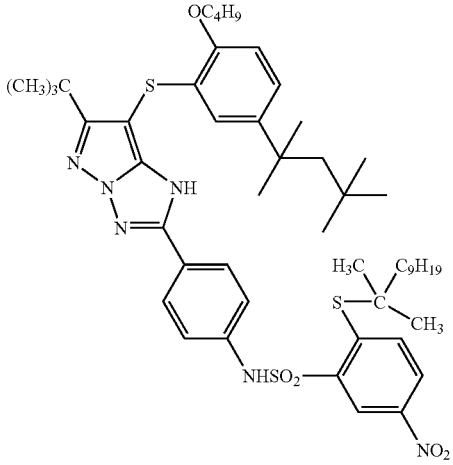
(b-82)
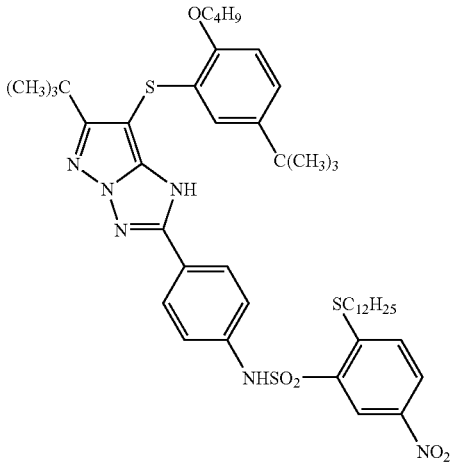

-continued
(b-83)
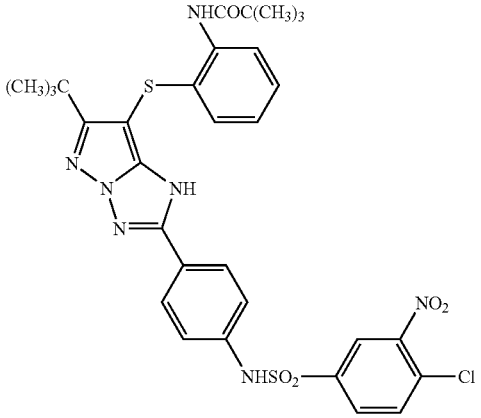
(b-84)
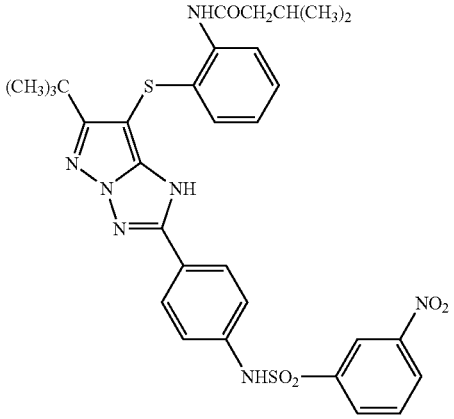
(b-85)
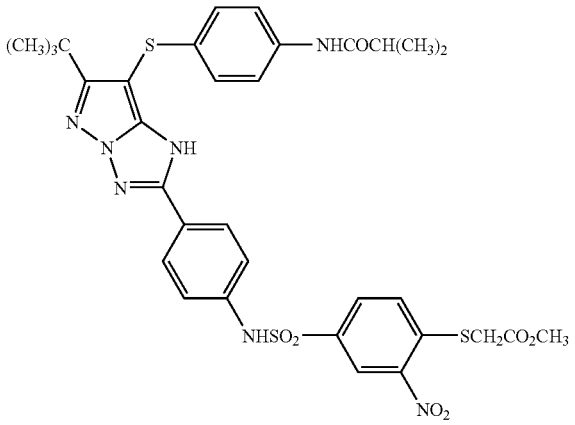
-continued
(b-86)
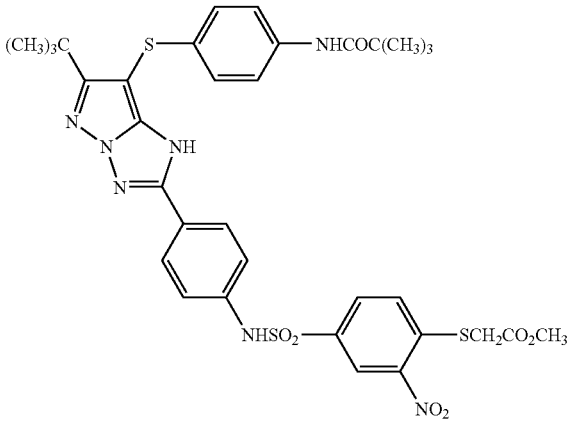
(b-87)
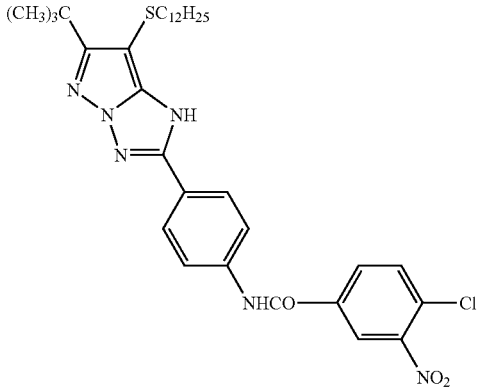
(b-88)
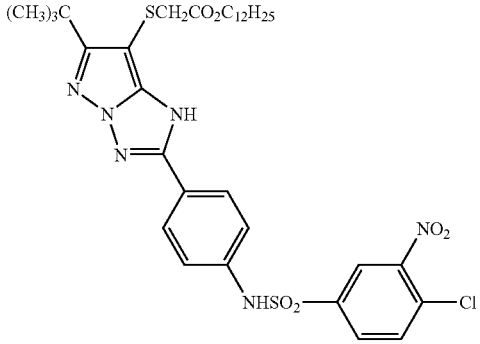
(b-89)
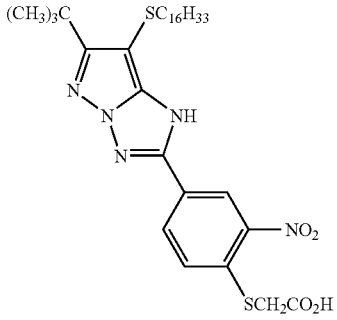

-continued
(b-90)
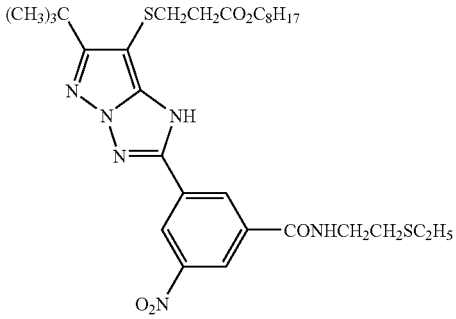
(b-91)
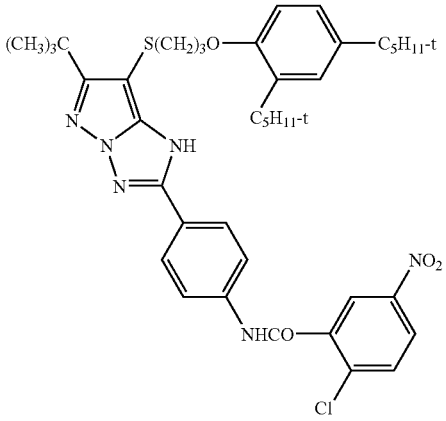
(b-92)
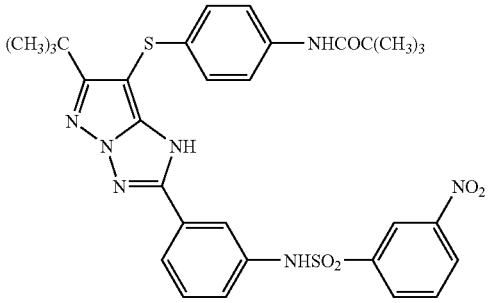
(b-93)
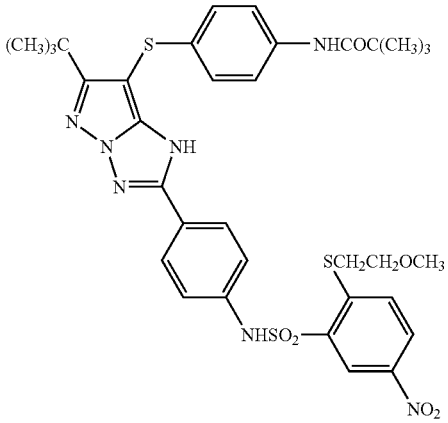
-continued
(b-94)
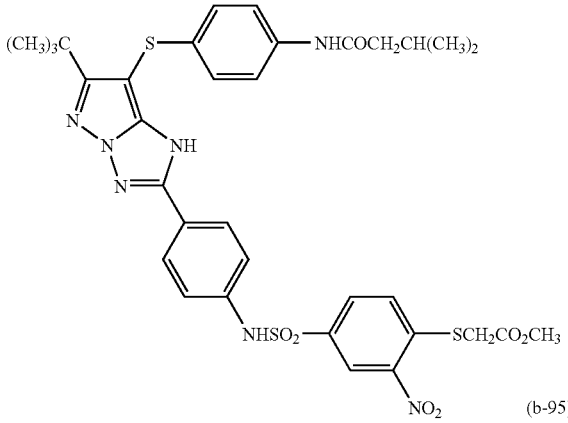
(b-95)
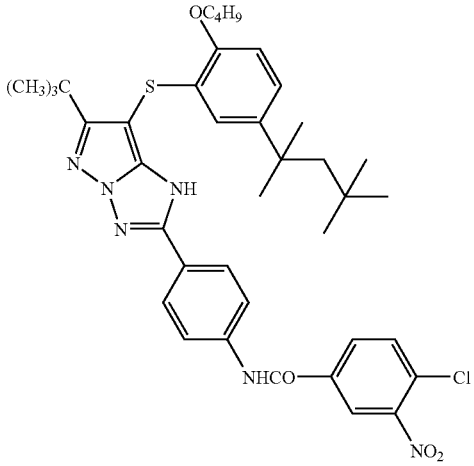
(b-96)
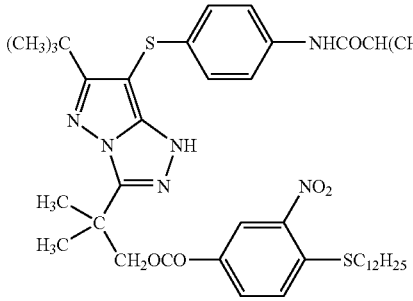
(b-97)
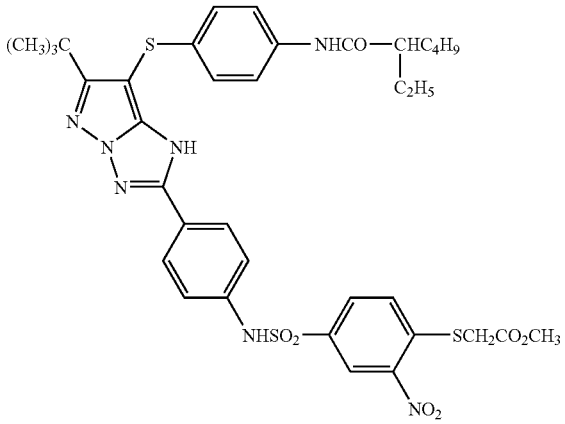

-continued (b-98)

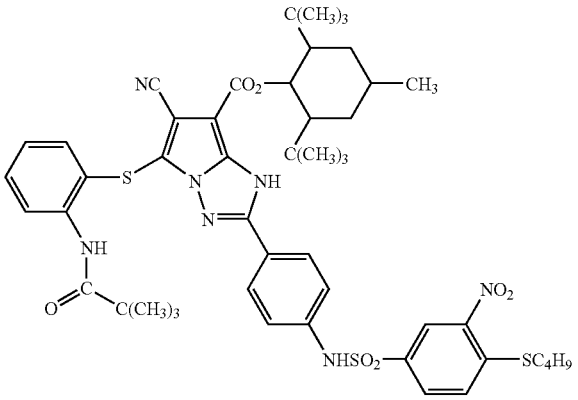

(b-99)

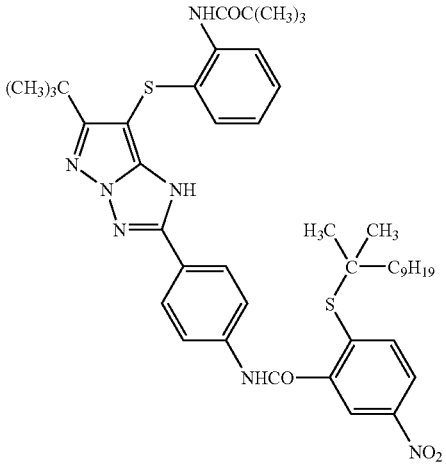

(b-100)

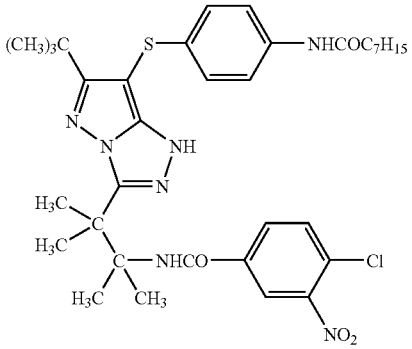

(b-101)

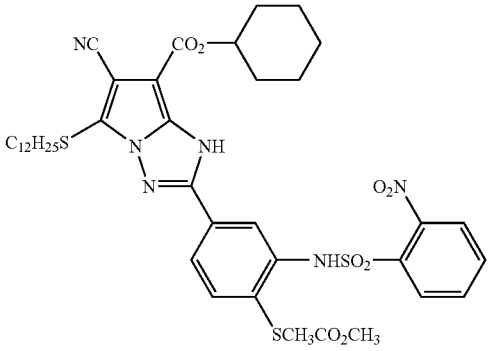

-continued (b-102)

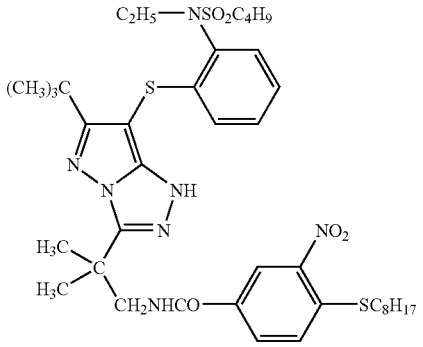

(b-103)

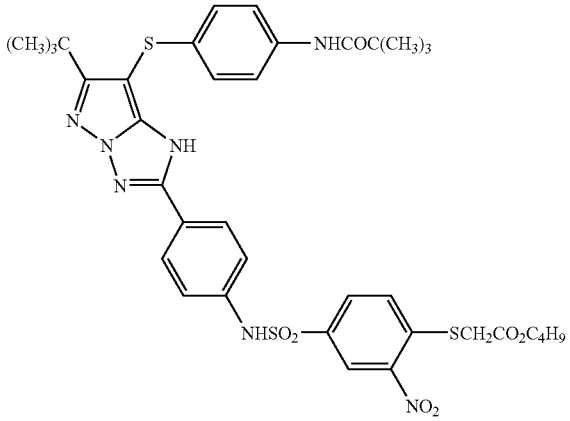

(b-104)

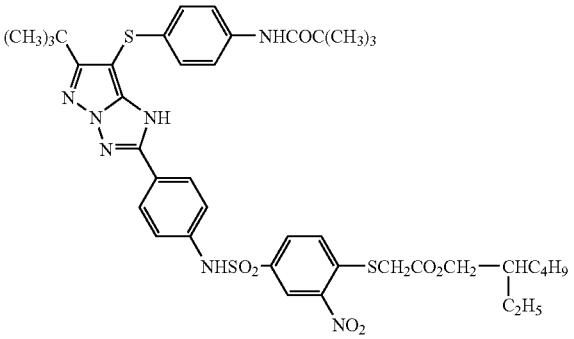

The compounds of the present invention can be easily synthesized by the synthetic methods described in, for example, JP-A's-61-65245, 61-65246, 61-147254 and 8-122984.

As aforementioned, although as the heterocyclic compounds having three or more heteroatoms according to the present invention those which react with oxidizing developing agents are preferred, those which do not react with oxidizing developing agents can be used. These will be described below.

As the heterocycles thereof, there can be mentioned, for example, a triazole ring, an oxadiazole ring, a thiadiazole ring, a benzotriazole ring, a tetrazaindene ring, a pentazaindene ring, a purine ring, a tetrazole ring, a pyrazolotriazole ring and the like.

Representative examples of heterocycles will be listed below.

As examples of the 6/5 bicyclo heterocyclic compounds according to the present invention, there can be mentioned a tetrazaindene ring, a pentazaindene ring and a hexazaindene ring.

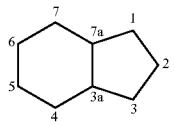

The position of nitrogen atom will be numbered in accordance with the above structures. Then, use can be made of, for example, 1,3,4,6- and 1,3,5,7- (these known as purines), 1,3,5,6-, 1,2,3a,5-, 1,2,3a,6-, 1,2,3a,7-, 1,3,3a,7-, 1,2,4,6-, 1,2,4,7-, 1,2,5,6- and 1,2,5,7-tetrazaindene rings. These compounds can also be expressed as derivatives of imidazo-, pyrazolo- or triazolopyrimidine ring, pyridazine ring and pyrazine ring. Further, use can be made of, for example, 1,2,3a,4,7-, 1,2,3a,5,7- and 1,3,3a,5,7-pentazaindene rings. Still further, use can be made of, for example, a 1,2,3a,4,6,7-hexazaindene ring. Preferably, use is made of 1,3,4,6-, 1,2,5,7-, 1,2,4,6-, 1,2,3a,7- and 1,3,3a,7-tetrazaindene rings.

Preferred examples thereof will be illustrated below.

(ca-1)

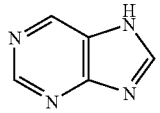

(ca-2)

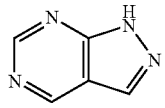

(ca-3)

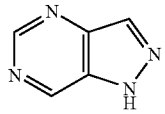

(ca-4)

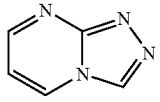

(ca-5)

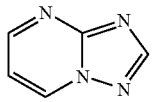

With respect to these tetrazaindene rings, pentazaindene rings and hexazaindene rings, it is preferred to avoid bonding of an ionizable substituent, such as hydroxyl, thiol, primary amino or secondary amino, to a ring atom so as to induce conjugation to ring nitrogen to thereby form a tautomer of heterocycle.

Furthermore, there can be mentioned the following heterocycles.

(ca-6)

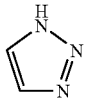

(ca-7)

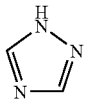

(ca-8)

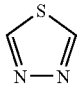

(ca-9)

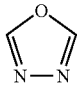

(ca-10)

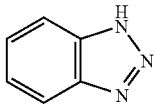

(ca-11)

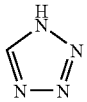

(ca-12)

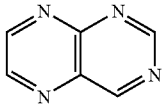

(ca-13)

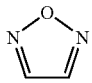

(ca-14)

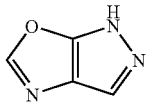

(ca-15)

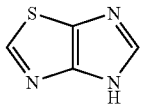

Although heterocycles resulting from partial or entire saturation of the above heterocycles can be used, it is preferred to employ those unsaturated as aforementioned.

These heterocycles, unless contrary to the definition of "heterocycle having three or more heteroatoms", may have any substituents or may be in the form of any condensed ring. As the substituents, there can be mentioned the aforementioned W. The tertiary nitrogen atom contained in heterocycles may be substituted into a quaternary nitrogen. Moreover, any other tautomeric structures which can be drawn with respect to heterocycles are chemically equivalent to each other.

With respect to the heterocycles of the present invention, it is preferred that free thiol (—SH) and thiocarbonyl (>C═S) be in unsubstituted form.

Among the above heterocycles, heterocycles (ca-1) to (ca-11) are preferred.

The heterocyclic compounds mentioned here are those which do not react with oxidizing developing agents. That is, heterocyclic compounds which induce no marked (less than 5 to 10%) direct chemical reaction or redox reaction with oxidizing developing agents are preferred. Further, those which are not couplers, being incapable of reacting with oxidizing developing agents to form dyes or other products are preferred.

Specific examples of the heterocyclic compounds having three or more heteroatoms which do not react with oxidizing developing agents will be shown below, which however in no way limit the scope of the present invention.

C-1

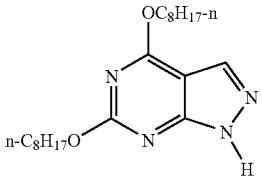

C-2

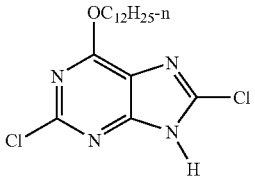

C-3

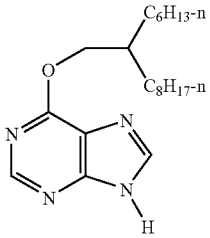

C-4

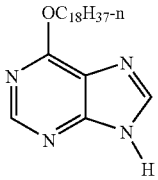

C-5

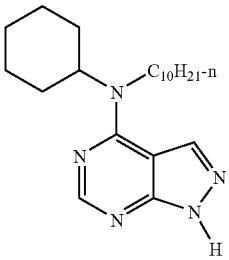

C-6

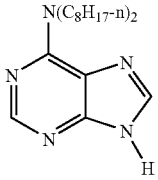

-continued

C-7

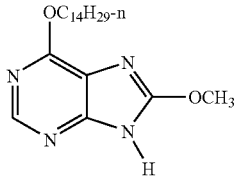

C-8

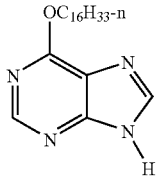

C-9

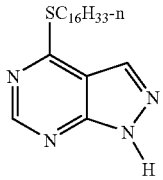

C-10

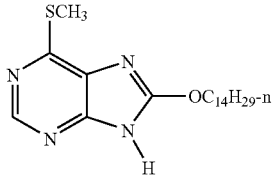

C-11

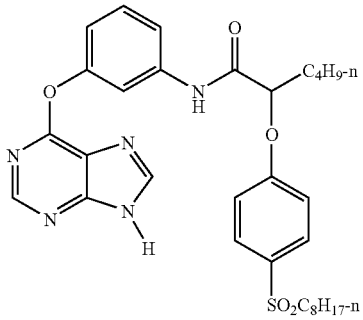

C-12

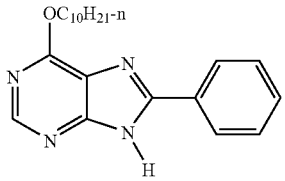

C-13

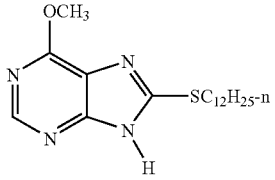

-continued
C-14
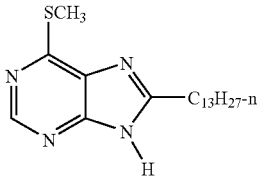
C-15
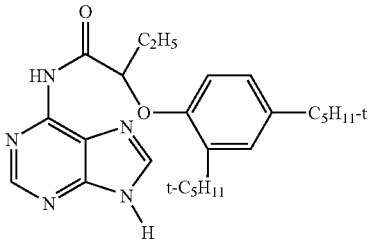
C-16
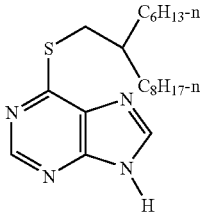
C-17
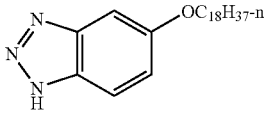
C-18
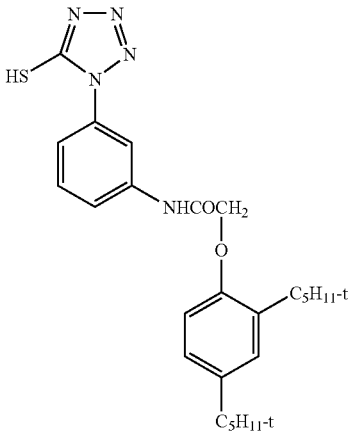
C-19
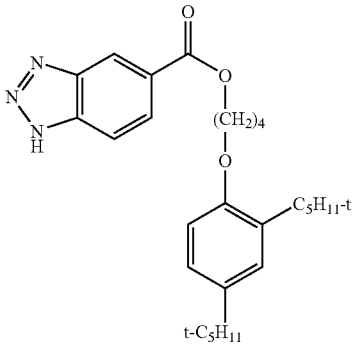
-continued
C-20
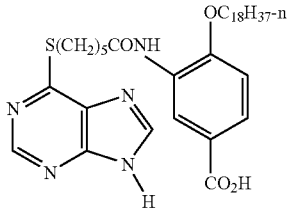
C-21
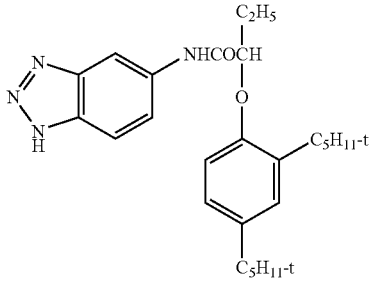
C-22
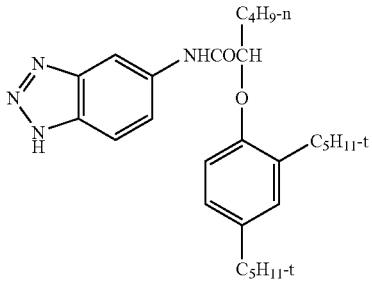
C-23
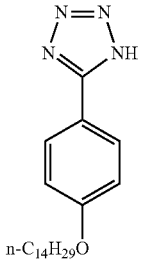
C-24
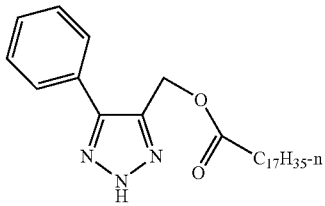
C-25
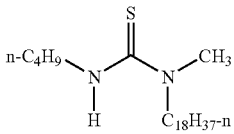

-continued
C-26
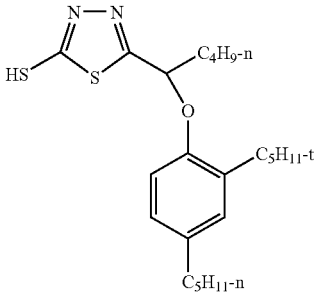
C-27
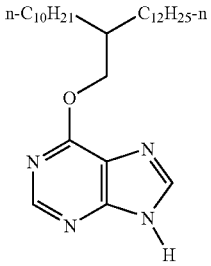
C-28
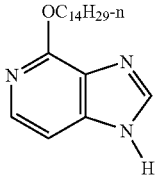
C-29
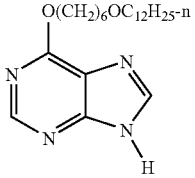
C-30
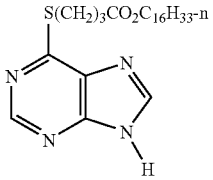
C-31
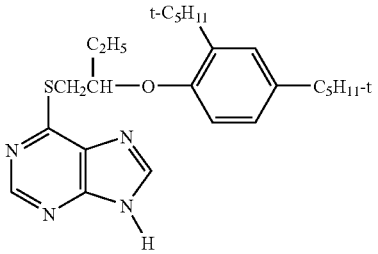
C-32
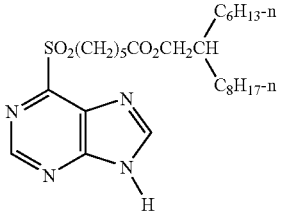
-continued
C-33
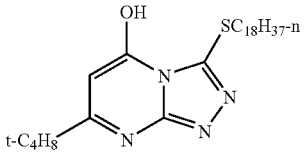
C-34
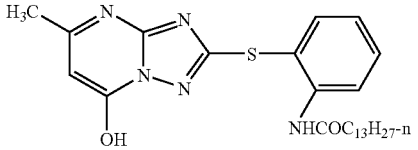
C-35
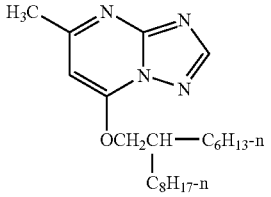
C-36
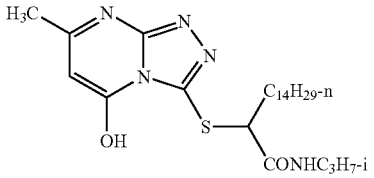
C-37
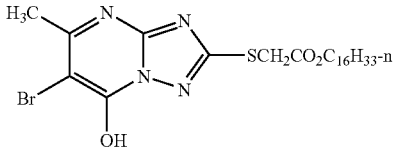
C-38
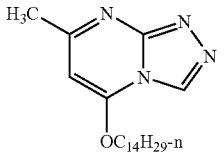
C-39
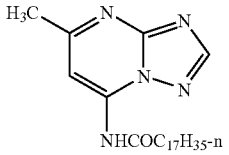
C-40
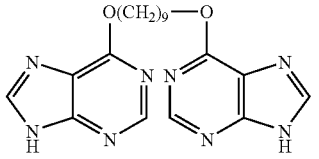

-continued

C-41

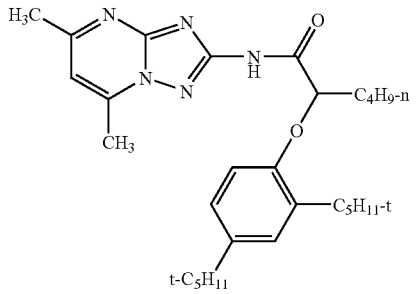

C-42

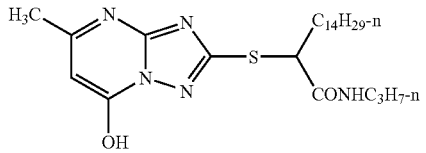

C-43

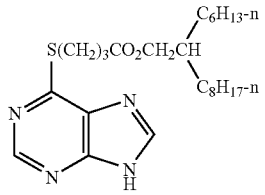

In addition to the above examples of compounds, compounds falling under the present invention described as examples in JP-A-2000-194085 can preferably be used as the compounds of the present invention.

As the compounds of the present invention, use can be made of compounds falling under the present invention among those described in, for example, "The Chemistry of Heterocyclic Compounds—A Series of Monographs" vol. 1–59, edited by Edward C. Taylor and Arnold Weissberger and published by John Wiley & Sons and "Heterocyclic Compounds" vol. 1–6, edited by Robert C. Elderfield and published by John Wiley & Sons. The compounds of the present invention can be synthesized by the processes described therein.

As substituents for the above compounds of the present invention, there can be selected any of those used by persons skilled in the art to which the present invention pertains for attaining desired photographic performance in specified usage. Such substituents include, for example, a hydrophobic group (ballasting group), a solubilizing group, a blocking group and a release or releasable group. With respect to these groups, generally, the number of carbon atoms thereof is preferably in the range of 1 to 60, more preferably 1 to 50.

For controlling the migration in photosensitive material, the compounds of the present invention in the molecules may contain a hydrophobic group or ballasting group of high molecular weight, or may contain a polymer main chain.

The number of carbon atoms of representative ballasting groups is preferably in the range of 8 to 60, more preferably 10 to 57, still more preferably 12 to 55, and most preferably 16 to 53. As these substituents, there can be mentioned substituted or unsubstituted alkyl, aryl and heterocyclic groups having 8 to 60, preferably 10 to 57, more preferably 13 to 55, still more preferably 16 to 53 and most preferably 20 to 50 carbon atoms. These preferably contain branches. Examples of representative substituents on these groups include alkyl, aryl, alkoxy, aryloxy, alkylthio, hydroxyl, halogen, alkoxycarbonyl, aryloxycarbonyl, carboxyl, acyl, acyloxy, amino, anilino, carbonamido, carbamoyl, alkylsulfonyl, arylsulfonyl, sulfonamido and sulfamoyl. These substituents generally each have 1 to 42 carbon atoms. For example, there can be mentioned the aforementioned W. These substituents may have further substituents.

The ballasting groups will be described in greater detail. Preferred examples thereof include an alkyl group (having 1 to 60 carbon atoms, such as methyl, ethyl, propyl, isobutyl, t-butyl, t-octyl, 1-ethylhexyl, nonyl, undecyl, pentadecyl, n-hexadecyl or 3-decanamidopropyl); an alkenyl group (having 2 to 60 carbon atoms, such as vinyl, allyl or oleyl); a cycloalkyl group (having 5 to 60 carbon atoms, such as cyclopentyl, cyclohexyl, 4-t-butylcyclohexyl, 1-indanyl or cyclododecyl); an aryl group (having 6 to 60 carbon atoms, such as phenyl, p-tolyl or naphthyl); an acylamino group (having 2 to 60 carbon atoms, such as acetylamino, n-butanamido, octanoylamino, 2-hexyldecanamido, 2-(2',4'-di-t-amylphenoxy)butanamido, benzoylamino or nicotinamido); a sulfonamido group (having 1 to 60 carbon atoms, such as methanesulfonamido, octanesulfonamido or benzenesulfdnamido); a ureido group (having 2 to 60 carbon atoms, such as decylaminocarbonylamino or di-n-octylaminocarbonylamino); a urethane group (having 2 to 60 carbon atoms, such as dodecyloxycarbonylamino, phenoxycarbonylamino or.2-ethylhexyloxycarbonylamino); an alkoxy group (having 1 to 60 carbon atoms, such as methoxy, ethoxy, butoxy, n-octyloxy, hexadecyloxy or methoxyethoxy); an aryloxy group (having 6 to 60 carbon atoms, such as phenoxy, 2,4-di-t-amylphenoxy, 4-t-octylphenoxy or naphthoxy); an alkylthio group (having 1 to 60 carbon atoms, such as methylthio, ethylthio, butylthio or hexadecylthio); an arylthio group (having 6 to 60 carbon atoms, such as phenylthio or 4-dodecyloxyphenylthio); an acyl group (having 1 to 60 carbon atoms, such as acetyl, benzoyl, butanoyl or dodecanoyl); a sulfonyl group (having 1 to 60 carbon atoms, such as methanesulfonyl, butanesulfonyl or toluenesulfonyl); a cyano group; a carbamoyl group (having 1 to 60 carbon atoms, such as N,N-dicyclohexylcarbamoyl); a sulfamoyl group (having 0 to 60 carbon atoms, such as N,N-dimethylsulfamoyl); a hydroxyl group; a sulfo group; a carboxyl group; a nitro group; an alkylamino group (having 1 to 60 carbon atoms, such as methylamino, diethylamino, octylamino or octadecylamino); an arylamino group (having 6 to 60 carbon atoms, such as phenylamino, naphthylamino or N-methyl-N-phenylamino); a heterocyclic group (having 0 to 60 carbon atoms, preferably heterocyclic group wherein an atom selected from among a nitrogen atom, an oxygen atom and a sulfur atom is used as a heteroatom being a constituent of the ring, more preferably heterocyclic group wherein not only a heteroatom but also a carbon atom is used as constituent atoms of the ring, and especially heterocyclic group having a 3 to 8-, preferably 5 or 6-membered ring, such as groups listed above as being represented by W); or an acyloxy group (having 1 to 60 carbon atoms, such as formyloxy, acetyloxy, myristoyloxy or benzoyloxy).

Among these groups, the alkyl, cycloalkyl, aryl, acylamino, ureido, urethane, alkoxy, aryloxy, alkylthio, arylthio, acyl, sulfonyl, cyano, carbamoyl and sulfamoyl groups include those having substituents. Examples of such substituents include an alkyl group, a cycloalkyl group, an aryl group, an acylamino group, a ureido group, a urethane group, an alkoxy group, an aryloxy group, an alkylthio group, an arylthio group, an acyl group, a sulfonyl group, a cyano group, a carbamoyl group, a sulfamoyl group and a halogen atom.

Among these substituents, an alkyl group, an aryl group, an alkoxy group and an aryloxy group are preferred. An alkyl group, an alkoxy group and an aryloxy group are more preferred. The most preferred substituent is a branched alkyl group.

The total number of carbon atoms of these substituents, although not particularly limited, is preferably in the range of 8 to 60, more preferably 10 to 57, still more preferably 12 to 55, and most preferably 16 to 53.

In the incorporating of compounds of the present invention in a silver halide photosensitive material, preferred use may be made of a compound which can be immobilized in specified layer during storage but diffuses at appropriate time (preferably development processing) of photograph processing. Although any compounds and methods can be used for preventing the diffusion of the compounds of the present invention and immobilizing the same during the storage, there can preferably be mentioned the following compounds and methods.

(1) Method wherein a compound of specified pKa value together with a high-boiling organic solvent described later, etc. is emulsified and added so that the compound of the present invention is dissociated and dissolved out from oil only during development.

The pKa value of the compounds of the present invention is preferably 5.5 or higher, more preferably from 6.0 to 10.0, still more preferably 6.5 to 8.4, and most preferably 6.9 to 8.3.

The dissociative group, although not particularly limited, can preferably be selected from among carboxyl, —$CONHSO_2$— (sulfonylcarbamoyl or carbonylsulfamoyl), —CONHCO— (carbonylcarbamoyl), —$SO_2NHSO_2$— (sulfonylsulfamoyl), sulfonamido, sulfamoyl and phenolic hydroxyl. Of these, carboxyl, —$CONHSO_2$—, —CONHCO— and —$SO_2NHSO_2$— are more preferred. Carboxyl and —$CONHSO_2$— are most preferred.

(2) Method wherein a ballasting group is introduced in the compounds of the present invention to thereby cause them to be resistant to diffusion.

(3) Method wherein a blocking group is used. Use can be made of compounds whose properties are changed (for example, becoming diffusive) by chemical reactions, such as nucleophilic reaction, electrophilic reaction, oxidation reaction and reduction reaction, during the photographic processing, and, relating to these, chemistry and any techniques publicly known in the photographic field can be utilized.

By way of example, the nucleophilic reaction will be described in detail below. The nucleophilic reaction, although can be induced in arbitrary conditions, is accelerated by bases or heating, especially in the presence of bases. The bases, although not particularly limited, can be selected from among inorganic bases and organic bases. For example, there can be mentioned a tertiary amine such as triethylamine, an aromatic heterocyclic amine such as pyridine and a base having OH anion such as sodium hydroxide or potassium hydroxide. In particular, in the present invention, the nucleophilic reaction is accelerated by high-pH photographic processing, such as developer processing, among the photographic processings, and thus can preferably be employed.

Herein, the nucleophilic agent refers to chemical species having properties to attack atoms of low electron density, such as carbonyl carbon, contained in an atomic group which forms a group split off upon being attacked by the nucleophilic agent, thereby donating or sharing electrons. Although the structure of the nucleophilic agent is not particularly limited, as preferred examples thereof there can be mentioned a hydroxide ion donating reagent (e.g., sodium hydroxide, potassium hydroxide, lithium hydroxide, sodium carbonate or potassium carbonate), a sulfite ion donating reagent (e.g., sodium sulfite or potassium sulfite), a hydroxylamido ion donating reagent (e.g., hydroxyamine), a hydrazido ion donating reagent (e.g., hydrazine hydrate or dialkylhydrazine compound), a hexacyanoiron (II) acid ion donating reagent (e.g., yellow prussiate of potash) and a cyanide ion, tin (II) ion, ammonia ion or alkoxy ion donating reagent (e.g., sodium methoxide). As the group split off as a result of attack by nucleophilic agents, there can be mentioned a group utilizing reverse Michael reaction described in Can. J. Chem. vol. 44, page 2315 (1966) and JP-A's-59-137945 and 60-41034, a group utilizing nucleophilic reaction described in Chem. Lett. page 585 (1988), JP-A-59-218439 and JP-B-5-78025, a group utilizing ester bond or amido bond hydrolyzing reaction, etc.

For imparting the above functions, the compounds of the present invention may be substituted with a block group capable of releasing compounds of the present invention during the photographic processing. As the block group, there can be employed known block groups, which include block groups such as acyl and sulfonyl groups as described in, for example, JP-B-48-9968, JP-A's-52-8828 and 57-82834, U.S. Pat. No. 3,311,476 and JP-B-47-44805 (U.S. Pat. No. 3,615,617); block groups utilizing the reverse Michael reaction as described in, for example, JP-B-55-17369 (U.S. Pat. No. 3,888,677), JP-B-55-9696 (U.S. Pat. No. 3,791,830), JP-B-55-34927 (U.S. Pat. No. 4,009,029), JP-A-56-77842 (U.S. Pat. No. 4,307,175) and JP-A's-59-105640, 59-105641 and 59-105642; block groups utilizing the formation of a quinone methide or quinone methide homologue through intramolecular electron transfer as described in, for example, JP-B-54-39727, U.S. Pat. Nos. 3,674,478, 3,932,480 and 3,993,661, JP-A-57-135944, JP-A-57-135945 (U.S. Pat. No. 4,420,554), JP-A's-57-136640 and 61-196239, JP-A-61-196240 (U.S. Pat. No. 4,702,999), JP-A-61-185743, JP-A-61-124941 (U.S. Pat. No. 4,639,408) and JP-A-2-280140; block groups utilizing an intramolecular nucleophilic substitution reaction as described in, for example, U.S. Pat. Nos. 4,358,525 and 4,330,617, JP-A-55-53330 (U.S. Pat. No. 4,310,612), JP-A's-59-121328 and 59-218439 and JP-A-63-318555 (EP 0295729); block groups utilizing a ring cleavage reaction of 5- or 6-membered ring as described in, for example, JP-A-57-76541 (U.S. Pat. No. 4,335,200), JP-A-57-135949 (U.S. Pat. No. 4,350,752), JP-A's-57-179842, 59-137945, 59-140445, 59-219741 and 59-202459, JP-A-60-41034 (U.S. Pat. No. 4,618,563), JP-A-62-59945 (U.S. Pat. No. 4,888,268), JP-A-62-65039 (U.S. Pat. No. 4,772,537), and JP-A's 62-80647, 3-236047 and 3-238445; block groups utilizing a reaction of addition of nucleophilic agent to conjugated unsaturated bond as described in, for example, JP-A's-59-201057 (U.S. Pat. No. 4,518,685), 61-43739 (U.S. Pat. No. 4,659,651), 61-95346 (U.S. Pat. No. 4,690,885), 61-95347 (U.S. Pat. No. 4,892,811), 64-7035, 4-42650 (U.S. Pat. No. 5,066,573), 1-245255, 2-207249, 2-235055 (U.S. Pat. No. 5,118,596) and 4-186344; block groups utilizing a β-elimination reaction as described in, for example, JP-A's-59-93442, 61-32839 and 62-163051 and JP-B-5-37299; block groups utilizing a nucleophilic substitution reaction of diarylmethanes as described in JP-A-61-188540; block groups utilizing Lossen rearrangement reaction as described in JP-A-62-187850; block groups utilizing a reaction between an N-acyl derivative of thiazolidine-2-thione and an amine as described in, for example, JP-A's-62-80646, 62-144163 and 62-147457; block groups having two electrophilic groups and capable of reacting with a binucleophilic agent as described in, for example, JP-A's-2-296240 (U.S. Pat. No. 5,019,492), 4-177243, 4-177244, 4-177245, 4-177246, 4-177247, 4-177248, 4-177249, 4-179948, 4-184337 and 4-184338, WO 92/21064, JP-A-4-330438, WO 93/03419 and JP-A-5-45816; and block groups of JP-A's-3-236047 and 3-238445. Of these block groups, block groups having two electrophilic groups and capable of reacting with a binucleophilic agent as described in, for example, JP-A's-2-296240 (U.S. Pat. No. 5,019,492), 4-177243, 4-177244, 4-177245, 4-177246, 4-177247, 4-177248, 4-177249, 4-179948, 4-184337 and 4-184338, WO 92/21064, JP-A-4-330438, WO 93/03419 and JP-A-5-45816 are especially preferred. Moreover, these block groups may be those containing timing groups capable of inducing cleavage reaction with the use of electron transfer reaction as described in U.S. Pat. Nos. 4,409,323 and 4,421,845. With respect to such groups, it is preferred that timing group terminals inducing electron transfer reaction be blocked.

(4) Method wherein use is made of a dimer, trimer or higher polymer compound containing partial structure of compounds of the present invention.

(5) Method wherein immobilization is effected by the use of water-insoluble compounds of the present invention (solid dispersions). As mentioned with respect to method (1), compounds of the present invention exhibiting specified pKa values are preferred from the viewpoint that they are dissolved only at the stage of development. Examples of uses of water-insoluble dye solids (solid dispersions) are disclosed in JP-A's-56-12639, 55-155350, 55-155351, 63-27838 and 63-197943, EP 15601, etc.

Particular methods for solid dispersion will be specified later.

(6) Method wherein compounds of the present invention are immobilized by coexistence of a polymer having an electric charge counter to that thereof as a mordant. Examples of dye immobilizations are disclosed in U.S. Pat. Nos. 2,548,564, 4,124,386 and 3,625,694, etc.

(7) Method wherein compounds of the present invention are immobilized by effecting adsorption thereof on metal salts such as silver halides. Examples of dye immobilizations are disclosed in U.S. Pat. Nos. 2,719,088, 2,496,841 and 2,496,843, JP-A-60-45237, etc.

As representative examples of adsorptive groups on silver halides which can be used in compounds of the present invention, there can be mentioned groups described in JP-A-2003-156823, page 16 right column line 1 to page 17 right column line 12.

As preferred adsorptive groups, there can be mentioned a mercapto-substituted nitrogenous heterocyclic group (e.g., 2-mercaptothiadiazole group, 3-mercapto-1,2,4-triazole group, 5-mercaptotetrazole group, 2-mercapto-1,3,4-oxadiazole group, 2-mercaptobenzoxazole group, 2-mercaptobenzothiazole group or 1,5-dimethyl-1,2,4-triazoium-3-thiolate group) and a nitrogenous heterocyclic group capable of forming an iminosilver (>NAg) and having —NH— as a partial structure of heterocycle (e.g., benzotriazole group, benzimidazole group or indazole group). Among these, a 5-mercaptotetrazole group, a 3-mercapto-1,2,4-triazole group and a benzotriazole group are more preferred. A 3-mercapto-1,2,4-triazole group and a 5-mercaptotetrazole group are most preferred.

An adsorptive group having two or more mercapto groups as a partial structure in the molecule is also especially preferred. The mercapto group (—SH) when tautomerizable may be in the form of a thione group. As preferred examples of adsorptive groups each having two or more mercapto groups as a partial structure (e.g., dimercapto-substituted nitrogenous heterocyclic groups), there can be mentioned a 2,4-dimercaptopyrimidine group, a 2,4-dimercaptotriazine group and a 3,5-dimercapto-1,2,4-triazole group.

Moreover, a quaternary salt structure of nitrogen or phosphorus can preferably be used as the adsorptive group. As the quaternary salt structure of nitrogen, there can be mentioned, for example, an ammonio group (such as trialkylammonio, dialkylaryl(heteroaryl)ammonio or alkyldiaryl(heteroaryl)ammonio) or a group containing a nitrogenous heterocyclic group containing a quaternarized nitrogen atom. As the quaternary salt structure of phosphorus, there can be mentioned, a phosphonio group (such as trialkylphosphonio, dialkylaryl(heteroaryl)phosphonio, alkyldiaryl(heteroaryl)phosphonio or triaryl(heteroaryl)phosphonio). Among these, the quaternary salt structure of nitrogen is more preferred. The 5- or 6-membered nitrogenous aromatic heterocyclic group containing a quaternarized nitrogen atom is still more preferred. A pyridinio group, a quinolinio group and an isoquinolinio group are most preferred. The above nitrogenous heterocyclic group containing a quaternarized nitrogen atom may have any arbitrary substituent.

As examples of counter anions to the quaternary salts, there can be mentioned a halide ion, a carboxylate ion, a sulfonate ion, a sulfate ion, a perchlorate ion, a carbonate ion, a nitrate ion, $BF_4^-$, $PF_6^-$ and $Ph_4B^-$. When in the molecule a group with negative charge is had by carboxylate, etc., an intramolecular salt may be formed therewith. A chloro ion, a bromo ion or a methanesulfonate ion is most preferred as a counter anion not present in the molecule.

Among the above methods for immobilizing compounds of the present invention, there can preferably be employed the method of using a compound of specified pKa (1), the method of using a compound having a ballasting group (2), the method of using a compound having a blocking group (3) and the method of using a solid dispersion (5). It is preferred to employ compounds suitable for the methods. Using the method (1), (2) or (3) together with suitable compounds is more preferred. Using the method (1) or (2) together with suitable compounds is still more preferred. Simultaneously using the methods (1) and (2) is most preferred. That is, compounds simultaneously having specified pKa and ballasting group according to the present invention can most preferably be employed.

The compounds of the present invention, when required for neutralizing the charges thereof, can contain a required number of required cations or anions. As representative cations, there can be mentioned inorganic cations such as proton ($H^+$), alkali metal ions (e.g., sodium ion, potassium ion and lithium ion) and alkaline earth metal ions (e.g., calcium ion); and organic ions such as ammonium ions (e.g., ammonium ion, tetraalkylammonium ion, triethylammonium ion, pyridinium ion, ethylpyridinium ion and 1,8-diazabicyclo[5,4,0]-7-undecenium ion). The anions can be inorganic anions or organic anions. As such, there can be mentioned halide anions (e.g., fluoride ion, chloride ion and iodide ion), substituted arylsulfonate ions (e.g., p-toluenesulfonate ion and p-chlorobenzenesulfonate ion), aryldisulfonate ions (e.g., 1,3-benzenedisulfonate ion, 1,5-naphthalenedisulfonate ion and 2,6-naphthalenedisulfonate ion), alkylsulfate ions (e.g., methylsulfate ion), sulfate ion, thiocyanate ion, perchlorate ion, tetrafluoroborate ion, picrate ion, acetate ion and trifluoromethanesulfonate ion. Further, use can be made of ionic polymers and other dyes having charges opposite to those of dyes. $CO_2^-$ and $SO_3^-$, when having a proton as a counter ion, can be indicated as $CO_2H$ and $SO_3H$, respectively.

It is preferred to use combinations of aforementioned individual preferred compounds (especially combinations of individual most preferred compounds) as the compound of the present invention.

When compounds of the present invention each have two or more asymmetric carbon atoms in the molecule, there are multiple stereoisomers per any particular structure. This description involves all possible stereoisomers. In the present invention, use can be made of any one of multiple stereoisomers, or some thereof in the form of a mixture.

With respect to the compounds of the present invention, any one thereof can be used, or two or more can be used in combination. The number and type of compounds for use can be arbitrarily selected.

Further, the compounds of the present invention may be used in combination with compounds each having at least three heteroatoms as described in JP-A's-2000-194085 and 2003-156823.

The compounds of the present invention can be used in combination with one or more arbitrary methods capable of exerting sensitivity enhancing effects or compounds capable of exerting sensitivity enhancing effects. The number and type of employed methods and contained compounds can be arbitrarily selected.

In the present invention, as long as the compounds of the present invention can be applied to a silver halide photosensitive sensitive material (preferably a silver halide color photosensitive material), the addition site therefor, etc. are not particularly limited, and the compounds may be added to any of silver halide photosensitive layer and nonsensitive layer.

In the use in a silver halide photosensitive layer consisting of multiple layers of different speeds, although the addition may be effected to any of these layers, it is preferred that the compounds be incorporated in the layer of highest speed.

In the use in nonsensitive layer, the compounds are preferably incorporated in a nonsensitive layer disposed between a red-sensitive layer and a green-sensitive layer or between a green-sensitive layer and a blue-sensitive layer. The nonsensitive layer refers to any of all layers other than the silver halide emulsion layers which include an antihalation layer, an interlayer, a yellow filter layer and a protective layer.

The method of incorporating the compounds of the present invention in a photosensitive material, although not particularly limited, can be selected from among, for example, the method of adding through emulsification dispersion of the compounds together with a high boiling organic solvent or the like, the method of adding through solid dispersion, the method of adding the compounds in solution form to a coating liquid (for example, dissolving the compounds in water, an organic solvent such as methanol or a mixed solvent before addition) and the method of adding during the preparation of silver halide emulsion. Among these, the method of incorporating in a photosensitive material through emulsification dispersion or solid dispersion is preferred. The method of incorporating in a photosensitive material through emulsification dispersion is more preferred.

As the emulsification dispersion method, use can be made of the in-water oil droplet dispersing method wherein the compounds are dissolved in a high-boiling organic solvent (optionally in combination with a low-boiling organic solvent), emulsified and dispersed in an aqueous solution of gelatin and added to a silver halide emulsion.

Examples of the high-boiling organic solvents for use in the in-water oil droplet dispersing method are listed in, for example, U.S. Pat. No. 2,322,027. Particulars of a latex dispersing method as one of polymer dispersing methods are described in, for example, U.S. Pat. No. 4,199,363, DE (OLS) 2,541,274, JP-B-53-41091 and EP's 0,727,703 and 0,727,704. Further, a method of dispersion by an organic solvent soluble polymer is described in WO 88/00723.

Examples of the high-boiling organic solvents which can be employed in the above in-water oil droplet dispersing method include phthalic acid esters (e.g., dibutyl phthalate, dioctyl phthalate and di-2-ethylhexyl phthalate), esters of phosphoric acid or phosphonic acid (e.g., triphenyl phosphate, tricresyl phosphate and tri-2-ethylhexyl phosphate), fatty acid esters (e.g., di-2-ethylhexyl succinate and tributyl citrate), benzoic acid esters (e.g., 2-ethylhexyl benzoate and dodecyl benzoate), amides (e.g., N,N-diethyldodecanamide and N,N-dimethyloleamide, alcohols or phenols (e.g., isostearyl alcohol and 2,4-di-tert-amylphenol), anilines (e.g., N,N-dibutyl-2-butoxy-5-tert-octylaniline), chlorinated paraffins, hydrocarbons (e.g., dodecylbenzene and diisopropylnaphthalene) and carboxylic acids (e.g., 2-(2,4-di-tert-amylphenoxy)butyric acid). Further, as an auxiliary solvent, an organic solvent having a boiling point of 30 to 160° C. (e.g., ethyl acetate, butyl acetate, methyl ethyl ketone, cyclohexanone, methyl cellosolve acetate or dimethylformamide) may be used in combination therewith. The high-boiling organic solvents are preferably used in a mass ratio to compounds of the present invention of 0 to 10, more preferably 0 to 4.

The whole or portion of the auxiliary solvent can be removed from the emulsified dispersion by vacuum distillation, noodle washing, ultrafiltration or other appropriate means according to necessity from the viewpoint of enhancing of aging stability during storage in the state of emulsified dispersion and inhibiting of photographic property change and enhancing of aging stability with respect to a final coating composition after emulsion mixing.

The average particle size of thus obtained lipophilic fine particle dispersion is preferably in the range of 0.04 to 0.50 μm, more preferably 0.05 to 0.30 μm and most preferably 0.08 to 0.20 μm. The average particle size can be measured by the use of, for example, Coulter submicron particle analyzer model N4 (trade name, manufactured by Coulter Electronic).

As means for solid fine particle dispersion, there can be mentioned the method wherein powdery compounds of the present invention are dispersed in an appropriate solvent such as water with the use of a ball mill, a colloid mill, a vibration ball mill, a sand mill, a jet mill, a roller mill or ultrasonic so as to obtain a solid dispersion. During the dispersing, use can be made of a protective colloid (e.g., polyvinyl alcohol) or a surfactant (e.g., anionic surfactant such as sodium triisopropylbutanesulfonate (mixture of those whose three isopropyl substitution sites are different from each other)). In the above mills, beads such as those of zirconia are generally used as dispersing media. Thus, Zr, etc. leached from the beads may be mixed in the dispersion. The amount thereof is generally in the range of 1 to 1000 ppm although depending on dispersing conditions. When the content of Zr in photosensitive material is 0.5 mg or less per g of silver, there would occur practically no adverse effect. The water dispersion can be doped with an antiseptic (e.g., benzoisothiazolinone sodium salt).

In the present invention, in order to obtain a coagulation-free solid dispersion of high S/N and small grain size, use can be made of the dispersing method wherein a water dispersion liquid is converted to a high-velocity stream and thereafter a pressure drop is effected. The solid dispersing apparatus and technology employed for carrying out this dispersing method are described in detail in, for example, "Dispersion Rheology and Dispersing Technology" written by Toshio Kajiuchi and Hiroki Usui, pp. 357–403, Shinzansha Shuppan (1991) and "Progress of Chemical Engineering, 24th Series" edited by the corporate juridical person Society of Chemical Engineering, Tokai Chapter, pp. 184–185, Maki Shoten (1990).

The addition amount of compounds of the present invention is preferably in the range of 0.1 to 1000 mg/m$^2$, more preferably 1 to 500 mg/m$^2$ and most preferably 5 to 100 mg/m$^2$. In the use in photosensitive silver halide emulsion layers, the addition amount is preferably in the range of $1\times10^{-5}$ to 1 mol, more preferably $1\times10^{-4}$ to $1\times10^{-1}$ mol and most preferably $1\times10^{-3}$ to $5\times10^{-2}$ mol per mol of silver contained in the same layer. Two or more compounds of the present invention may be used in combination. These compounds may be incorporated in the same layer or separate layers.

The pKa values of compounds of the present invention are those determined in the following manner. 0.5 milliliter (hereinafter also expressed as "mL") of 1 N sodium chloride is added to 100 mL of a solution dissolving 0.01 mmol of compound of the present invention in a 6:4 (mass ratio) mixture of tetrahydrofuran and water, and titrated with a 0.5 N aqueous potassium hydroxide solution under agitation in a nitrogen gas atmosphere. The pKa refers to the pH at the central position of inflexion point of titration curve having an axis of abscissas indicating the amount of aqueous potassium hydroxide solution dropped and an axis of ordinate indicating pH values. With respect to compounds having multiple dissociation sites, multiple inflexion points exist and multiple pKa values can be determined. Also, the inflexion point can be determined by monitoring ultraviolet/visible light absorption spectra and checking absorption changes.

Generally, the photographic speed depends on the size of silver halide emulsion grains. The larger the emulsion grains, the higher the photographic speed. However, the graininess is deteriorated in accordance with an increase of the size of silver halide grains. Therefore, the speed and the graininess fall in trade-off relationship.

The speed increase can be accomplished by the method of increasing coupler activity or the method of decreasing the amount of development inhibitor release coupler (DIR coupler) as well as the above increasing of the size of silver halide emulsion grains. However, when the speed increase is effected by these methods, graininess deterioration accompanies the same. These methods of changing of the size of emulsion grains, regulation of coupler activity and regulation of the amount of DIR coupler, in speed/graininess trade-off relationship, provide only "regulatory means" for deteriorating graininess while increasing speed, or improving graininess while lowering speed.

In the present invention, it is not intended to provide a method of speed increase accompanied by graininess deterioration matching the speed increase.

According to the present invention, there is provided a method of speed increase not accompanied by graininess deterioration, or a method of speed increase wherein the speed increase is conspicuous as compared with graininess deterioration. In the present invention, when speed increase and graininess deterioration simultaneously occur, speed comparison is effected after graininess matching conducted by the above "regulatory means" to thereby find a substantial speed increase.

The substantial speed increase is defined as a speed difference of 0.02 or greater exhibited when photosensitive materials are exposed through continuous wedge and speeds in terms of the logarithm of inverse number of exposure intensity realizing minimum density +0.5 are compared.

It is preferred that the photosensitive material of the present invention contain "a compound which undergoes a one-electron oxidation so as to form a one-electron oxidation product capable of releasing one or more electrons".

This compound is preferably selected from among the following compounds of type 1 and type 2.

(Type 1)

Compound which undergoes a one-electron oxidation so as to form a one-electron oxidation product capable of, through subsequent bond cleavage reaction, releasing one or more electrons.

(Type 2)

Compound which undergoes a one-electron oxidation so as to form a one-electron oxidation product capable of, after subsequent bond formation reaction, releasing one or more electrons.

First, the compound of type 1 will be described.

With respect to the compound of type 1, as the compound which undergoes a one-electron oxidation so as to form a one-electron oxidation product capable of, through subsequent bond cleavage reaction, releasing one electron, there can be mentioned compounds referred to as "one photon two electrons sensitizers" or "deprotonating electron donating sensitizers", as described in, for example, JP-A-9-211769 (examples: compounds PMT-1 to S-37 listed in Tables E and F on pages 28 to 32), JP-A-9-211774, JP-A-11-95355 (examples: compounds INV 1 to 36), PCT Japanese Translation Publication 2001-500996 (examples: compounds 1 to 74, 80 to 87 and 92 to 122), U.S. Pat. Nos. 5,747,235 and 5,747,236, EP 786692A1 (examples: compounds INV 1 to 35), EP 893732A1 and U.S. Pat. Nos. 6,054,260 and 5,994,051. Preferred ranges of these compounds are the same as described in the cited patent specifications.

With respect to the compound of type 1, as the compound which undergoes a one-electron oxidation so as to form a one-electron oxidation product capable of, through subsequent bond cleavage reaction, releasing one or more electrons, there can be mentioned compounds of the general formula (1) (identical with the general formula (1) described in JP-A-2003-114487), the general formula (2) (identical with the general formula (2) described in JP-A-2003-114487), the general formula (3) (identical with the general formula (3) described in JP-A-2003-114487), the general formula (3) (identical with the general formula (1) described in JP-A-2003-114488), the general formula (4) (identical with the general formula (2) described in JP-A-2003-114488), the general formula (5) (identical with the general formula (3) described in JP-A-2003-114488), the general formula (6) (identical with the general formula (1) described in JP-A-2003-75950), the general formula (8) (identical with the general formula (1) described in Japanese Patent Application 2003-25886) and the general formula (9) (identical with the general formula (3) described in JP-A-2003-33446) among the compounds of inducing the reaction represented by the chemical reaction formula (1) (identical with the chemical reaction formula (1) described in Japanese Patent Application 2003-33446). Preferred ranges of these compounds are the same as described in the cited patent specifications.

General formula (1)

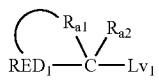

General formula (2)

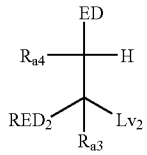

In the general formulae (1) and (2), each of RED, and $RED_2$ represents a reducing group. $R_{a1}$ represents a nonmetallic atom group capable of forming a cyclic structure corresponding to a tetrahydro form or hexahydro form of 5-membered or 6-membered aromatic ring (including aromatic heterocycle) in cooperation with carbon atom (C) and $RED_1$. Each of $R_{a2}$, $R_{a3}$ and $R_{a4}$ represents a hydrogen atom or a substituent. Each of $L_{v1}$ and $L_{v2}$ represents a split off group. ED represents an electron donating group.

General formula (3)

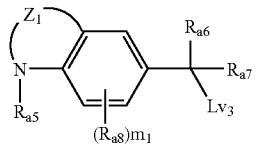

General formula (4)

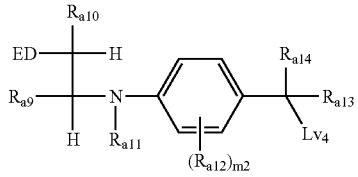

General formula (5)

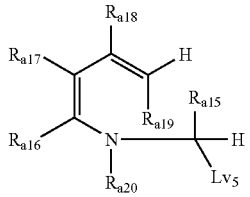

In the general formulae (3), (4) and (5), $Z_1$ represents an atomic group capable of forming a 6-membered ring in cooperation with a nitrogen atom and two carbon atoms of benzene ring. Each of $R_{a5}$, $R_{a6}$, $R_{a7}$, $R_{a9}$, $R_{a10}$, $R_{a11}$, $R_{a13}$, $R_{a14}$, $R_{a15}$, $R_{a16}$, $R_{a17}$, $R_{a18}$ and $R_{a19}$ represents a hydrogen atom or a substituent. $R_{a20}$ represents a hydrogen atom or a substituent, provided that when $R_{a20}$ represents a non-aryl group, $R_{a16}$ and $R_{a17}$ are bonded to each other to thereby form an aromatic ring or aromatic heterocycle. Each of $R_{a8}$ and $R_{a12}$ represents a substituent capable of substitution on benzene ring. $m_1$ is an integer of 0 to 3. $m_2$ is an integer of 0 to 4. Each of $L_{v3}$, $L_{v4}$ and $L_{v5}$ represents a split off group.

General formula (6)

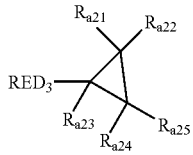

General formula (7)

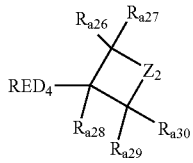

In the general formulae (6) and (7), each of $RED_3$ and $RED_4$ represents a reducing group. Each of $R_{a21}$ to $R_{a30}$ represents a hydrogen atom or a substituent. $Z_2$ represents —$CR_{111}R_{112}$—, —$NR_{113}$— or —O—. Each of $R_{111}$ and $R_{112}$ independently represents a hydrogen atom or a substituent. $R_{113}$ represents a hydrogen atom, an alkyl group, an aryl group or a heterocyclic group.

General formula (8)

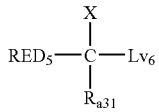

In the general formula (8), $RED_5$ is a reducing group, representing an arylamino group or a heterocyclic amino group. $R_{a31}$ represents a hydrogen atom or a substituent. X represents an alkoxy group, an aryloxy group, a heterocyclic oxy group, an alkylthio group, an arylthio group, a heterocyclic thio group, an alkylamino group, an arylamino group or a heterocyclic amino group. $L_{v6}$ is a split off group, representing carboxyl or its salt or a hydrogen atom.

Chemical reaction formula (1)

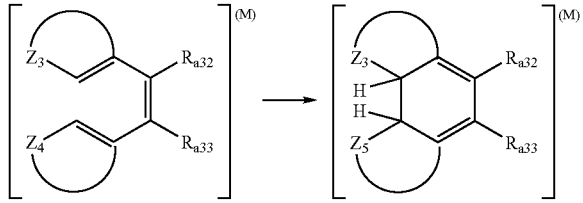

General formula (9)

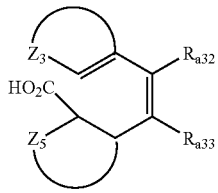

The compound represented by the general formula (9) is one which undergoes a two-electron oxidation accompanied by decarbonation and is further oxidized to thereby effect a bond forming reaction of chemical reaction formula (1). In the chemical reaction formula (1), each of $R_{a32}$ and $R_{a33}$ represents a hydrogen atom or a substituent. $Z_3$ represents a group capable of forming a 5- or 6-membered heterocyclic ring in cooperation with C═C. $Z_4$ represents a group capable of forming a 5- or 6-membered aryl group or heterocyclic ring in cooperation with C═C. M represents a radical, a radical cation or a cation. In the general formula (9), $R_{a32}$, $R_{a33}$ and $Z_3$ have the same meaning as in the chemical reaction formula (1). $Z_5$ represents a group capable of forming a 5- or 6-membered cycloaliphatic hydrocarbon group or heterocyclic ring in cooperation with C—C.

Now, the compounds of type 2 will be described.

As the compounds of type 2, namely, compounds which undergo a one-electron oxidation so as to form a one-electron oxidation product capable of, through subsequent bond formation reaction, releasing one or more electrons, there can be mentioned compounds of the general formula (10) (identical with the general formula (1) described in JP-A-2003-140287) and compounds of the general formula (11) (identical with the general formula (2) described in Japanese Patent Application 2003-33446) capable of inducing the reaction represented by the chemical reaction formula (1) (identical with the chemical reaction formula (1) described in Japanese Patent Application 2003-33446). Preferred ranges of these compounds are the same as described in the cited patent specifications.

$RED_6$-Q-Y General formula (10)

In the general formula (10), $RED_6$ represents a reducing group which undergoes a one-electron oxidation. Y represents a reactive group containing carbon to carbon double bond moiety, carbon to carbon triple bond moiety, aromatic group moiety or nonaromatic heterocyclic moiety of benzo condensation ring capable of reacting with a one-electron oxidation product formed by a one-electron oxidation of $RED_6$ to thereby form a new bond. Q represents a linking group capable of linking $RED_6$ with Y.

Chemical reaction formula (1)

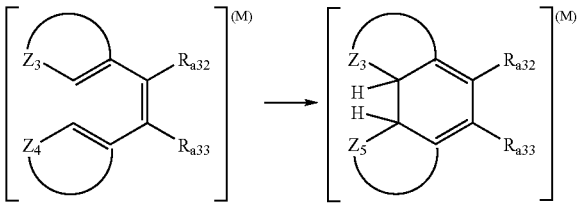

General formula (11)

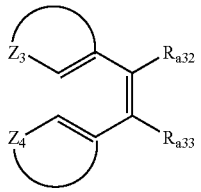

The compound represented by the general formula (11) is one oxidized to thereby effect a bond forming reaction of chemical reaction formula (1). In the chemical reaction formula (1), each of $R_{a32}$ and $R_{a33}$ represents a hydrogen atom or a substituent. $Z_3$ represents a group capable of forming a 5- or 6-membered heterocyclic ring in cooperation with C═C. $Z_4$ represents a group capable of forming a 5- or 6-membered aryl group or heterocyclic ring in cooperation with C═C. $Z_5$ represents a group capable of forming a 5- or 6-membered cycloaliphatic hydrocarbon group or heterocyclic ring in cooperation with C—C. M represents a radical, a radical cation or a cation. In the general formula (11), $R_{a32}$, $R_{a33}$, $Z_3$ and $Z_4$ have the same meaning as in the chemical reaction formula (1).

Among the compounds of types 1 and 2, "compounds having in the molecule an adsorptive group on silver halides" and "compounds having in the molecule a partial structure of spectral sensitizing dye" are preferred. As representative examples of adsorptive groups on silver halides, there can be mentioned groups described in JP-A-2003-156823, page 16 right column line 1 to page 17 right column line 12. The partial structure of spectral sensitizing dye is as described in the same reference, page 17 right column line 34 to page 18 left column line 6.

Among the compounds of types 1 and 2, "compounds having in the molecule at least one adsorptive group on silver halides" are more preferred. "Compounds having in the same molecule two or more adsorptive groups on silver halides" are still more preferred. When two or more adsorptive groups are present in a single molecule, they may be identical with or different from each other.

As preferred adsorptive groups, there can be mentioned a mercapto-substituted nitrogenous heterocyclic group (e.g., 2-mercaptothiadiazole group, 3-mercapto-1,2,4-triazole group, 5-mercaptotetrazole group, 2-mercapto-1,3,4-oxadiazole group, 2-mercaptobenzoxazole group, 2-mercaptobenzothiazole group or 1,5-dimethyl-1,2,4-triazoium-3-thiolate group) and a nitrogenous heterocyclic group capable of forming an iminosilver (>NAg) and having —NH— as a partial structure of heterocycle (e.g., benzotriazole group, benzimidazole group or indazole group). Among these, a 5-mercaptotetrazole group, a 3-mercapto-1,2,4-triazole group and a benzotriazole group are more preferred. A 3-mercapto-1,2,4-triazole group and a 5-mercaptotetrazole group are most preferred.

An adsorptive group having two or more mercapto groups as a partial structure in the molecule is also especially preferred. The mercapto group (—SH) when tautomerizable may be in the form of a thione group. As preferred examples of adsorptive groups each having two or more mercapto groups as a partial structure (e.g., dimercapto-substituted nitrogenous heterocyclic groups), there can be mentioned a 2,4-dimercaptopyrimidine group, a 2,4-dimercaptotriazine group and a 3,5-dimercapto-1,2,4-triazole group.

Moreover, a quaternary salt structure of nitrogen or phosphorus can preferably be used as the adsorptive group. As the quaternary salt structure of nitrogen, there can be mentioned, for example, an ammonio group (such as trialkylammonio, dialkylaryl(heteroaryl)ammonio or alkyldiaryl(heteroaryl)ammonio) or a group containing a nitrogenous heterocyclic group containing a quaternarized nitrogen atom. As the quaternary salt structure of phosphorus, there can be mentioned, a phosphonio group (such as trialkylphosphonio, dialkylaryl(heteroaryl)phosphonio, alkyldiaryl(heteroaryl)phosphonio or triaryl(heteroaryl)phosphonio). Among these, the quaternary salt structure of nitrogen is more preferred. The 5- or 6-membered nitrogenous aromatic heterocyclic group containing a quaternarized nitrogen atom is still more preferred. A pyridinio group, a quinolinio group and an isoquinolinio group are most preferred. The above nitrogenous heterocyclic group containing a quaternarized nitrogen atom may have any arbitrary substituent.

As examples of counter anions to the quaternary salts, there can be mentioned a halide ion, a carboxylate ion, a sulfonate ion, a sulfate ion, aperchlorate ion, a carbonate ion, a nitrate ion, $BF_4^-$, $PF_6^-$ and $Ph_4B^-$. When in the molecule a group with negative charge is had by carboxylate, etc., an intramolecular salt may be formed therewith. A chloro ion, a bromo ion or a methanesulfonate ion is most preferred as a counter anion not present in the molecule.

Among the compounds of types 1 and 2 having the structure of quaternary salt of nitrogen or phosphorus as the adsorptive group, preferred structures can be represented by the general formula (X).

$$(P\text{-}Q_1\text{-})_i\text{-}R(\text{-}Q_2\text{-}S)_j \qquad \text{General formula (X)}$$

In the general formula (X), each of P and R independently represents the structure of quaternary salt of nitrogen or phosphorus, which is not a partial structure of sensitizing dye. Each of $Q_1$ and $Q_2$ independently represents a linking group, which may be, for example, a single bond, an alkylene group, an arylene group, a heterocyclic group, —O—, —S—, —$NR_N$—, —C(═O)—, —$SO_2$—, —SO— and —P(═O)—, these used individually or in combination. $R_N$ represents a hydrogen atom, an alkyl group, an aryl group or a heterocyclic group. S represents a residue resulting from removal of one atom from the compound of type 1 or type 2. Each of i and j is an integer of 1 or greater, provided that i+j is in the range of 2 to 6. i=1 to 3 while j=1 to 2 is preferred, i=1 or 2 while j=1 is more preferred, and i=j=1 is most preferred. With respect to the compounds represented by the general formula (X), the total number of carbon atoms thereof is preferably in the range of 10 to 100, more preferably 10 to 70, still more preferably 11 to 60, and most preferably 12 to 50.

The compounds of type 1 and type 2 according to the present invention may be added at any stage during the emulsion preparation or photosensitive material production. For example, the addition may be effected at grain formation, desalting, chemical sensitization or coating. The compounds may be divided and added in multiple times during the above stages. The addition stage is preferably after completion of grain formation but before desalting, during chemical sensitization (just before initiation of chemical sensitization to just after termination thereof) or prior to coating. The addition stage is more preferably during chemical sensitization or prior to coating.

The compounds of type 1 and type 2 according to the present invention are preferably dissolved in water, a water soluble solvent such as methanol or ethanol or a mixed solvent thereof before addition. In the dissolving in water, with respect to compounds whose solubility is higher at higher or lower pH value, the dissolution is effected at pH value raised or lowered before addition.

The compounds of type 1 and type 2 according to the present invention, although preferably incorporated in emulsion layers, may be added to not only an emulsion layer but also a protective layer or an interlayer so as to realize diffusion at the time of coating operation. The timing of addition of compounds of the present invention may be before or after sensitizing dye addition, and at either stage the compounds are preferably incorporated in silver halide emulsion layers in an amount of $1\times10^{-9}$ to $5\times10^{-2}$ mol, more preferably $1\times10^{-8}$ to $2\times10^{-3}$ mol per mol of silver halides.

The present invention is preferably used in combination with the technique of increasing a light absorption with a spectral sensitizing dye, more preferably the technique of multilayer adsorption of sensitizing dye. The multilayer adsorption refers to adsorption (or laminating) of more than one layer of dye chromophore on the surface of silver halide grains.

The multilayer adsorption can be effected by, for example, the method of effecting adsorption of sensitizing dyes on the surface of silver halide grains in an amount greater than monolayer saturated coating amount by the use of intermolecular force, or the method of effecting adsorption on silver halide grains of a dye consisting of two or more separate nonconjugated dye chromophores coupled with each other through covalent bond, known as coupled dye. The particulars thereof are described in the following patents relating to multilayer adsorption.

JP-A's-10-239789, 11-133531, 2000-267216, 2000-275772, 2001-75222, 2001-75247, 2001-75221, 2001-75226, 2001-75223, 2001-255615, 2002-23294, 10-171058, 10-186559, 10-197980, 2000-81678, 2001-5132, 2001-166413, 2002-49113, 64-91134, 10-110107, 10-171058, 10-226758, 10-307358, 10-307359, 10-310715, 2000-231174, 2000-231172, 2000-231173 and 2001-350442, and EP's 985965A, 985964A, 985966A, 985967A, 1085372A, 1085373A, 1172688A, 1199595A and 887700A1.

Moreover, the present invention is preferably used in combination with techniques described in JP-A's-10-239789, 2001-75222 and 10-171058.

The emulsions which can be employed in the photosensitive material of the present invention (hereinafter also referred to as "emulsions of the present invention") relate to silver iodobromide, silver bromide or silver chloroiodobromide tabular emulsions.

In the color photosensitive material of the present invention, preferably, each of the unit photosensitive layers is composed of multiple silver halide emulsion layers of substantially identical color sensitivities but different photographic speeds, and 50% or more of the total projected area of silver halide grains contained in at least one emulsion layer of high photographic speed among the silver halide emulsion layers constituting each of the unit photosensitive layers is occupied by tabular silver halide grains (hereinafter also referred to as "tabular grains"). In the present invention, the average aspect ratio of such tabular grains is preferably 8 or higher, more preferably 12 or higher, and most preferably 15 or higher.

With respect to tabular grains, the aspect ratio refers to the ratio of diameter to thickness of silver halides. That is, the aspect ratio is the quotient of diameter divided by thickness with respect to each individual silver halide grain. Herein, the diameter refers to the diameter of a circle with an area equal to the projected area of grain exhibited when silver halide grains are observed through a microscope or an electron microscope. Further, herein, the average aspect ratio refers to the average of aspect ratios regarding all the tabular grains of each emulsion.

In the silver halide photographic emulsion used in each of the layers of highest speed among the green-sensitive silver halide emulsion layers and red-sensitive silver halide emulsion layers according to the present invention, 50% or more by number of all the silver halide grains have a grain thickness of 0.15 μm or less. It is preferred that 60% or more by number of all the silver halide grains be grains of 0.15 μm or less thickness, and also that 50% or more by number of all the silver halide grains be grains of 0.01 to 0.15 μm thickness.

The method of taking a transmission electron micrograph by the replica technique and measuring the equivalent circle diameter and thickness of each individual grain can be mentioned as an example of aspect ratio and grain thickness determining method. In the mentioned method, the thickness is calculated from the length of replica shadow.

The configuration of tabular grains of the present invention is generally hexagonal. The terminology "hexagonal configuration" means that the shape of the main planes of tabular grains is hexagonal, the adjacent side ratio (maximum side length/minimum side length) thereof being 2 or less. The adjacent side ratio is preferably 1.6 or less, more preferably 1.2 or less. It is needless to mention that the lower limit thereof is 1.0. In the grains of high aspect ratio, especially, triangular tabular grains are increased in the tabular grains. The triangular tabular grains are produced when the Ostwald ripening has excessively been advanced. From the viewpoint of obtaining substantially hexagonal tabular grains, it is preferred that the period of this ripening be minimized. For this purpose, it is requisite to endeavor to raise the tabular grain ratio by nucleation. It is preferred that one or both of an aqueous silver ion solution and an aqueous bromide ion solution contain gelatin for the purpose of raising the probability of occurrence of hexagonal tabular grains at the time of adding silver ions and bromide ions to a reaction mixture according to the double jet technique, as described in JP-A-63-11928 by Saito.

The hexagonal tabular grains contained in the lightsensitive material of the present invention are formed through the steps of nucleation, Ostwald ripening and growth. Although all of these steps are important for suppressing the spread of grain size distribution, attention should be paid so as to avoid the spread of size distribution at the first nucleation step because the spread of size distribution brought about in the above steps cannot be narrowed by an ensuing step. What is important in the nucleation step is the relationship between the temperature of reaction mixture and the period of time of nucleation comprising adding silver ions and bromide ions to a reaction mixture according to the double jet technique and producing precipitates. JP-A-63-92942 by Saito describes that it is preferred that the temperature of the reaction mixture at the time of nucleation be in the range of from 20 to 45° C. for realizing a monodispersity enhancement. Further, JP-A-2-222940 by Zola et al describes that the suitable temperature at nucleation is 60° C. or below.

Supplemental addition of gelatin may be effected during the grain formation in order to obtain monodisperse tabular grains of high aspect ratio. The added gelatin is preferably a chemically modified gelatin as described in JP-A's-10-148897 and 11-143002. This chemically modified gelatin is a gelatin characterized in that at least two carboxyl groups have newly been introduced at a chemical modification of amino groups contained in the gelatin, and it is preferred that gelatin trimellitate be used as the same. Also, gelatin succinate is preferably used. The chemically modified gelatin is preferably added prior to the growth step, more preferably-immediately after the nucleation. The addition amount thereof is preferably 60% or greater, more preferably 80% or greater, and most preferably 90% or greater, based on the total mass of dispersion medium used in grain formation.

The tabular grain emulsion is preferably constituted of silver iodobromide or silver chloroiodobromide. Although silver chloride may be contained, the silver chloride content is preferably 8 mol % or less, more preferably 3 mol % or less, and most preferably 0 mol %. With respect to the silver iodide content, it is preferably 20 mol % or less inasmuch as the variation coefficient of the grain size distribution of the tabular grain emulsion is preferably 30% or less. The lowering of the variation coefficient of the distribution of equivalent circle diameter of the tabular grain emulsion can be facilitated by decreasing the silver iodide content. It is especially preferred that the variation coefficient of the grain size distribution of the tabular grain emulsion be 20% or less while the silver iodide content be 10 mol % or less.

Furthermore, it is preferred that the tabular grain emulsion have some intragranular structure with respect to the silver iodide distribution. The silver iodide distribution may have a double structure, a treble structure, a quadruple structure or a structure of higher order.

In the present invention, It is preferable that tabular grains have dislocation lines. Dislocation lines in tabular grains can be observed by a direct method performed using a transmission electron microscope at a low temperature, as described in, e.g., J. F. Hamilton, Phot. Sci. Eng., 11, 57, (1967) or T. Shiozawa, J. Soc. Phot. Sci. Japan, 3, 5, 213, (1972). That is, silver halide grains, carefully extracted from an emulsion so as not to apply any pressure by which dislocations are produced in the grains, are placed on a mesh for electron microscopic observation. Observation is performed by a transmission method while the sample is cooled to prevent damage (e.g., print out) due to electron rays. In this observation, as the thickness of a grain is increased, it becomes more difficult to transmit electron rays through it. Therefore, grains can be observed more clearly by using an electron microscope of a high voltage type (200 kV or more for a grain having a thickness of 0.25 μm). From photographs of grains obtained by the above method, it is possible to obtain the positions and the number of dislocations in each grain viewed in a direction perpendicular to the principal planes of the grain.

The average number of dislocation lines of tabular grains used in the present invention is preferably 10 or more, and more preferably, 20 or more per grain. If dislocation lines are densely present or cross each other, it is sometimes impossible to correctly count dislocation lines per grain. Even in these situations, however, dislocation lines can be roughly counted to such an extent that their number is approximately 10, 20, or 30. This makes it possible to distinguish these grains from those in which obviously only a few dislocation lines are present. The average number of dislocation lines per grain is obtained as a number average by counting dislocation lines of 100 or more grains. Several hundreds of dislocation lines are sometimes found.

Dislocation lines can be introduced to, e.g., a portion near the peripheral region of a tabular grain. In this case, dislocations are substantially perpendicular to the peripheral region and produced from a position x % of the length between the center and the edge (peripheral region) of a tabular grain to the peripheral region. The value of x is preferably 10 to less than 100, more preferably, 30 to less than 99, and most preferably, 50 to less than 98. Although the shape obtained by connecting the start positions of the dislocations is almost similar to the shape of the grain, this shape is not perfectly similar but sometimes distorted. Dislocations of this type are not found in the central region of a grain. The direction of dislocation lines is crystallographically, approximately a (211) direction. Dislocation lines, however, are often zigzagged and sometimes cross each other.

A tabular grain can have dislocation lines either almost uniformly across the whole peripheral region or at a particular position of the peripheral region. That is, in the case of a hexagonal tabular silver halide grain, dislocation lines can be limited to either portions near the six corners or only a portion near one of the six corners. In contrast, it is also possible to limit dislocation lines to only portions near the edges except for the portions near the six corners.

Dislocation lines can also be formed across a region containing the centers of two principal planes of a tabular grain. When dislocation lines are formed across the entire region of the principal planes, the direction of the dislocation lines is sometimes crystallographically, approximately a (211) direction with respect to a direction perpendicular to the principal planes. In some cases, however, the direction is a (110) direction or random. The lengths of the individual dislocation lines are also random; the dislocation lines are sometimes observed as short lines on the principal planes and sometimes observed as long lines reaching the edges (peripheral region). Although dislocation lines are sometimes straight, they are often zigzagged. In many cases, dislocation lines cross each other.

As described above, the position of dislocation lines can be either limited on the peripheral region or the principal planes or a local position on at least one of them. That is, dislocation lines can be present on both the peripheral region and the principal planes.

Introducing dislocation lines to a tabular grain can be achieved by forming a specific silver iodide rich phase inside the grain. This silver iodide rich phase can include a discontinuous silver iodide rich region. More specifically, after a substrate grain is prepared, the silver iodide rich phase is formed and covered with a layer having a silver iodide content lower than that of the silver iodide rich phase. The silver iodide content of the substrate tabular grain is lower than that of the silver iodide rich phase, and is preferably 0 to 20 mol %, and more preferably, 0 to 15 mol %.

In this specification, the silver iodide rich phase inside a grain is a silver halide solid solution containing silver iodide. This silver halide is preferably silver iodide, silver iodobromide, or silver bromochloroiodide, and more preferably, silver iodide or silver iodobromide (the silver iodide content with respect to a silver halide contained in this silver iodide rich phase is 10 to 40 mol %). To cause this silver iodide rich phase inside a grain (to be referred to as an internal silver iodide rich phase hereinafter) to selectively exist on the edge, the corner, or the surface of a substrate grain, it is desirable to control the formation conditions of the substrate grain, the formation conditions of the internal silver iodide rich phase, and the formation conditions of a phase covering the outside of the internal silver iodide rich phase. Important factors as the formation conditions of a substrate grain are the pAg (the logarithm of the reciprocal of a silver ion concentration), the presence/absence, type, and amount of a silver halide solvent, and the temperature. By controlling the pAg to preferably 8.5 or less, more preferably, 8 or less during the growth of substrate grains, the internal silver iodide rich phase can be made to selectively exist in portions near the corners or on the surface of the substrate grain, when this silver iodide rich phase is formed later.

On the other hand, by controlling the pAg to preferably 8.5 or more, more preferably, 9 or more during the growth of substrate grains, the internal silver iodide rich phase can be made to exist on the edges of the substrate grain. The threshold value of the pAg rises and falls depending on the temperature and the presence/absence, type, and amount of a silver halide solvent. When thiocyanate is used as the silver halide solvent, this threshold value of the pAg shifts to higher values. The value of the pAg at the end of the growth of substrate grains is particularly important, among other pAg values during the growth. On the other hand, even if the pAg during the growth does not meet the above value, the position of the internal silver iodide rich phase can be controlled by performing ripening by controlling the pAg to the above proper value after the growth of substrate grains. In this case, ammonia, an amine compound, a thiourea derivative, or thiocyanate salt can be effectively used as the silver halide solvent. The internal silver iodide rich phase can be formed by a so-called conversion method.

This method includes a method which, at a certain point during grain formation, adds halogen ion smaller in solubility for salt for forming silver ion than halogen ion that forms grains or portions near the surfaces of grains at that point. In the present invention, the amount of halogen ion having a smaller solubility to be added preferably takes a certain value (related to a halogen composition) with respect to the surface area of grains at that point. For example, at a given point during grain formation, it is preferable to add a certain amount or more of KI with respect to the surface area of silver halide grains at that point. More specifically, it is preferable to add $8.2\times10^{-5}$ mol/m$^2$ or more of iodide salt.

A more preferable method of forming the internal silver iodide rich phase is to add an aqueous silver salt solution simultaneously with addition of an aqueous silver halide solution containing iodide salt.

As an example, an aqueous $AgNO_3$ solution is added simultaneously with addition of an aqueous KI solution by the double-jet method. In this case, the addition start timings and the addition end timings of the aqueous KI solution and the aqueous $AgNO_3$ solution can be shifted from each other. The addition molar ratio of the aqueous $AgNO_3$ solution to the aqueous KI solution is preferably 0.1 or more, more preferably, 0.5 or more, and most preferably, 1 or more. The total addition molar quantity of the aqueous $AgNO_3$ solution can exit in a silver excess region with respect to halogen ion in the system and iodine ion added. During the addition of the aqueous silver halide solution containing iodine ion and the addition of the aqueous silver salt solution by the double-jet method, the pAg preferably decreases with the addition time by the double-jet. The pAg before the addition is preferably 6.5 to 13, and more preferably, 7.0 to 11. The pAg at the end of the addition is most preferably 6.5 to 10.0.

In carrying out the above method, the solubility of a silver halide in the mixing system is preferably as low as possible. Therefore, the temperature of the mixing system at which the silver iodide rich phase is formed is preferably 30° C. to 80° C., and more preferably, 30° C. to 70° C.

The formation of the internal silver iodide rich phase is most preferably performed by adding fine-grain silver iodide, fine-grain silver iodobromide, fine-grain silver chloroiodide, or fine-grain silver bromochloroiodide. The addition of fine-grain silver iodide is particularly preferred. These fine grains normally have a grain size of 0.01 to 0.1 μm, but those having a grain size of 0.01 μm or less or 0.1 μm or more can also be used. Methods of preparing these fine silver halide grains are described in JP-A's-1-183417, 2-44335, 1-183644, 1-183645, 2-43534, and 2-43535, the disclosures of which are incorporated herein by reference. The internal silver iodide rich phase can be formed by adding and ripening these fine silver halide grains.

In dissolving the fine grains by ripening, the silver halide solvent described above can also be used. These fine grains added need not immediately, completely dissolve to disappear but need only disappear by dissolution when the final grains are completed.

The internal silver iodide rich phase is located in a region of, when measuring from the center of, e.g., a hexagon formed in a plane by projecting a grain thereon, preferably 5 to less than 100 mol %, more preferably, 20 to less than 95 mol %, and most preferably, 50 to less than 90 mol % with respect to the total silver amount of the grain. The amount of a silver halide which forms the internal silver iodide rich phase is, as a silver amount, preferably 50 mol % or less, and more preferably, 20 mol % or less of the total silver amount of a grain. These values of amounts of the silver iodide rich phase are not those obtained by measuring the halogen composition of the final grain by using various analytical methods but formulated values in the producing of a silver halide emulsion. The internal silver iodide rich phase often disappears from the final grain owing to, e.g., recrystallization, and so all silver amounts described above are related to their formulated values.

It is, therefore, readily possible to observe dislocation lines in the final grains by the above method, but the internal silver iodide rich phase introduced to introduce dislocation lines cannot be observed as a definite phase in many cases because the silver iodide composition in the boundary continuously changes. The halogen compositions in each portion of a grain can be checked by combining X-ray diffraction, an EPMA (also called an XMA) method (a method of scanning a silver halide grain by electron rays to detect its silver halide composition), and an ESCA (also called an XPS) method (a method of radiating X-rays to spectroscopically detect photoelectrons emitted from the surface of a grain).

The silver iodide content of an outer phase covering the internal silver iodide rich phase is lower than that of the silver iodide rich phase, and is preferably 0 to 30 mol %, more preferably, 0 to 20 mol %, and most preferably, 0 to 10 mol % with respect to a silver halide amount contained in the outer phase.

Although the temperature and the pAg, at which the outer phase covering the internal silver iodide rich phase is formed, can take arbitrary values, the temperature is preferably 30° C. to 80° C., and most preferably, 35° C. to 70° C., and the pAg is preferably 6.5 to 11.5. The use of the silver halide solvents described above is sometimes preferable, and the most preferable silver halide solvent is thiocyanate salt.

Another method of introducing dislocation lines to tabular grains is to use an iodide ion releasing agent as described in JP-A-6-11782, the disclosure of which is incorporated herein by reference. This method is also preferably used. Dislocation lines can also be introduced by appropriately combining this dislocation line introducing method with the above-mentioned dislocation line introducing method.

The variation coefficient of the inter-grain iodide distribution of silver halide grains contained in a light-sensitive material of the present invention is preferably 20% or less, more preferably, 15% or less, and most preferably, 10% or less. If the variation coefficient of the iodide content distribution of each individual silver halide is larger than 20%, no high contrast can be obtained, and a reduction of the sensitivity upon application of a pressure increases.

Any known method can be used as a method of producing silver halide grains contained in a light-sensitive material of the present invention and having a narrow inter-grain iodide distribution. Examples are a method of adding fine grains as disclosed in JP-A-1-183417 and a method which uses an iodide ion releasing agent as disclosed in JP-A-2-68538, the disclosures of which are incorporated herein by reference. These methods can be used alone or in combination.

The variation coefficient of the inter-grain iodide distribution of silver halide grains used in the present invention is preferably 20% or less. The most preferred method of monodispersing the inter-grain iodide distribution is a method described in JP-A-3-213845, the disclosure of which is incorporated herein by reference. That is, fine silver halide grains containing 95 mol % or more of silver iodide are formed by mixing an aqueous solution of a water-soluble silver salt and an aqueous solution of a water-soluble halide (containing 95 mol % or more of iodide ions) in a mixer placed outside a reaction vessel, and supplied to the reaction vessel immediately after the formation. In this manner, a monodisperse inter-grain iodide distribution can be achieved. The reaction vessel is a vessel which causes nucleation and/or crystal growth of tabular silver halide grains.

As described in JP-A-3-213845, the disclosure of which is incorporated herein by reference, the following three technologies can be used as a method of adding the silver halide grains prepared in the mixer and as a preparing means used in the method.

(1) After being formed in the mixer, the fine grains are immediately added to the reaction vessel.

(2) Strong and efficient stirring is performed in the mixer.

(3) An aqueous protective colloid solution is poured into the mixer.

The protective colloid used in method (3) above can be singly poured into the mixer or can be poured into the mixer after being contained in an aqueous halogen salt solution or aqueous silver nitrate solution. The concentration of the protective colloid is 1 mass % or more, preferably 2 to 5 mass %. Examples of a polymer compound having a protective colloid function with respect to silver halide grains used in the present invention are a polyacrylamide polymer, an amino polymer, a polymer having a thioether group, polyvinyl alcohol, an acrylic acid polymer, a polymer having hydroxyquinoline, cellulose, starch, acetal, polyvinylpyrrolidone, and a ternary polymer. The use of low-molecular-weight gelatin is preferred. The weight-average molecular weight of this low-molecular-weight gelatin is preferably 30,000 or less, and more preferably, 10,000 or less.

When fine silver halide grains are to be prepared, the grain formation temperature is preferably 35° C. or less, and particularly preferably, 25° C. or less. The temperature of the reaction vessel to which fine silver halide grains are added is 50° C. or more, preferably 60° C. or more, and more preferably, 70° C. or more.

The grain size of a fine silver halide used in the present invention can be directly confirmed by a transmission electron microscope by placing the grain on a mesh. The size of fine grains used in the present invention is preferably 0.3 μm or less, more preferably, 0.1 μm or less, and most preferably, 0.01 μm or less. This fine silver halide can be added simultaneously with another halogen ion or silver ion or can be added alone. The mixing amount of the fine silver halide grains is 0.005 to 20 mol %, preferably 0.01 to 10 mol % with respect to a total silver halide.

The silver iodide content of each grain can be measured by analyzing the composition of the grain by using an X-ray microanalyzer. The variation coefficient of an inter-grain iodide distribution is a value defined by $$(\text{standard deviation}/\text{average silver iodide content})\times 100=\text{variation coefficient}\ (\%)$$

by using the standard deviation of silver iodide contents and the average silver iodide content when the silver iodide contents of at least 100, more preferably, 200, and most preferably, 300 emulsion grains are measured. The measurement of the silver iodide content of each individual grain is described in, e.g., European Patent 147,868. A silver iodide content Yi [mol %] and an equivalent-sphere diameter Xi [μm] of each grain sometimes have a correlation and sometimes do not. However, Yi and Xi desirably have no correlation. The silver halogen composition structure of a grain used in the present invention can be checked by combining, e.g., X-ray diffraction, an EPMA (also called an XMA) method (a method of scanning a silver halide grain by electron rays to detect its silver halide composition), and an ESCA (also called an XPS) method (a method of radiating X-rays to spectroscopically detect photoelectrons emitted from the surface of a grain). When the silver iodide content is measured in the present invention, the grain surface is a region about 5 nm deep from the surface, and the grain interior is a region except for the surface. The halogen composition of this grain surface can usually be measured by the ESCA method.

In the present invention, regular-crystal grains such as cubic, octahedral, and tetradecahedral grains and irregular twinned-crystal grains can be used in addition to aforementioned tabular grains.

Silver halide emulsions used in the present invention are preferably subjected to selenium sensitization or gold sensitization.

As selenium sensitizers usable in the present invention, selenium compounds disclosed in conventionally known patents can be used. Usually, a labile selenium compound and/or a non-labile selenium compound is used by adding it to an emulsion and stirring the emulsion at a high temperature, preferably 40° C. or more for a predetermined period of time. As non-labile selenium compounds, it is preferable to use compounds described in, e.g., JP-B's-44-15748 and 43-13489, and JP-A's-4-25832 and 4-109240, the disclosures of which are incorporated herein by reference.

Practical examples of a labile selenium sensitizer are isoselenocyanates (e.g., aliphatic isoselenocyanates such as allylisoselenocyanate), selenoureas, selenoketones, selenoamides, selenocarboxylic acids (e.g., 2-selenopropionic acid and 2-selenobutyric acid), selenoesters, diacylselenides (e.g., bis(3-chloro-2,6-dimethoxybenzoyl)selenide), selenophosphates, phosphineselenides, and colloidal metal selenium.

Although preferred examples of a labile selenium compound are described above, the present invention is not limited to these examples. It is generally agreed by those skilled in the art that the structure of a labile selenium compound used as a sensitizer for a photographic emulsion is not so important as long as selenium is labile, and that the organic part of a molecule of a selenium sensitizer has no important role except the role of carrying selenium and keeping it in a labile state in an emulsion. In the present invention, therefore, labile selenium compounds in this extensive concept are advantageously used.

Examples of a non-labile selenium compound usable in the present invention are compounds described in JP-B's-46-4553, 52-34491, and 52-34492, the disclosures of which are incorporated herein by reference. Practical examples of a non-labile selenium compound are selenious acid, potassium selenocyanide, selenazoles, quaternary ammonium salts of selenazoles, diarylselenide, diaryldiselenide, dialkylselenide, dialkyldiselenide, 2-selenazolidinedione, 2-selenoxazolidinethione, and derivatives of these compounds.

These selenium sensitizers are dissolved in water, an organic solvent such as methanol or ethanol, or a solvent mixture of such organic solvents, and the resultant solution is added during chemical sensitization, preferably before the start of chemical sensitization. A selenium sensitizer to be used is not limited to one type, but two or more types of the selenium sensitizers described above can be used together. Combining a labile selenium compound and a non-labile selenium compound is preferred.

The addition amount of selenium sensitizers usable in the present invention changes in accordance with the activity of each selenium sensitizer used, the type or grain size of a silver halide, and the temperature and time of ripening. The addition amount, however, is preferably $2\times10^{-6}$ to $5\times10^{-6}$ mol per mol of a silver halide. When selenium sensitizers are used, the temperature of chemical sensitization is preferably 40° C. to 80° C. The pAg and pH can take given values. For example, the effect of the present invention can be obtained in a wide pH range of 4 to 9.

Selenium sensitization can be achieved more effectively in the presence of a silver halide solvent.

Examples of a silver halide solvent usable in the present invention are (a) organic thioethers described in U.S. Pat Nos. 3,271,157, 3,531,289, and 3,574,628, and JP-A's-54-1019 and 54-158917, the disclosures of which are incorporated herein by reference, (b) thiourea derivatives described in JP-A's-53-82408, 55-77737, and 55-2982, the disclosures of which are incorporated herein by reference, (c) a silver halide solvent having a thiocarbonyl group sandwiched between an oxygen or sulfur atom and a nitrogen atom, described in JP-A-53-144319, the disclosure of which is incorporated herein by reference, (d) imidazoles described in JP-A-54-100717, the disclosure of which is incorporated herein by reference, (e) sulfite, and (f) thiocyanate.

Most preferred examples of a silver halide solvent are thiocyanate and tetramethylthiourea. Although the amount of a solvent to be used changes in accordance with its type, a preferred amount is $1\times10^{-4}$ to $1\times10^{-2}$ mol per mol of a silver halide.

A gold sensitizer for use in gold sensitization of the present invention can be any compound having an oxidation number of gold of +1 or +3, and it is possible to use gold compounds normally used as gold sensitizers. Representative examples are chloroaurate, potassium chloroaurate, auricrichloride, potassium auricthiocyanate, potassium iodoaurate, tetracyanoauric acid, ammonium aurothiocyanate, pyridyltrichloro gold, gold sulfide, and gold selenide. Although the addition amount of gold sensitizers changes in accordance with various conditions, the amount is preferably $1\times10^{-7}$ to $5\times10^{-5}$ mol per mol of a silver halide.

Emulsions used in the present invention are preferably subjected to sulfur sensitization during chemical sensitization.

This sulfur sensitization is commonly performed by adding sulfur sensitizers and stirring the emulsion for a predetermined time at a high temperature, preferably 40° C. or more.

Sulfur sensitizers known to those skilled in the art can be used in sulfur sensitization described above. Examples are thiosulfate, allylthiocarbamidothiourea, allylisothiacyanate, cystine, p-toluenethiosulfonate, and rhodanine. It is also possible to use sulfur sensitizers described in, e.g., U.S. Pat. Nos. 1,574,944, 2,410,689, 2,278,947, 2,728,668, 3,501,313, and 3,656,955, German Patent 1,422,869, JP-B-56-24937, and JP-A-55-45016, the disclosures of which are incorporated herein by reference. The addition amount of sulfur sensitizers need only be large enough to effectively increase the sensitivity of an emulsion. This amount changes over a wide range in accordance with various conditions, such as the pH, the temperature, and the size of silver halide grains. However, the amount is preferably $1\times10^{-7}$ to $5\times10^{-5}$ mol per mol of a silver halide.

Silver halide emulsions used in the present invention can also be subjected to reduction sensitization during grain formation, after grain formation and before or during chemical sensitization, or after chemical sensitization.

Reduction sensitization can be selected from a method of adding reduction sensitizers to a silver halide emulsion, a method called silver ripening in which grains are grown or ripened in a low-pAg ambient at pAg 1 to 7, and a method called high-pH ripening in which grains are grown or ripened in a high-pH ambient at pH 8 to 11. Two or more of these methods can also be used together.

The method of adding reduction sensitizers is preferred in that the level of reduction sensitization can be finely adjusted.

Known examples of reduction sensitizers are stannous salt, ascorbic acid and its derivative, amines and polyamines, a hydrazine derivative, formamidinesulfinic acid, a silane compound, and a borane compound. In reduction sensitization of the present invention, it is possible to selectively use these known reduction sensitizers or to use two or more types of compounds together. Preferred compounds as reduction sensitizers are stannous chloride, thiourea dioxide, dimethylamineborane, and ascorbic acid and its derivative. Although the addition amount of reduction sensitizers must be so selected as to meet the emulsion producing conditions, a preferable amount is $10^{-7}$ to $10^{-3}$ mol per mol of a silver halide.

Reduction sensitizers are dissolved in water or an organic solvent such as alcohols, glycols, ketones, esters, or amides, and the resultant solution is added during grain growth. Although adding to a reactor vessel in advance is also preferred, adding at a given timing during grain growth is more preferred. It is also possible to add reduction sensitizers to an aqueous solution of a water-soluble silver salt or of a water-soluble alkali halide to precipitate silver halide grains by using this aqueous solution. Alternatively, a solution of reduction sensitizers can be added separately several times or continuously over a long time period with grain growth.

It is preferable to use an oxidizer for silver during the process of producing emulsions used in the present invention. An oxidizer for silver is a compound having an effect of converting metal silver into silver ion. A particularly effective compound is the one that converts very fine silver grains, formed as a by-product in the process of formation and chemical sensitization of silver halide grains, into silver ion. The silver ion produced can form a silver salt hard to dissolve in water, such as a silver halide, silver sulfide, or silver selenide, or a silver salt easy to dissolve in water, such as silver nitrate. An oxidizer for silver can be either an inorganic or organic substance. Examples of an inorganic oxidizer are ozone, hydrogen peroxide and its adduct (e.g., $NaBO_2.H_2O_2.3H_2O$, $2NaCO_3.3H_2O_2$, $Na_4P_2O_7.2H_2O_2$, and $2Na_2SO_4.H_2O_2.2H_2O$), peroxy acid salt (e.g., $K_2S_2O_8$, $K_2C_2O_6$, and $K_2P_2O_8$), a peroxy complex compound (e.g., $K_2[Ti(O_2)C_2O_4].3H_2O$, $4K_2SO_4.Ti(O_2)OH.SO_4.2H_2O$, and $Na_3[VO(O_2)(C_2H_4)_2.6H_2O]$), permanganate (e.g., $KMnO_4$), an oxyacid salt such as chromate (e.g., $K_2Cr_2O_7$), a halogen element such as iodine and bromine, perhalogenate (e.g., potassium periodate), a salt of a high-valence metal (e.g., potassium hexacyanoferrate(II)), and thiosulfonate.

Examples of an organic oxidizer are quinones such as p-quinone, an organic peroxide such as peracetic acid and perbenzoic acid, and a compound for releasing active halogen (e.g., N-bromosuccinimide, chloramine T, and chloramine B).

Preferable oxidizers of the present invention are inorganic oxidizers such as ozone, hydrogen peroxide and its adduct, a halogen element, and thiosulfonate, and organic oxidizers such as quinones.

It is preferable to use the reduction sensitization described above and the oxidizer for silver together. In this case, the reduction sensitization can be performed after the oxidizer is used or vice versa, or the oxidizer can be used simultaneously with the reduction sensitization. These methods can be applied to both the grain formation step and the chemical sensitization step.

Photographic emulsions used in the present invention can achieve high color saturation when spectrally sensitized by preferably methine dyes and the like. Usable dyes involve a cyanine dye, merocyanine dye, composite cyanine dye, composite merocyanine dye, holopolar cyanine dye, hemicyanine dye, styryl dye, and hemioxonole dye. Most useful dyes are those belonging to a cyanine dye, merocyanine dye, and composite merocyanine dye. These dyes can contain any nucleus commonly used as a basic heterocyclic nucleus in cyanine dyes.

Examples are a pyrroline nucleus, oxazoline nucleus, thiazoline nucleus, pyrrole nucleus, oxazole nucleus, thiazole nucleus, selenazole nucleus, imidazole nucleus, tetrazole nucleus, and pyridine nucleus; a nucleus in which an aliphatic hydrocarbon ring is fused to any of the above nuclei; and a nucleus in which an aromatic hydrocarbon ring is fused to any of the above nuclei, e.g., an indolenine nucleus, benzindolenine nucleus, indole nucleus, benzoxadole nucleus, naphthoxazole nucleus, benzthiazole nucleus, naphthothiazole nucleus, benzoselenazole nucleus, benzimidazole nucleus, and quinoline nucleus. These nuclei can be substituted on a carbon atom.

It is possible to apply to a merocyanine dye or a composite merocyanine dye a 5- or 6-membered heterocyclic nucleus as a nucleus having a ketomethylene structure. Examples are a pyrazoline-5-one nucleus, thiohydantoin nucleus, 2-thiooxazolidine-2,4-dione nucleus, thiazolidine-2,4-dione nucleus, rhodanine nucleus, and thiobarbituric acid nucleus.

Although these sensitizing dyes can be used singly, they can also be combined. The combination of sensitizing dyes is often used for a supersensitization purpose. Representative examples of the combination are described in U.S. Pat. Nos. 2,688,545, 2,977,229, 3,397,060, 3,522,0523, 3,527,641, 3,617,293, 3,628,964, 3,666,480, 3,672,898, 3,679,4283, 3,703,377, 3,769,301, 3,814,609, 3,837,862, and 4,026,707, British Patents 1,344,281 and 1,507,803, JP-B's-43-4936 and 53-12375, and JP-A's-52-110618 and 52-109925, the disclosures of which are incorporated herein by reference. In addition to sensitizing dyes, emulsions can contain dyes having no spectral sensitizing effect or substances not substantially absorbing visible light and presenting supersensitization.

Further, the present invention is preferably combined with a technique of increasing a light absorption factor by the addition of a spectral sensitizing dye. For example, there can be mentioned more than monolayer saturated adsorption (namely, single-layer adsorption) of a sensitizing dye onto the surface of silver halide grains by means of intermolecular force, or adsorption of a so-called connected dye, comprising a plurality of chromophores connected to each other by covalent bonds without separate conjugation. In particular, it is more preferred to combine the present invention with techniques described in the following patent publications:

JP-A's-10-239789, 11-133531, 2000-267216, 2000-275772, 2001-75222, 2001-75247, 2001-75221, 2001-75226, 2001-75223, 2001-255615, 2002-23294, 10-171058, 10-186559, 10-197980, 2000-81678, 2001-5132, 2001-166413, 2002-49113, 64-91134, 10-110107, 10-171058, 10-226758, 10-307358, 10-307359, 10-310715, 2000-231174, 2000-231172, 2000-231173 and 2001-356442 and EP's 985965A, 985964A, 985966A, 985967A, 1085372A, 1085373A, 1172688A, 1199595A and 887700A1.

Sensitizing dyes can be added to an emulsion at any point conventionally known to be useful during the preparation of an emulsion. Most ordinarily, sensitizing dyes are added after the completion of chemical sensitization and before coating. However, it is possible to perform the addition simultaneously with the addition of chemical sensitizing dyes to thereby perform spectral sensitization and chemical sensitization at the same time, as described in U.S. Pat. Nos. 3,628,969 and 4,225,666, the disclosures of which are incorporated herein by reference. It is also possible to perform the addition prior to chemical sensitization, as described in JP-A-58-113928, the disclosure of which is incorporated herein by reference, or before the completion of the formation of a silver halide grain precipitate to thereby start spectral sensitization. Alternatively, as disclosed in U.S. Pat. No. 4,225,666, these sensitizing dyes can be added separately; a portion of the sensitizing dyes is added prior to chemical sensitization, and the rest is added after that. That is, sensitizing dyes can be added at any timing during the formation of silver halide grains, including the method disclosed in U.S. Pat. No. 4,183,756, the disclosure of which is incorporated herein by reference.

When a plurality of sensitizing dyes are to be added, these sensitizing dyes can be separately added with predetermined pauses between them or added mixedly, or a portion of one sensitizing dye is previously added and the rest is added together with the other sensitizing dyes. That is, it is possible to select an optimum method in accordance with the types of the chosen sensitizing dyes and with the desired spectral sensitivity.

The addition amount of sensitizing dyes can be $4\times10^{-6}$ to $8\times10^{-3}$ mol per mol of a silver halide. However, for a more favorable silver halide grain size of 0.2 to 1.2 μm, an addition amount of about $5\times10^{-5}$ to $2\times10^{-3}$ mol is more effective.

The twin plane spacing of a silver halide grain used in the present invention is preferably 0.017 μm or less, more preferably, 0.007 to 0.017 μm, and most preferably, 0.007 to 0.015 μm.

Fog occurring while a silver halide emulsion used in the present invention is aged can be improved by adding and dissolving a previously prepared silver iodobromide emulsion during chemical sensitization. This silver iodobromide emulsion can be added at any timing during chemical sensitization. However, it is preferable to first add and dissolve the silver iodobromide emulsion and then add sensitizing dyes and chemical sensitizers in this order. The silver iodobromide emulsion used has an iodide content lower than the surface iodide content of a host grain, and is preferably a pure silver bromide emulsion. The size of this silver iodobromide emulsion is not limited as long as the emulsion can be completely dissolved. However, the equivalent-sphere diameter is preferably 0.1 μm or less, and more preferably, 0.05 μm or less. Although the addition amount of the silver iodobromide emulsion changes in accordance with a host grain used, the amount is basically preferably 0.005 to 5 mol %, and more preferably, 0.1 to 1 mol % per mol of silver.

Common dopants known to be useful to silver halide emulsions can be used in emulsions used in the present invention. Examples of common dopants are Fe, Co, Ni, Ru, Rh, Pd, Re, Os, Ir, Pt, Au, Hg, Pb, and Ti. In the present invention, a hexacyano iron(II) complex and hexacyanoruthenium complex (to be simply referred to as "metal complexes" hereinafter) are preferably used.

The addition amount of these metal complexes is preferably $10^{-7}$ to $10^{-3}$ mol, and more preferably, $1.0\times10^{-5}$ to $5\times10^{-4}$ mol per mol of a silver halide.

Metal complexes used in the present invention can be added in any stage of the preparation of silver halide grains, i.e., before or after nucleation, growth, physical ripening, or chemical sensitization. Also, metal complexes can be divisionally added a plurality of times. However, 50% or more of the total content of metal complexes contained in a silver halide grain are preferably contained in a layer ½ or less as a silver amount from the outermost surface of the grain. A layer not containing metal complexes can also be formed on the outside, i.e., on the side away from a support, of the layer containing metal complexes herein mentioned.

These metal complexes are preferably contained by dissolving them in water or an appropriate solvent and directly adding the solution to a reaction solution during the formation of silver halide grains, or by forming silver halide grains by adding them to an aqueous silver salt solution, aqueous silver salt solution, or some other solution for forming the grains. Alternatively, these metal complexes are also favorably contained by adding and dissolving fine silver halide grains previously made to contain the metal complexes, and depositing these grains on other silver halide grains.

When these metal complexes are to be added, the hydrogen ion concentration in a reaction solution is such that the pH is preferably 1 to 10, and more preferably, 3 to 7.

The silver halide color photographic light-sensitive material of the present invention comprises a support and, superimposed thereon, at least two, having different sensitivities, red-sensitive silver halide emulsion layers and green-sensitive silver halide emulsion layers and at least one blue-sensitive silver halide emulsion layer and nonsensitive layer.

In a multilayered silver halide color photographic light-sensitive material, unit light-sensitive layers are generally arranged in the order of red-, green-, and blue-sensitive layers from a support. However, according to the intended use, this order of arrangement can be reversed, or light-sensitive layers sensitive to the same color can sandwich another light-sensitive layer sensitive to a different color. Non-light-sensitive layers can be formed between the silver halide sensitive layers and as the uppermost layer and the lowermost layer. These non-light-sensitive layers can contain, e.g., couplers, DIR compounds, and color amalgamation inhibitors to be described later. As a plurality of silver halide emulsion layers constituting each unit light-sensitive layer, as described in DE 1,121,470 or GB 923,045, the disclosures of which are incorporated herein by reference, high- and low-speed emulsion layers are preferably arranged such that the sensitivity is sequentially decreased toward a support. Also, as described in JP-A's-57-112751, 62-200350, 62-206541, and 62-206543, the disclosures of which are incorporated herein by reference, layers can be arranged such that a low-speed emulsion layer is formed apart from a support and a high-speed emulsion layer is formed close to the support.

More specifically, layers can be arranged, from the one farthest from-a support, in the order of a low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL, or the order of BH/BL/GH/GL/RL/RH.

In addition, as described in JP-B-55-34932, the disclosure of which is incorporated herein by reference, layers can be arranged in the order of a blue-sensitive layer/GH/RH/GL/

RL from the one farthest from a support. Furthermore, as described in JP-A's-56-25738 and 62-63936, the disclosures of which are incorporated herein by reference, layers can be arranged in the order of a blue-sensitive layer/GL/RL/GH/RH from the one farthest from a support.

As described in JP-B-49-15495, the disclosure of which is incorporated herein by reference, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer, i.e., three layers having different sensitivities can be arranged such that the sensitivity is sequentially decreased toward a support. Even when a layer structure is thus constituted by three layers having different sensitivities, these layers can be arranged, in a layer sensitive to one color, in the order of a medium-speed emulsion layer/high-speed emulsion layer/low-speed emulsion layer from the one farthest from a support as described in JP-A-59-202464, the disclosure of which is incorporated herein by reference.

In addition, the order of a high-speed emulsion layer/low-speed emulsion layer/medium-speed emulsion layer or low-speed emulsion layer/medium-speed emulsion layer/high-speed emulsion layer can be used.

Furthermore, the arrangement can be changed as described above even when four or more layers are formed.

As a means for improving the color reproduction, the use of an interlayer inhibiting effect is preferred.

The size and shape of silver halide grains to be used in the layer for donating the interlayer effect to red-sensitive layers are not particularly restricted. It is, however, favorable to use so-called tabular grains having a high aspect ratio, a monodisperse emulsion which is uniform in grain size, or silver iodobromide grains having a layered structure of iodide. In addition, to enlarge the exposure latitude, it is preferable to mix two or more types of emulsions different in grain size.

Although the donor layer which donates the interlayer effect to a red-sensitive layer can be formed in any position on a support, it is preferable to form this layer closer to the support than a blue-sensitive layer and farther from the support than a green-sensitive layer. It is more preferable that the donor layer be located closer to the support than a yellow filter layer.

It is further preferable that the donor layer which donates the interlayer effect to a red-sensitive layer be located closer to a support than a green-sensitive layer and farther from the support than the red-sensitive layer. It is most preferable that the donor layer be located adjacent to the side of a green-sensitive layer close to a support. "Adjacent" means that there is no interlayer or the like in between.

The layer which donates the interlayer effect to a red-sensitive layer can include a plurality of layers. In that case, these layers can be either adjacent to or separated from each other.

Solid disperse dyes described in JP-A-11-305396, the disclosure of which is incorporated herein by reference can be used in the present invention.

An emulsion used in a light-sensitive material of the present invention can be any of a surface latent image type emulsion which mainly forms a latent image on the surface of a grain, an internal latent image type emulsion which forms a latent image in the interior of a grain, and another type of emulsion which has latent images on the surface and in the interior of a grain. However, the emulsion must be a negative type emulsion. The internal latent image type emulsion can be a core/shell internal latent image type emulsion described in JP-A-63-264740, the disclosure of which is incorporated herein by reference. A method of preparing this core/shell internal latent image type emulsion is described in JP-A-59-133542, the disclosure of which is incorporated herein by reference. Although the thickness of a shell of this emulsion depends on the development conditions and the like, it is preferably 3 to 40 nm, and most preferably, 5 to 20 nm.

A silver halide emulsion is normally subjected to physical ripening, chemical sensitization, and spectral sensitization before being used. Additives for use in these steps are described in Research Disclosure (RD) Nos. 17643, 18716, and 307105, and the corresponding portions are summarized in a table to be presented later.

In a light-sensitive material of the present invention, it is possible to mix, in a single layer, two or more types of emulsions different in at least one of the characteristics, i.e., the grain size, grain size distribution, halogen composition, grain shape, and sensitivity, of a sensitive silver halide emulsion.

It is also preferable to apply surface-fogged silver halide grains described in U.S. Pat. No. 4,082,553, internally fogged silver halide grains described in U.S. Pat. No. 4,626,498 and JP-A-59-214852, and colloidal silver, to light-sensitive silver halide emulsion layers and/or substantially non-light-sensitive hydrophilic colloid layers. The internally fogged or surface-fogged silver halide grain means a silver halide grain which can be developed uniformly (non-imagewise) regardless of whether the location is a non-exposed portion or an exposed portion of the light-sensitive material. A method of preparing the internally fogged or surface-fogged silver halide grain is described in U.S. Pat. No. 4,626,498 and JP-A-59-214852. A silver halide which forms the core of the internally fogged core/shell type silver halide grain can have a different halogen composition. As the internally fogged or surface-fogged silver halide, any of silver chloride, silver chlorobromide, silver iodobromide, and silver bromochloroiodide can be used. The average grain size of these fogged silver halide grains is preferably 0.01 to 0.75 μm, and most preferably, 0.05 to 0.6 μm. The grain shape can be a regular grain shape. Although the emulsion can be a polydisperse emulsion, it is preferably a monodisperse emulsion (in which at least 95% in weight, or number, of silver halide grains have grain sizes falling within the range of ±40% of the average grain size).

In the present invention, a non-light-sensitive fine-grain silver halide is preferably used. The non-light-sensitive fine-grain silver halide preferably consists of silver halide grains which are not exposed during imagewise exposure for obtaining a dye image and are not substantially developed during development. These silver halide grains are preferably not fogged in advance. In the fine-grain silver halide, the content of silver bromide is 0 to 100 mol %, and silver chloride and/or silver iodide can be added if necessary. The fine-grain silver halide preferably contains 0.5 to 10 mol % of silver iodide. The average grain size (the average value of equivalent-circle diameters of projected areas) of the fine-grain silver halide is preferably 0.01 to 0.5 μm, and more preferably, 0.02 to 2 μm.

The fine-grain silver halide can be prepared following the same procedures as for a common light-sensitive silver halide. The surface of each silver halide grain need not be optically sensitized nor spectrally sensitized. However, before the silver halide grains are added to a coating solution, it is preferable to add a well-known stabilizer such as a triazole-based compound, azaindene-based compound, benzothiazolium-based compound, mercapto-based compound, or zinc compound. Colloidal silver can be added to this fine-grain silver halide grain-containing layer.

Although the several different additives described above are used in a light-sensitive material according to this technique, a variety of other additives can also be used in accordance with the intended use.

These additives are described in more detail in Research Disclosures Item 17643 (December, 1978), Item 18716 (November, 1979), and Item 308119 (December, 1989) , the disclosures of which are incorporated herein by reference. The corresponding portions are summarized in a table below.

| Additives | RD17643 | RD18716 |
|---|---|---|
| 1. Chemical sensitizers | page 23 | page 648, right column |
| 2. Sensitivity increasing agents | | page 648, right column |
| 3. Spectral sensitizers, super sensitizers | pages 23–24 | page 648, right column to page 649, right column |
| 4. Brighteners | page 24 | |
| 5. Antifoggants and stabilizers | pages 24–25 | page 649, right column |
| 6. Light absorbent, filter dye, ultraviolet absorbents | pages 25–26 | page 649, right column to page 650, left column |
| 7. Stain preventing agents | page 25, right column | page 650, left to right columns |
| 8. Dye image stabilizer | page 25 | |
| 9. Hardening agents | page 26 | page 651, left column |
| 10. Binder | page 26 | page 651, left column |
| 11. Plasticizers, lubricants | page 27 | page 650, right column |
| 12. Coating aids, surface active agents | pages 26–27 | page 650, right column |
| 13. Antistatic agents | page 27 | page 650, right column |
| 14. Matting agent | | |

| Additives | RD308119 |
|---|---|
| 1. Chemical sensitizers | page 996 |
| 2. Sensitivity increasing agents | |
| 3. Spectral sensitizers, super sensitizers | page 996, right column to page 998, right column |
| 4. Brighteners | page 998, right column |
| 5. Antifoggants and stabilizers | page 998, right column to page 1,000, right column |
| 6. Light absorbent, filter dye, ultraviolet absorbents | page 1,003, left column to page 1,003, right column |
| 7. Stain preventing agents | page 1,002, right column |
| 8. Dye image stabilizer | page 1,002, right column |
| 9. Hardening agents | page 1,004, right column to page 1,005, left column |
| 10. Binder | page 1,003, right column to page 1,004, right column |

-continued

| Additives | RD308119 |
|---|---|
| 11. Plasticizers, lubricants | page 1,006, left to right columns |
| 12. Coating aids, surface active agents | page 1,005, left column to page 1,006, left column |
| 13. Antistatic agents | page 1,006, right column to page 1,007, left column |
| 14. Matting agent | page 1,008, left column to page 1,009, left column |

Techniques such as a layer arrangement technique, silver halide emulsions, dye forming couplers, functional couplers such as DIR couplers, various additives, and development usable in photographic light-sensitive materials of the present invention and emulsions used in the materials are described in European Patent No. 0565096A1 (laid open in Oct. 13, 1993) and the patents cited in it, the disclosures of which are incorporated herein by reference. The individual items and the corresponding portions are enumerated below.

1. Layer arrangements: page 61, lines 23–35, page 61, line 41–page 62, line 14
2. Interlayers: page 61, lines 36–40
3. Interlayer effect donor layers: page 62, lines 15–18
4. Silver halide halogen compositions: page 62, lines 21–25
5. Silver halide grain crystal habits: page 62, lines 26–30
6. Silver halide grain size: page 62, lines 31–34
7. Emulsion preparation methods: page 62, lines 35–40
8. Silver halide grain size distribution: page 62, lines 41–42
9. Tabular grains: page 62, lines 43–46
10. Internal structures of grains: page 62, lines 47–53
11. Latent image formation types of emulsions: page 62, line 54–page 63, line 5
12. Physical ripening and chemical sensitization of emulsions: page 63, lines 6–9
13. Use of emulsion mixtures: page 63, lines 10–13
14. Fogged emulsions: page 63, lines 14–31
15. Non-light-sensitive emulsions: page 63, lines 32–43
16. Silver coating amount: page 63, lines 49–50
17. Formaldehyde scavengers: page 64, lines 54–57
18. Mercapto-based antifoggants: page 65, lines 1–2
19. Agents releasing, e.g., fogging agent: page 65, lines 3–7
20. Dyes: page 65, lines 7–10
21. General color couplers: page 65, lines 11–13
22. Yellow, magenta, and cyan couplers: page 65, lines 14–25
23. Polymer couplers: page 65, lines 26–28
24. Diffusing dye forming couplers: page 65, lines 29–31
25. Colored couplers: page 65, lines 32–38
26. General functional couplers: page 65, lines 39–44
27. Bleaching accelerator release couplers: page 65, lines 45–48
28. Development accelerator release couplers: page 65, lines 49–53
29. Other DIR couplers: page 65, line 54–page 66, line 4
30. Coupler diffusing methods: page 66, lines 5–28
31. Antiseptic agents and mildewproofing agents: page 66, lines 29–33
32. Types of light-sensitive materials: page 66, lines 34–36
33. Light-sensitive layer film thickness and swell speed: page 66, line 40–page 67, line 1
34. Back layers: page 67, lines 3–8
35. General development processing: page 67, lines 9–11

36. Developers and developing agents: page 67, lines 12–30
37. Developer additives: page 67, lines 31–44
38. Reversal processing: page 67, lines 45–56
39. Processing solution aperture ratio: page 67, line 57–page 68, line 12
40. Development time: page 68, lines 13–15
41. Bleach-fix, bleaching, and fixing: page 68, line 16–page 69, line 31
42. Automatic processor: page 69, lines 32–40
43. Washing, rinsing, and stabilization: page 69, line 41–page 70, line 18
44. Replenishment and reuse of processing solutions: page 70, lines 19–23
45. Incorporation of developing agent into light-sensitive material: page 70, lines 24–33
46. Development temperature: page 70, lines 34–38
47. Application to film with lens: page 70, lines 39–41

It is also possible to preferably use a bleaching solution described in European Patent No. 602600, the disclosure of which is incorporated herein by reference, which contains 2-pyridinecarboxylic acid or 2,6-pyridinedicarboxylic acid, ferric salt such as ferric nitrate, and persulfate. When this bleaching solution is to be used, it is preferable to interpose a stop step and a washing step between the color development step and the bleaching step and to use organic acid such as acetic acid, succinic acid, or maleic acid as the stop bath. Furthermore, for the purposes of pH adjustment and bleaching fog, the bleaching solution preferably contains 0.1 to 2 mols/litter (litter will be referred to as "L" hereinafter) of organic acid such as acetic acid, succinic acid, maleic acid, glutaric acid, or adipic acid.

Supports which can be appropriately used in the present invention are described in, e.g., the aforementioned RD. No. 17643, page 28; RD. No. 18716, from the right column of page 647 to the left column of page 648; and RD. No. 307105, page 879. The support for use in the present invention may be furnished with a back layer. The back layer for use in the present invention in preferred form has at least one layer has at least one layer containing a hydrophilic binder and further polyacrylic acid and/or a salt thereof. With respect to the polyacrylic acid and/or salt thereof preferably used in the present invention, the weight average molecular weight thereof is preferably in the range of 5000 to 200 thousand, more preferably 50,000 to 200 thousand. Also, a latex containing polyacrylic acid can be preferably used. As a counter cation for forming the salt, there can be mentioned, for example, an alkali metal atom, an alkaline earth metal atom or an organic amine. An alkali metal atom or an organic amine is preferred. Lithium, potassium and sodium are most preferred.

As the hydrophilic binder preferably used in the present invention, there can be mentioned, for example, hydrophilic colloids. Gelatin is most preferred. Both alkali treated gelatin and acid treated gelatin can preferably be used. When ossein gelatin is used, it is preferred to remove calcium and iron contents therefrom.

Other hydrophilic colloids include water soluble polymers such as polyacrylamide, polyvinyl alcohol, polyvinylpyrrolidone and dextran sulfate. The total dry thickness of the back layer is preferably in the range of 6 to 15 μm.

The back layer preferably contains a light absorber, a filter dye, an ultraviolet absorber, an antistatic agent, a film hardener, a binder, a plasticizer, a lubricant, a coating aid and a surfactant. The swelling ratio of the back layer, when being a hydrophilic colloid layer, is preferably in the range of 100 to 500%. Moreover, in another preferred form, the support may be furnished with a magnetic recording layer.

A magnetic recording layer preferably used in the present invention will be described below. This magnetic recording layer is formed by coating the surface of a support with an aqueous or organic solvent-based coating solution which is prepared by dispersing magnetic grains in a binder.

As the magnetic grains used in the present invention, it is possible to use, e.g., ferromagnetic iron oxide such as $\gamma Fe_2O_3$, Co-depositedy $\gamma Fe_2O_3$, Co-deposited magnetite, Co-containing magnetite, ferromagnetic chromium dioxide, a ferromagnetic metal, a ferromagnetic alloy, Ba ferrite of a hexagonal system, Sr ferrite, Pb ferrite, and Ca ferrite. Co-deposited ferromagnetic iron oxide such as Co-deposited $\gamma Fe_2O_3$ is preferred. The grain can take the shape of any of, e.g., a needle, rice grain, sphere, cube, and plate. The specific area is preferably 20 $m^2/g$ or more, and more preferably, 30 $m^2/g$ or more as SBET.

The saturation magnetization ($\sigma$ s) of the ferromagnetic substance is preferably $3.0\times10^4$ to $3.0\times10^5$ A/m, and most preferably, $4.0\times10^4$ to $2.5\times10^5$ A/m. A surface treatment can be performed for the ferromagnetic grains by using silica and/or alumina or an organic material. Also, the surface of the ferromagnetic grain can be treated with a silane coupling agent or a titanium coupling agent as described in JP-A-6-161032, the disclosure of which is incorporated herein by reference. A ferromagnetic grain whose surface is coated with an inorganic or organic substance described in JP-A-4-259911 or JP-A-5-81652, the disclosures of which are incorporated herein by reference, can also be used.

As a binder used in the magnetic grains, it is possible to use a thermoplastic resin, thermosetting resin, radiation-curing resin, reactive resin, acidic, alkaline, or biodegradable polymer, natural polymer (e.g., a cellulose derivative and sugar derivative), and their mixtures. These examples are described in JP-A-4-219569, the disclosure of which is incorporated herein by reference. The Tg of the resin is preferably −40° C. to 300° C., and its weight average molecular weight is preferably 2,000 to 1,000,000. Examples are a vinyl-based copolymer, cellulose derivatives such as cellulosediacetate, cellulosetriacetate, celluloseacetatepropionate, celluloseacetatebutylate, and cellulosetripropionate, acrylic resin, and polyvinylacetal resin. Gelatin is also preferred. Cellulosedi(tri)acetate is particularly preferred. This binder can be hardened by the addition of an epoxy-, aziridine-, or isocyanate-based crosslinking agent. Examples of the isocyanate-based crosslinking agent are isocyanates such as tolylenediisocyanate, 4,4'-diphenylmethanediisocyanate, hexamethylenediisocyanate, and xylylenediisocyanate, reaction products of these isocyanates and polyalcohol (e.g., a reaction product of 3 mols of tolylenediisocyanate and 1 mol of trimethylolpropane), and polyisocyanate produced by condensation of any of these isocyanates. These examples are described in JP-A-6-59357, the disclosure of which is incorporated herein by reference.

As a method of dispersing the magnetic substance in the binder, as described in JP-A-6-35092, the disclosure of which is incorporated herein by reference, a kneader, pin type mill, and annular mill are preferably used singly or together. Dispersants described in JP-A-5-088283, the disclosure of which is incorporated herein by reference, and other known dispersants can be used. The thickness of the magnetic recording layer is 0.1 to 10 μm, preferably 0.2 to 5 μm, and more preferably, 0.3 to 3 μm.

The weight ratio of the magnetic grains to the binder is preferably 0.5:100 to 60:100, and more preferably, 1:100 to 30:100. The coating amount of the magnetic grains is 0.005 to 3 $g/m^2$, preferably 0.01 to 2 $g/m^2$, and more preferably, 0.02 to 0.5 $g/m^2$. The transmission yellow density of the magnetic recording layer is preferably 0.01 to 0.50, more preferably, 0.03 to 0.20, and most preferably, 0.04 to 0.15. The magnetic recording layer can be formed in the whole area of, or into the shape of stripes on, the back surface of a photographic support by coating or printing. As a method of coating the magnetic recording layer, it is possible to use any of an air doctor, blade, air knife, squeegee, impregnation, reverse roll, transfer roll, gravure, kiss, cast, spray, dip, bar, and extrusion. A coating solution described in JP-A-5-341436, the disclosure of which is incorporated herein by reference is preferred.

The magnetic recording layer can be given a lubricating property improving function, curling adjusting function, antistatic function, adhesion preventing function, and head polishing function. Alternatively, another functional layer can be formed and these functions can be given to that layer. A polishing agent in which at least one type of grains are aspherical inorganic grains having a Mohs hardness of 5 or more is preferred. The composition of this aspherical inorganic grain is preferably an oxide such as aluminum oxide, chromium oxide, silicon dioxide, titanium dioxide, and silicon carbide, a carbide such as silicon carbide and titanium carbide, or a fine powder of diamond. The surfaces of the grains constituting these polishing agents can be treated with a silane coupling agent or titanium coupling agent. These grains can be added to the magnetic recording layer or overcoated (as, e.g., a protective layer or lubricant layer) on the magnetic recording layer. A binder used together with the grains can be any of those described above and is preferably the same binder as in the magnetic recording layer. Light-sensitive materials having the magnetic recording layer are described in U.S. Pat. No. 5,336,589, U.S. Pat. No. 5,250,404, U.S. Pat. No. 5,229,259, U.S. Pat. No. 5,215,874, and EP 466,130, the disclosures of which are incorporated herein by reference.

A polyester support used in the present invention will be described below. Details of the polyester support and light-sensitive materials, processing, cartridges, and examples (to be described later) are described in Journal of Technical Disclosure No. 94-6023 (JIII; 1994, Mar. 15) , the disclosure of which is incorporated herein by reference. Polyester used in the present invention is formed by using diol and aromatic dicarboxylic acid as essential components. Examples of the aromatic dicarboxylic acid are 2,6-, 1,5-, 1,4-, and 2,7-naphthalenedicarboxylic acids, terephthalic acid, isophthalic acid, and phthalic acid. Examples of the diol are diethyleneglycol, triethyleneglycol, cyclohexanedimethanol, bisphenol A, and bisphenol. Examples of the polymer are homopolymers such as polyethyleneterephthalate, polyethylenenaphthalate, and polycyclohexanedimethanolterephthalate. Polyester containing 50 to 100 mol % of 2,6-naphthalenedicarboxylic acid is particularly preferred. Polyethylene-2,6-naphthalate is most preferred among other polymers. The average molecular weight ranges between about 5,000 and 200,000. The Tg of the polyester of the present invention is 50° C. or higher, preferably 90° C. or higher.

To give the polyester support a resistance to curling, the polyester support is heat-treated at a temperature of preferably 40° C. to less than Tg, and more preferably, Tg −20° C. to less than Tg. The heat treatment can be performed at a fixed temperature within this range or can be performed together with cooling. The heat treatment time is preferably 0.1 to 1500 hr, and more preferably, 0.5 to 200 hr. The heat treatment can be performed for a roll-like support or while a support is conveyed in the form of a web. The surface shape can also be improved by roughening the surface (e.g., coating the surface with conductive inorganic fine grains such as $SnO_2$ or $Sb_2O_5$). It is desirable to knurl and slightly raise the end portion, thereby preventing the cut portion of the core from being photographed. These heat treatments can be performed in any stage after support film formation, after surface treatment, after back layer coating (e.g., an antistatic agent or lubricating agent), and after undercoating. A favorable timing is after the antistatic agent is coated.

An ultraviolet absorbent can be incorporated into this polyester. Also, to prevent light piping, dyes or pigments such as Diaresin manufactured by Mitsubishi Kasei Corp. or Kayaset manufactured by NIPPON KAYAKU CO. LTD. commercially available for polyester can be incorporated.

In the present invention, it is preferable to perform a surface treatment in order to adhere the support and the light-sensitive material constituting layers. Examples of the surface treatment are surface activation treatments such as a chemical treatment, mechanical treatment, corona discharge treatment, flame treatment, ultraviolet treatment, high-frequency treatment, glow discharge treatment, active plasma treatment, laser treatment, mixed acid treatment, and ozone oxidation treatment. Among other surface treatments, the ultraviolet radiation treatment, flame treatment, corona treatment, and glow treatment are preferred.

An undercoat layer can include a single layer or two or more layers. Examples of an undercoat layer binder are copolymers formed by using, as a starting material, a monomer selected from vinyl chloride, vinylidene chloride, butadiene, methacrylic acid, acrylic acid, itaconic acid, and maleic anhydride. Other examples are polyethyleneimine, an epoxy resin, grafted gelatin, nitrocellulose, and gelatin. Resorcin and p-chlorophenol are examples of a compound which swells a support. Examples of a gelatin hardener added to the undercoat layer are chromium salt (e.g., chromium alum), aldehydes (e.g., formaldehyde and glutaraldehyde), isocyanates, an active halogen compound (e.g., 2,4-dichloro-6-hydroxy-s-triazine), an epichlorohydrin resin, and an active vinylsulfone compound. $SiO_2$, $TiO_2$, inorganic fine grains, or polymethylmethacrylate copolymer fine grains (0.01 to 10 μm) can also be contained as a matting agent.

In the present invention, an antistatic agent is preferably used. Examples of this antistatic agent are carboxylic acid, carboxylate, a macromolecule containing sulfonate, cationic macromolecule, and ionic surfactant compound.

As the antistatic agent, it is most preferable to use fine grains of at least one crystalline metal oxide selected from ZnO, $TiO_2$, $SnO_2$, $Al_2O_3$, $In_2O_3$, $SiO_2$, MgO, BaO, $MoO_3$, and $V_2O_5$, and having a volume resistivity of preferably 107 Ω·cm or less, and more preferably, $10^5$ Ω·cm or less and a grain size of 0.001 to 1.0 μm, fine grains of composite oxides (e.g., Sb, P, B, In, S, Si, and C) of these metal oxides, fine grains of sol metal oxides, or fine grains of composite oxides of these sol metal oxides.

The content in a light-sensitive material is preferably 5 to 500 mg/$m^2$, and particularly preferably, 10 to 350 mg/$m^2$. The ratio of a conductive crystalline oxide or its composite oxide to the binder is preferably 1/300 to 100/1, and more preferably, 1/100 to 100/5.

A light-sensitive material of the present invention preferably has a slip property. Slip agent-containing layers are preferably formed on the surfaces of both a light-sensitive layer and back layer. A preferable slip property is 0.01 to 0.25 as a coefficient of kinetic friction. This represents a value obtained when a stainless steel sphere 5 mm in diameter is conveyed at a speed of 60 cm/min (25° C., 60%

RH). In this evaluation, a value of nearly the same level is obtained when the surface of a light-sensitive layer is used as a sample to be measured.

Examples of a slip agent usable in the present invention are polyorganocyloxane, higher fatty acid amide, higher fatty acid metal salt, and ester of higher fatty acid and higher alcohol. As the polyorganocyloxane, it is possible to use, e.g., polydimethylcyloxane, polydiethylcyloxane, polystyrylmethylcyloxane, or polymethylphenylcyloxane. A layer to which the slip agent is added is preferably the outermost emulsion layer or back layer. Polydimethylcyloxane or ester having a long-chain alkyl group is particularly preferred.

A light-sensitive material of the present invention preferably contains a matting agent. This matting agent can be added to either the emulsion surface or back surface and is most preferably added to the outermost emulsion layer. The matting agent can be either soluble or insoluble in processing solutions, and the use of both types of matting agents is preferred. Favorable examples are polymethylmethacrylate grains, poly(methylmethacrylate/methacrylic acid=9/1 or 5/5 (molar ratio)) grains, and polystyrene grains. The grain size is preferably 0.8 to 10 μm, and a narrow grain size distribution is favored. It is preferable that 90% or more of all grains have grain sizes 0.9 to 1.1 times the average grain size. To increase the matting property, it is preferable to simultaneously add fine grains with a grain size of 0.8 μm or smaller. Examples are polymethylmethacrylate grains (0.2 μm), poly(methylmethacrylate/methacrylic acid=9/1 (molar ratio, 0.3 μm) grains, polystyrene grains (0.25 μm), and colloidal silica grains (0.03 μm).

A support used in examples of the present invention can be prepared with reference to the process as described in JP-A-2001-281815.

A film cartridge used in the present invention will be described below. The principal material of the cartridge used in the present invention can be a metal or synthetic plastic.

Preferable plastic materials are polystyrene, polyethylene, polypropylene, and polyphenylether. The cartridge of the present invention can also contain various antistatic agents. For this purpose, carbon black, metal oxide grains, nonion-, anion-, cation-, and betaine-based surfactants, or a polymer can be preferably used. These cartridges subjected to the antistatic treatment are described in JP-A-1-312537 and JP-A-1-312538, the disclosures of which are incorporated herein by reference. It is particularly preferable that the resistance be $10^{12}$ Ω or less at 25° C. and 25% RH. Commonly, plastic cartridges are manufactured by using plastic into which carbon black or a pigment is incorporated in order to give a light-shielding property. The cartridge size can be a presently available 135 size. To miniaturize cameras, it is effective to decrease the diameter of a 25 mm cartridge of 135 size to 22 mm or less. The volume of a cartridge case is 30 $cm^3$ or less, preferably 25 $cm^3$ or less. The weight of plastic used in the cartridge and the cartridge case is preferably 5 to 15 g.

Furthermore, a cartridge which feeds a film by rotating a spool can be used in the present invention. It is also possible to use a structure in which a film leader is housed in a cartridge main body and fed through a port of the cartridge to the outside by rotating a spool shaft in the film feed direction. These structures are disclosed in U.S. Pat. No. 4,834,306 and U.S. Pat. No. 5,226,613, the disclosures of which are incorporated herein by reference. Photographic films used in the present invention can be so-called raw films before being developed or developed photographic films. Also, raw and developed photographic films can be accommodated in the same new cartridge or in different cartridges.

A color photographic light-sensitive material of the present invention is also suitably used as a negative film for Advanced Photo System (to be referred to as APS hereinafter). Examples are the NEXIA A, NEXIA F, and NEXIA H (ISO 200, 100, and 400, respectively) manufactured by Fuji Photo Film Co., Ltd. (to be referred to as Fuji Film hereinafter). These films are so processed as to have an APS format and set in an exclusive cartridge. These APS cartridge films are loaded into APS cameras such as the Fuji Film EPION Series (e.g., the EPION 300Z).

A color photosensitive film of the present invention is also suited as a film with lens such as the Fuji Film FUJICOLOR UTSURUNDESU SUPER SLIM or the UTSURUNDESU ACE 800.

A photographed film is printed through the following steps in a mini-lab system.

(1) Reception (an exposed cartridge film is received from a customer)

(2) Detaching step (the film is transferred from the cartridge to an intermediate cartridge for development)

(3) Film development (4) Reattaching step (the developed negative film is returned to the original cartridge)

(5) Printing (prints of three types C, H, and P and an index print are continuously automatically printed on color paper [preferably the Fuji Film SUPER FA8])

(6) Collation and shipment (the cartridge and the index print are collated by an ID number and shipped together with the prints)

As these systems, the Fuji Film MINI-LAB CHAMPION SUPER FA-298, FA-278, FA-258, FA-238 and the Fuji Film FRONTIER digital lab system are preferred. Examples of a film processor for the MINI-LAB CHAMPION are the FP922AL, FP562B, FP562B,AL, FP362B, and FP362B,AL, and recommended processing chemicals are the FUJICOLOR JUST-IT CN-16L and CN-16Q. Examples of a printer processor are the PP3008AR, PP3008A, PP1828AR, PP1828A, PP1258AR, PP1258A, PP728AR, and PP728A, and a recommended processing chemicals are the FUJICOLOR JUST-IT CP-47L and CP-40FAII.

In the FRONTIER system, the SP-1000 scanner & image processor and the LP-1000P laser printer & paper processor or the LP-1000W laser printer are used. A detacher used in the detaching step and a reattacher used in the reattaching step are preferably the Fuji Film DT200 or DT100 and AT200 or AT100, respectively.

APS can also be enjoyed by PHOTO JOY SYSTEM whose main component is the Fuji Film Aladdin 1000 digital image workstation. For example, a developed APS cartridge film is directly loaded into the Aladdin 1000, or image information of a negative film, positive film, or print is input to the Aladdin 1000 by using the FE-550 35 mm film scanner or the PE-550 flat head scanner. Obtained digital image data can be easily processed and edited. This data can be printed out by the NC-550AL digital color printer using a photofixing heat-sensitive color printing system or the PICTOROGRAPHY 3000 using a laser exposure thermal development transfer system, or by existing laboratory equipment through a film recorder. The Aladdin 1000 can also output digital information directly to a floppy disk or Zip disk or to an CD-R via a CD writer.

In a home, a user can enjoy photographs on a TV set simply by loading a developed APS cartridge film into the Fuji Film PHOTO PLAYER AP-1. Image information can also be continuously input to a personal computer by loading a developed APS cartridge film into the Fuji Film PHOTO SCANNER AS-1. The Fuji Film PHOTO VISION FV-10 or FV-5 can be used to input a film, print, or three-dimensional object. Furthermore, image information recorded in a floppy disk, Zip disk, CR-R, or hard disk can be variously processed on a computer by using the Fuji Film PHOTO FACTORY application software. The Fuji Film NC-2 or NC-2D digital color printer using a photo-fixing heat-sensitive color printing system is suited to outputting high-quality prints from a personal computer.

To keep developed APS cartridge films, the FUJICOLOR POCKET ALBUM AP-5 POP L, AP-1 POP L, or AP-1 POP KG, or the CARTRIDGE FILE 16 is preferred.

Examples of the present invention will be described below. However, the present invention is not limited to these examples.

EXAMPLE 1

The silver halide emulsions Em-A to Em-O listed in Table 1 were prepared with reference to the process for preparing emulsions Em-A to Em-O as described in Example 1 of JP-A-2001-281815.

TABLE 1

| Emulsion name | Average silver iodide content (mol %) | Average equivalent-sphere diameter (μm) | Shape |
|---|---|---|---|
| Em-A | 4 | 0.75 | Tabular |
| Em-B | 5 | 0.54 | Tabular |
| Em-C | 4.7 | 0.40 | Tabular |
| Em-D | 1 | 0.37 | Tabular |
| Em-E | 5 | 0.70 | Tabular |
| Em-F | 5.5 | 0.50 | Tabular |
| Em-G | 4.7 | 0.40 | Tabular |
| Em-H | 2.5 | 0.37 | Tabular |
| Em-I | 1.5 | 0.27 | Tabular |
| Em-J | 5 | 0.87 | Tabular |
| Em-K | 3.7 | 0.44 | Tabular |
| Em-L | 5.5 | 0.87 | Tabular |
| Em-M | 8.8 | 0.64 | Tabular |
| Em-N | 3.7 | 0.37 | Tabular |
| Em-O | 1.8 | 0.19 | Cubic |

In the tabular grains of Table 1, dislocation lines as described in JP-A-3-237450 are observed through a high-voltage electron microscope.

1) Superimposition of Light-Sensitive Layers (Preparation of Sample 001)

Multilayer coating of a cellulose triacetate support was effected with the following compositions, thereby obtaining a color negative film (sample 001).

(Compositions of Light-Sensitive Layers)

The main materials used in the individual layers are classified as follows.

ExC: Cyan coupler UV: Ultraviolet absorbent

ExM: Magenta coupler HBS: High-boiling organic solvent

ExY: Yellow coupler H: Gelatin hardener (In the following description, practical compounds have numbers attached to their symbols. Formulas of these compounds will be presented later.)

The number corresponding to each component indicates the coating amount in units of g/m$^2$. The coating amount of a silver halide is indicated by the amount of silver.

| | | |
|---|---|---|
| 1st layer (1st antihalation layer) | | |
| Black colloidal silver | silver | 0.109 |
| Gelatin | | 0.677 |
| HBS-1 | | 0.004 |
| HBS-2 | | 0.002 |
| 2nd layer (2nd antihalation layer) | | |
| Black colloidal silver | silver | 0.043 |
| Gelatin | | 0.313 |
| ExF-8 | | 0.010 |
| HBS-1 | | 0.054 |
| 3rd layer (Interlayer) | | |
| Cpd-1 | | 0.082 |
| HBS-1 | | 0.050 |
| Gelatin | | 0.424 |
| 4th layer (Low-speed red-sensitive emulsion layer) | | |
| Em-D | silver | 0.192 |
| Em-C | silver | 0.384 |
| ExC-1 | | 0.211 |
| ExC-2 | | 0.021 |
| ExC-3 | | 0.127 |
| ExC-4 | | 0.111 |
| ExC-5 | | 0.032 |
| ExC-6 | | 0.024 |
| Cpd-2 | | 0.025 |
| Cpd-4 | | 0.008 |
| ExC-8 | | 0.010 |
| HBS-1 | | 0.210 |
| HBS-5 | | 0.038 |
| Gelatin | | 2.312 |
| 5th layer (Medium-speed red-sensitive emulsion layer) | | |
| Em-B | silver | 0.923 |
| Em-C | silver | 0.077 |
| ExC-1 | | 0.051 |
| ExC-2 | | 0.034 |
| ExC-3 | | 0.034 |
| ExC-4 | | 0.050 |
| ExC-5 | | 0.013 |
| ExC-6 | | 0.020 |
| Cpd-2 | | 0.036 |
| Cpd-4 | | 0.008 |
| Cpd-6 | | 0.060 |
| ExC-7 | | 0.010 |
| HBS-1 | | 0.097 |
| Gelatin | | 1.525 |
| 6th layer (High-speed red-sensitive emulsion layer) | | |
| Em-A | silver | 0.566 |
| Em-B | silver | 0.391 |
| ExC-1 | | 0.122 |
| ExC-3 | | 0.009 |
| ExC-6 | | 0.040 |
| Cpd-2 | | 0.064 |
| Cpd-4 | | 0.009 |
| Cpd-6 | | 0.025 |
| ExC-7 | | 0.039 |
| HBS-1 | | 0.223 |
| Gelatin | | 1.407 |
| 7th layer (Interlayer) | | |
| Cpd-1 | | 0.053 |
| Cpd-7 | | 0.369 |
| HBS-1 | | 0.049 |
| Polyethylacrylate latex | | 0.088 |
| Gelatin | | 0.784 |
| 8th layer (layer for donating interlayer effect to red-sensitive layer) | | |
| Em-J | silver | 0.450 |
| Em-K | silver | 0.281 |
| Cpd-4 | | 0.030 |
| ExM-2 | | 0.052 |
| ExM-3 | | 0.004 |
| ExM-4 | | 0.040 |
| ExY-1 | | 0.011 |

-continued

| | | |
|---|---|---|
| ExY-6 | | 0.045 |
| ExC-9 | | 0.005 |
| ExC-10 | | 0.110 |
| HBS-1 | | 0.190 |
| HBS-3 | | 0.008 |
| HBS-5 | | 0.020 |
| Gelatin | | 1.203 |
| 9th layer (Low-speed green-sensitive emulsion layer) | | |
| Em-G | silver | 0.403 |
| Em-H | silver | 0.288 |
| Em-I | silver | 0.128 |
| ExM-2 | | 0.205 |
| ExM-3 | | 0.063 |
| ExM-4 | | 0.090 |
| ExY-1 | | 0.004 |
| ExC-9 | | 0.004 |
| ExC-10 | | 0.004 |
| HBS-1 | | 0.120 |
| HBS-3 | | 0.015 |
| HBS-4 | | 0.140 |
| HBS-5 | | 0.250 |
| Gelatin | | 1.805 |
| 10th layer (Medium-speed green-sensitive emulsion layer) | | |
| Em-F | silver | 0.286 |
| Em-G | silver | 0.347 |
| ExM-2 | | 0.105 |
| ExM-3 | | 0.010 |
| ExM-4 | | 0.089 |
| ExY-1 | | 0.002 |
| ExY-5 | | 0.006 |
| ExC-6 | | 0.005 |
| ExC-7 | | 0.010 |
| ExC-9 | | 0.005 |
| ExC-10 | | 0.006 |
| HBS-1 | | 0.100 |
| HBS-3 | | 0.003 |
| HBS-5 | | 0.020 |
| Gelatin | | 0.852 |
| 11th layer (High-speed green-sensitive emulsion layer) | | |
| Em-E | silver | 0.537 |
| ExC-6 | | 0.009 |
| ExC-7 | | 0.010 |
| ExM-1 | | 0.035 |
| ExM-2 | | 0.006 |
| ExM-3 | | 0.005 |
| ExM-4 | | 0.007 |
| ExC-9 | | 0.002 |
| ExC-10 | | 0.004 |
| ExY-5 | | 0.006 |
| Cpd-3 | | 0.003 |
| Cpd-4 | | 0.004 |
| HBS-1 | | 0.060 |
| HBS-5 | | 0.037 |
| Polyethylacrylate latex | | 0.090 |
| Gelatin | | 0.937 |
| 12th layer (Yellow filter layer) | | |
| Yellow colloidal silver | Silver | 0.042 |
| Cpd-1 | | 0.080 |
| Solid disperse dye ExF-2 | | 0.050 |
| Solid disperse dye ExF-5 | | 0.010 |
| Oil-soluble dye ExF-7 | | 0.010 |
| HBS-1 | | 0.055 |
| Gelatin | | 0.808 |
| 13th layer (Low-speed blue-sensitive emulsion layer) | | |
| Em-O | silver | 0.100 |
| Em-M | silver | 0.287 |
| Em-N | silver | 0.236 |
| ExC-1 | | 0.017 |
| ExY-1 | | 0.004 |
| ExY-2 | | 0.270 |
| ExY-6 | | 0.027 |
| ExY-7 | | 0.388 |
| ExC-9 | | 0.004 |

-continued

| | | |
|---|---|---|
| ExC-10 | | 0.011 |
| Cpd-2 | | 0.050 |
| Cpd-3 | | 0.004 |
| HBS-1 | | 0.258 |
| HBS-5 | | 0.074 |
| Gelatin | | 1.917 |
| 14th layer (High-speed blue-sensitive emulsion layer) | | |
| Em-L | silver | 0.546 |
| ExY-1 | | 0.010 |
| ExY-2 | | 0.255 |
| ExY-6 | | 0.062 |
| ExY-7 | | 0.150 |
| ExC-10 | | 0.030 |
| Cpd-2 | | 0.075 |
| Cpd-3 | | 0.001 |
| HBS-1 | | 0.071 |
| Gelatin | | 1.078 |
| 15th layer (1st protective layer) | | |
| silver iodobromide emulsion grain (Average equivalent-sphere diameter 0.07 μm, Silver iodide content 1 mol %) | silver | 0.250 |
| UV-1 | | 0.100 |
| UV-2 | | 0.120 |
| UV-3 | | 0.170 |
| UV-4 | | 0.017 |
| UV-5 | | 0.100 |
| ExF-8 | | 0.003 |
| ExF-9 | | 0.004 |
| ExF-10 | | 0.005 |
| ExF-11 | | 0.016 |
| F-11 | | 0.002 |
| S-1 | | 0.068 |
| HBS-1 | | 0.030 |
| HBS-4 | | 0.139 |
| Gelatin | | 1.500 |
| 16th layer (2nd protective layer) | | |
| H-1 | | 0.400 |
| B-1 (diameter 1.7 μm) | | 0.007 |
| B-2 (diameter 1.7 μm) | | 0.160 |
| B-3 | | 0.029 |
| Gelatin | | 0.442 |

In addition to the above components, to improve the storage stability, processability, resistance to pressure, antiseptic and mildewproofing properties, antistatic properties, and coating properties, the individual layers contained W-1 to W-9, B-4 to B-6, F-1 to F-17, lead salt, platinum salt, iridium salt, and rhodium salt.

Preparation of Dispersions of Organic Solid Disperse Dyes

ExF-2 in the 12th layer was dispersed by the following method.

| | |
|---|---|
| Wet cake (containing 17.6 mass % of water) of ExF-2 | 2.800 kg |
| Sodium octylphenyldiethoxymethane sulfonate (31 mass % aqueous solution) | 0.376 kg |
| F-15 (7% aqueous solution) | 0.011 kg |
| Water | 4.020 kg |
| Total | 7.210 kg |

pH was adjusted to 7.2 by NaOH)

A slurry having the above composition was coarsely dispersed by stirring by using a dissolver. The resultant material was dispersed at a peripheral speed of 10 m/s, a discharge amount of 0.6 kg/min, and a packing ratio of 0.3-mm diameter zirconia beads of 80% by using an agitator mill until the absorbance ratio of the dispersion was 0.29, thereby obtaining a solid fine-grain dispersion. The average grain size of the fine dye grains was 0.29 μm.

ExF-5 was dispersed by a microprecipitation dispersion method described in Example 1 of EP 549,489A, the disclosure of which is incorporated herein by reference. The average grain size was found to be 0.06 μm.

Compounds used in the formation of each layer were as follows.

ExC-1

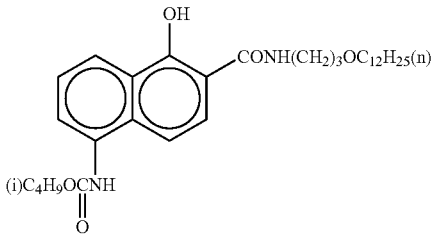

ExC-2

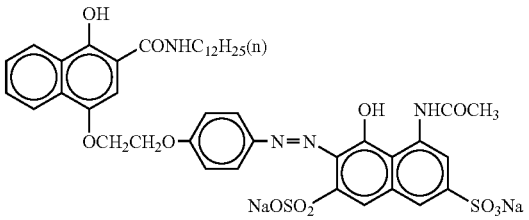

ExC-3

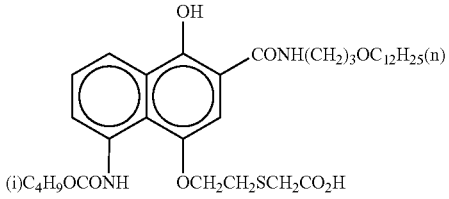

ExC-4

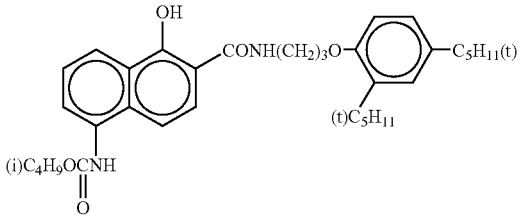

ExC-5

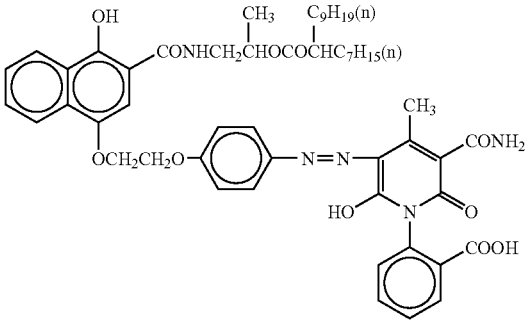

ExC-6

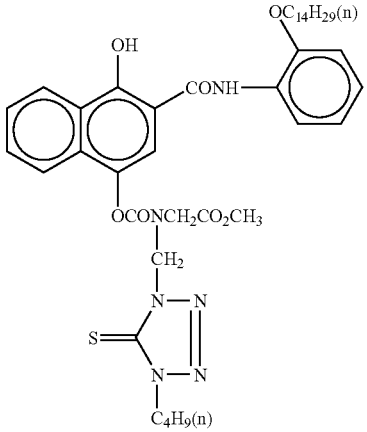

ExC-7

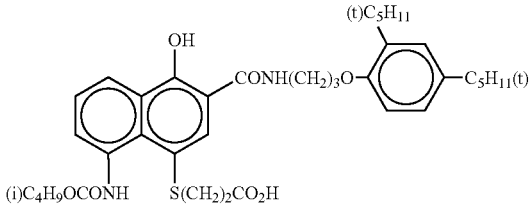

ExC-8

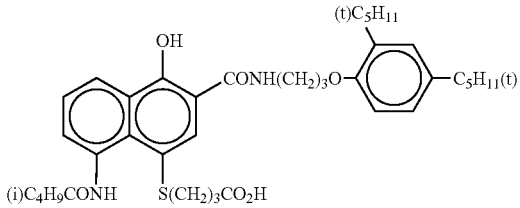

-continued
ExC-9
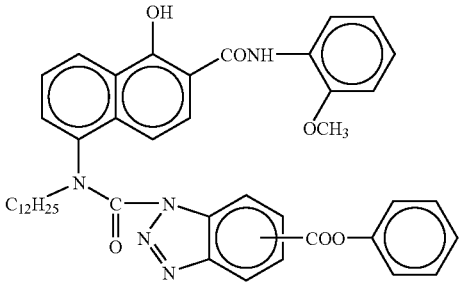
ExM-1
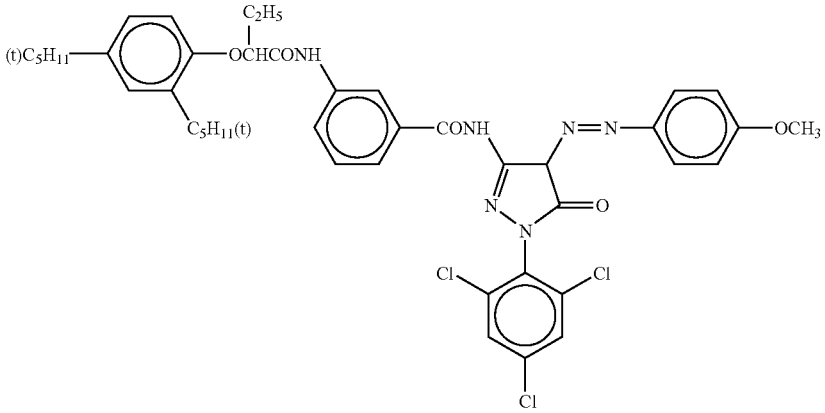
ExM-2
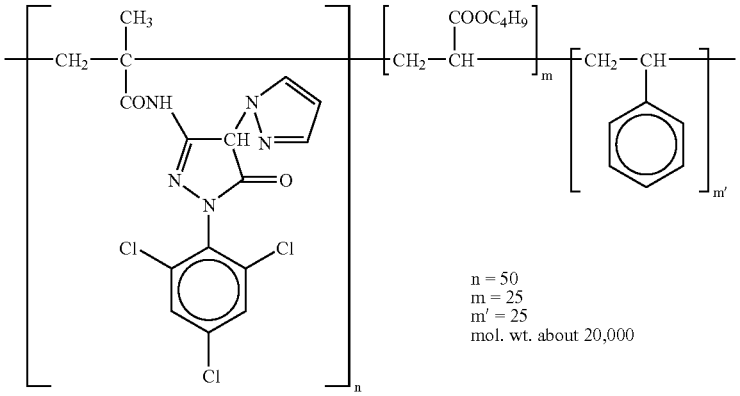
ExM-3
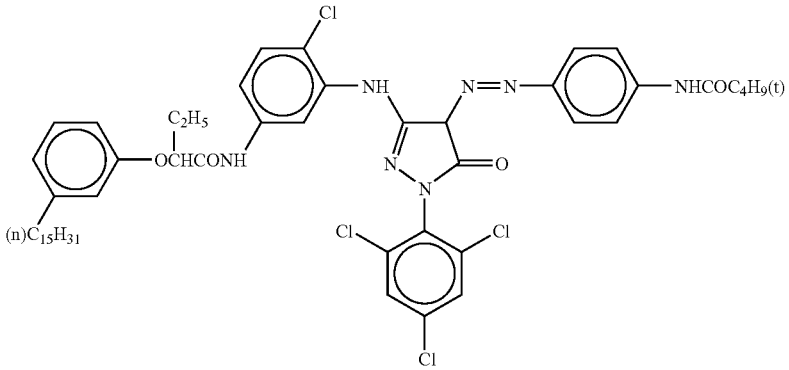

-continued
ExM-4
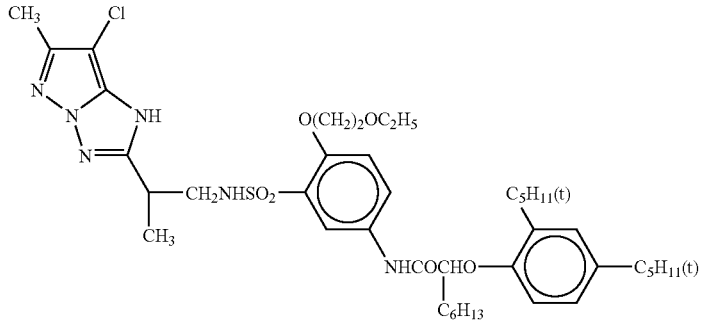
ExC-10
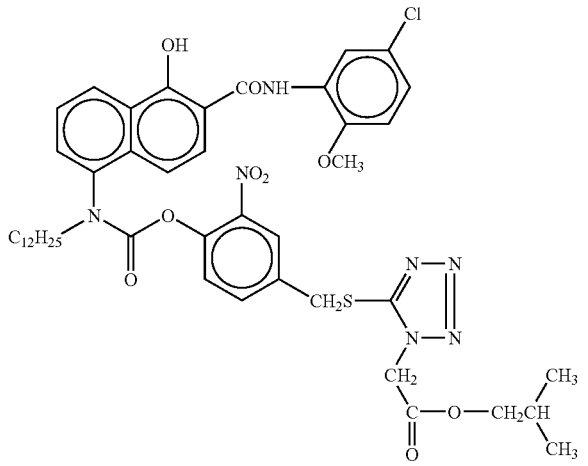
ExY-1
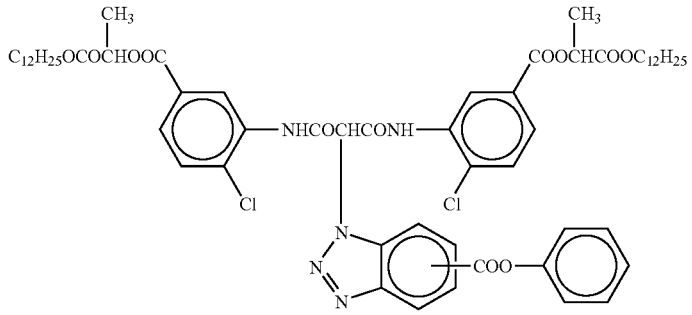
ExY-2
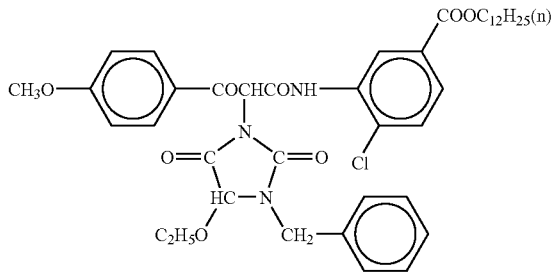

-continued
ExY-5
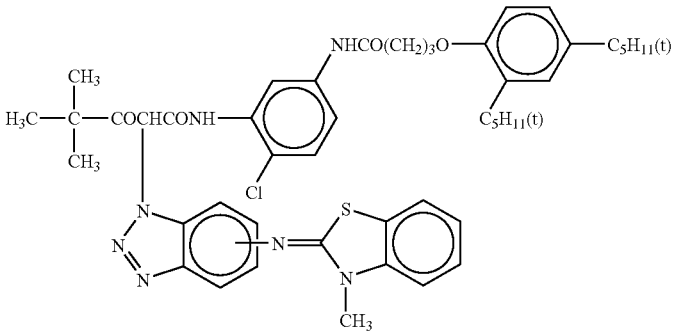
ExY-6
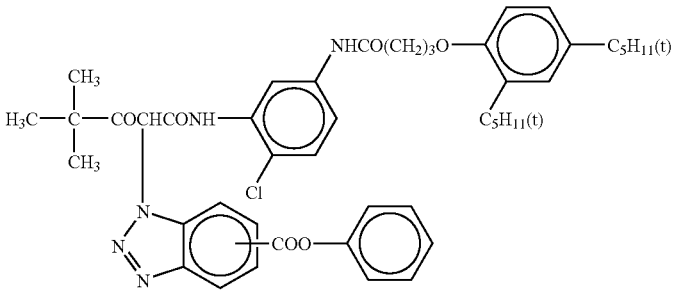
ExY-7
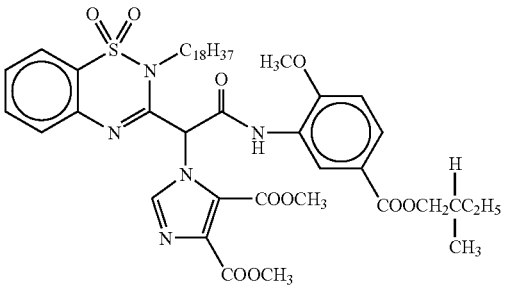
Cpd-1
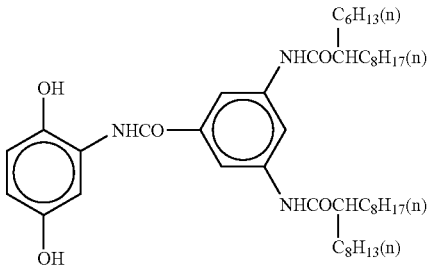
Cpd-2
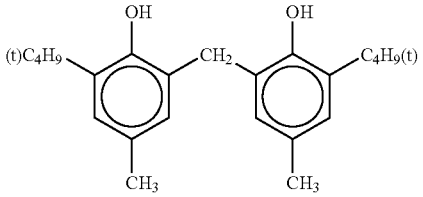
Cpd-3
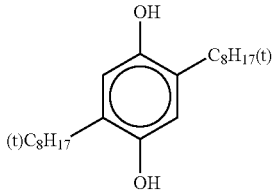
Cpd-4
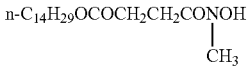
Cpd-5
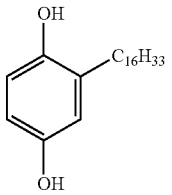
Cpd-6
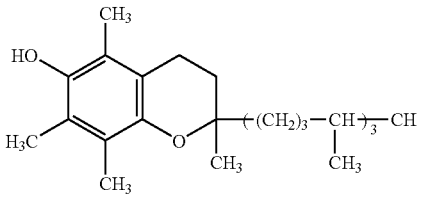
UV-1
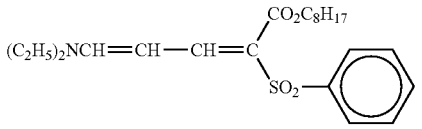

-continued
UV-2
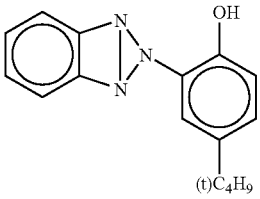
UV-3
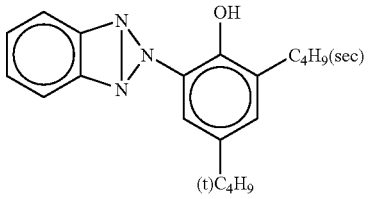
UV-4
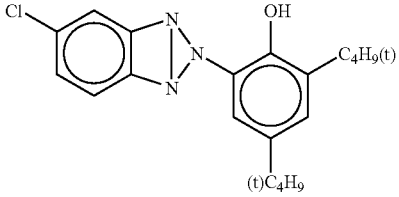
UV-5
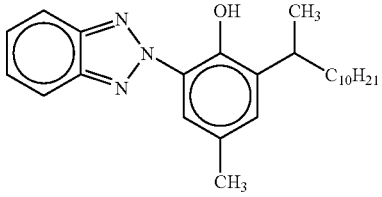
B-1
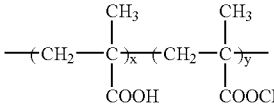
x/y = 10/90 (mass ratio)
Weight-average molecular weight: about 35,000
B-2
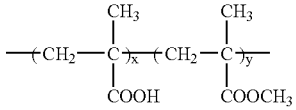
x/y = 40/60 (mass ratio)
Weight-average molecular weight: about 20,000
B-3
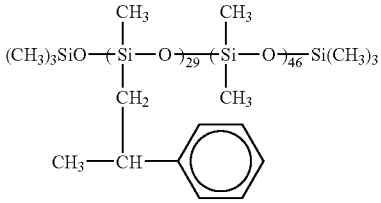
(mole ratio)
Weight-average molecular weight: about 8,000
H-1
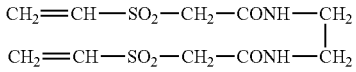
S-1
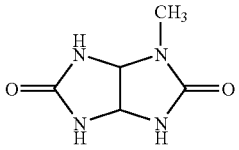
Di-n-butyl phthalate
HBS-1
Tricresyl phosphate
HBS-2
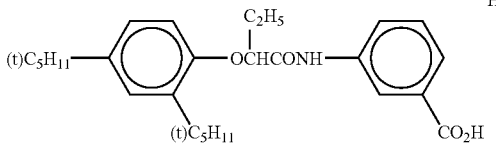
HBS-3
Tri (2-ethylhexyl) phosphate
HBS-4
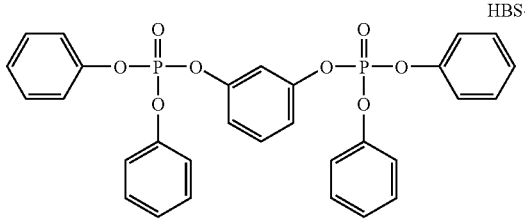
HBS-5

-continued
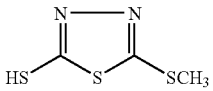
F-1
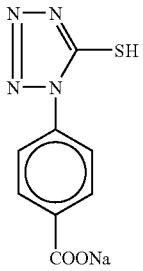
F-2
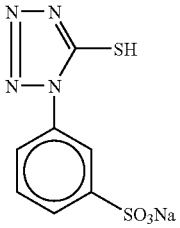
F-3
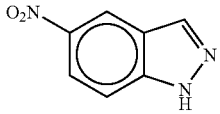
F-4
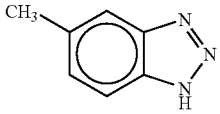
F-5
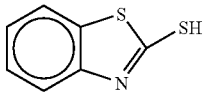
F-6
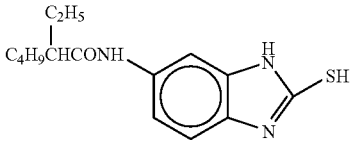
F-7
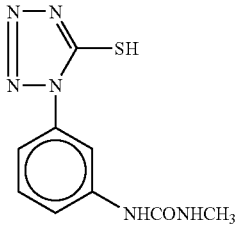
F-8
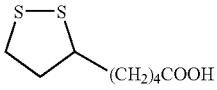
F-9
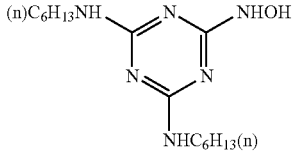
F-10
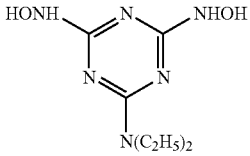
F-11
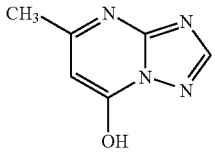
F-12
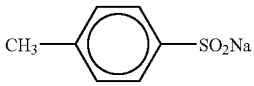
F-13
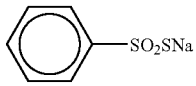
F-14
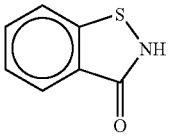
F-15
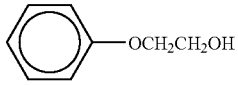
F-16
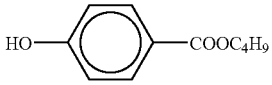
F-17
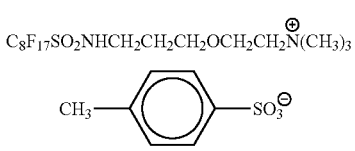
W-1

-continued
W-2
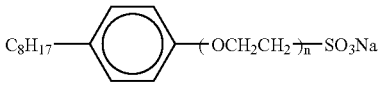
n = 2~4
W-3
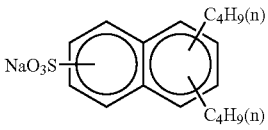
W-4
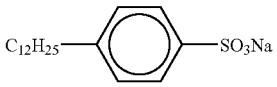
W-5
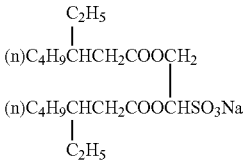
W-6
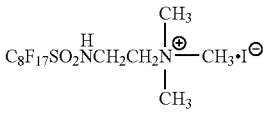
W-7
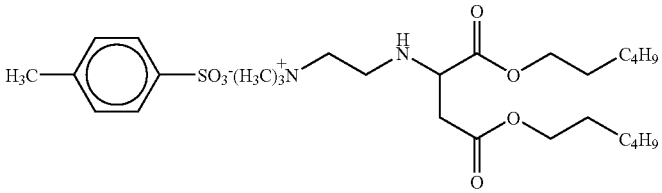
W-8
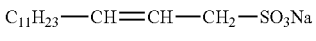
W-9
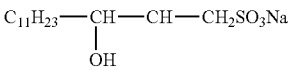
B-4
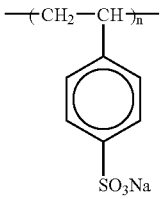
Weight-average molecular weight: about 750,000
B-5
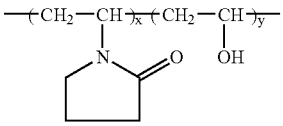
x/y = 70/30 (mass ratio)
Weight-average molecular weight: about 17,000
B-6
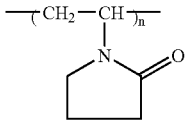
Weight-average molecular weight: about 10,000
Cpd-7
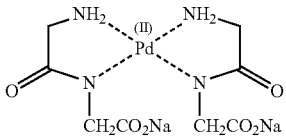
ExF-2
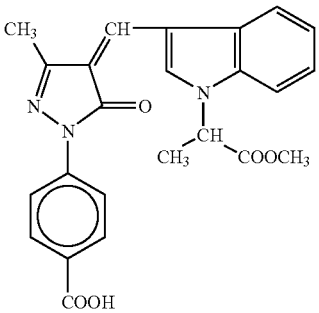

-continued

ExF.-5

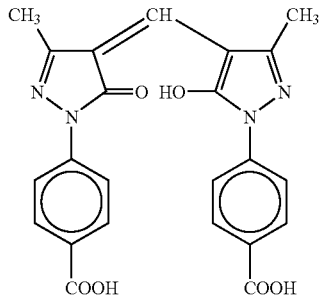

ExF-7

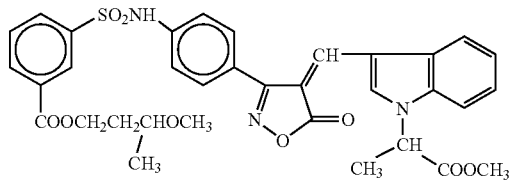

ExF-8

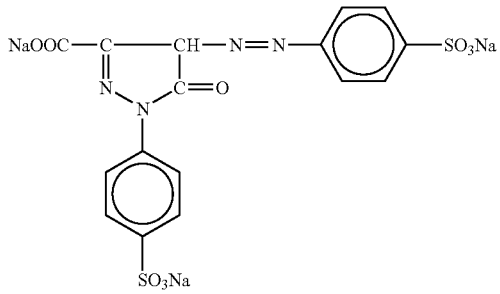

ExF-9

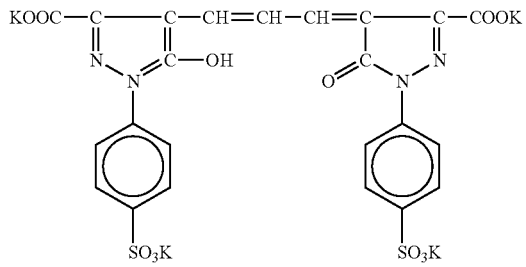

ExF-10

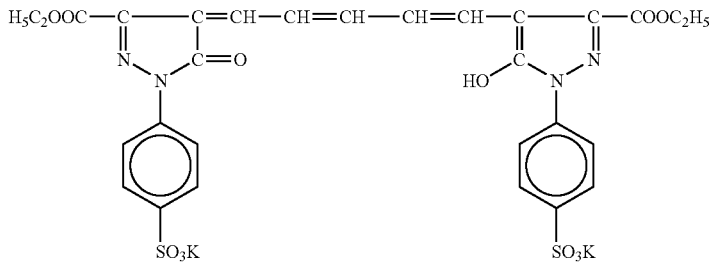

ExF-11

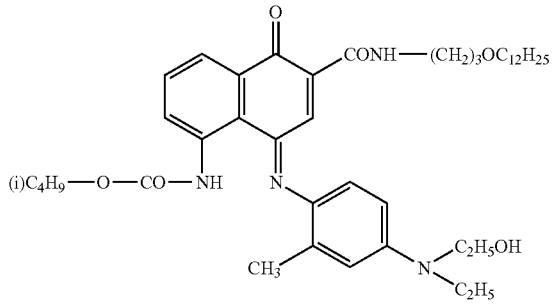

The thus prepared color negative lightsensitive material is referred to as sample 001.

The sample 101 was sequentially subjected to exposure, development described below and determination of ISO speed. The ISO speed was 365. The difference ($\lambda_G-\lambda_{-R}$) between center-of-gravity wavelength ($\lambda_{-R}$) of spectral sensitivity of interlayer effect exerted upon red-sensitive layers and center-of-gravity wavelength ($\lambda_G$) of spectral sensitivity of green-sensitive layers was 13 nm.

(Preparation of Sample 102)

Sample 102 was prepared by regulating the addition amount of dyes ExF-8, 9 and 10 of the 15th layer of the sample 101.

(Preparation of Sample 103)

Sample 103 was prepared by changing the grain size of silver halide emulsions of the 4th, 5th, 6th, 8th, 9th, 10th, 11th, 13th and 14th layers of the sample 102 to 0.7 to 0.8-fold size and further changing the amount of gelatin used in these layers to 0.75-fold amount.

(Preparation of Sample 104)

Sample 104 was prepared by adding compound (A) to the 5th, 6th, 8th, 9th, 10th, 11th, 13th and 14th layers of the sample 103 as specified in Table 2 (addition amount: 10 mmol added per mol of coating silver amount) and further regulating the amounts of couplers ExC-1 and -3 of the 5th and 6th layers, ExM-2 and -4 of the 9th, 10th and 11th layers and ExY-2 and -7 of the 13th and 14th layers.

(Preparation of Sample 105)

Sample 105 was prepared by changing the emulsions Em-A to Em-O of the sample 104 to emulsions Em-A' to Em-O' specified in Table 2 (equal silver amount) and further regulating the content of grains of 0.15 μm or less thickness in the 5th and 10th layers to 60% and regulating the content of grains of 0.15 μm or less thickness in the 6th and 11th layers to 65%.

TABLE 2

| Emulsion name | Average silver iodide content (mol %) | Average equivalent-sphere diameter (μm) | Average grain thickness (μm) | Shape |
|---|---|---|---|---|
| Em-A' | 4 | 0.60 | 0.12 | Tabular |
| Em-B' | 4 | 0.44 | 0.13 | Tabular |
| Em-C' | 4.7 | 0.40 | 0.13 | Tabular |
| Em-D' | 1.7 | 0.36 | 0.15 | Tabular |
| Em-E' | 4 | 0.60 | 0.12 | Tabular |
| Em-F' | 5 | 0.44 | 0.13 | Tabular |
| Em-G' | 4.5 | 0.40 | 0.13 | Tabular |
| Em-H' | 2.5 | 0.36 | 0.15 | Tabular |
| Em-I' | 1 | 0.27 | 0.23 | Tabular |
| Em-J' | 4.5 | 0.67 | 0.12 | Tabular |
| Em-K' | 3.9 | 0.44 | 0.13 | Tabular |
| Em-L' | 5.6 | 0.80 | 0.18 | Tabular |
| Em-M' | 7.0 | 0.60 | 0.16 | Tabular |
| Em-N' | 3.2 | 0.35 | 0.12 | Tabular |
| Em-O' | 1.5 | 0.19 | — | Cubic |

(Preparation of Samples 106 to 110)

Samples 106 to 110 were prepared by adding compound (A) to the 5th, 6th, 8th, 9th, 10th, 11th, 13th and 14th layers of the sample 105 as specified in Table 2 (addition amount (total amount of compound (A)): 10 mmol added per mol of coating silver amount) and further regulating the amounts of couplers ExC-1 and -3 of the 5th and 6th layers, ExM-2 and -4 of the 9th, 10th and 11th layers and ExY-2 and -7 of the 13th and 14th layers.

(Preparation of Sample 111)

Sample 111 was prepared by regulating the addition amount of dyes ExF-8, 9 and 10 of the 15th layer of the sample 110.

(Preparation of Sample 112)

Sample 112 was prepared by reducing the coating silver amount of individual emulsion layers of the sample 110 to 70% thereof, further increasing the addition amount of compound (A) to the 5th, 6th, 8th, 9th, 10th, 11th, 13th and 14th layers to 1.5-fold amount and still further regulating the amounts of couplers ExC-1 and -3 of the 5th and 6th layers, ExM-2 and -4 of the 9th, 10th and 11th layers and ExY-2 and -7 of the 13th and 14th layers.

(Preparation of Sample 113)

Sample 113 was prepared by regulating the addition amount of dyes ExF-8, 9 and 10 of the 15th layer of the sample 110 and by further regulating the grain sizes of silver halide emulsions of the 5th and 6th layers, silver halide emulsion of the 10th layer and silver halide emulsion of the 11th layer so as to adjust characteristic curves.

The thus prepared color negative photosensitive materials are referred as samples 102 to 113. The samples 102 to 113 were sequentially subjected to exposure, development described below and determination of ISO speed. Thus, results listed in Table 3 were obtained.

TABLE 3

| Sample | ISO speed | Total dry film thickness (μm) | Compound (A) added to 5th, 6th, 8th, 9th, 10th, 11th, 13th or 14th layer | Content of tabular grain of 0.15 μm or less thickness in high-speed layers (%) | | | |
|---|---|---|---|---|---|---|---|
| | | | | 5th layer | 6th layer | 10th layer | 11th layer |
| 101 | 365 | 26.0 | — | 20 | 30 | 20 | 30 |
| 102 | 221 | 25.8 | — | 20 | 30 | 20 | 30 |
| 103 | 180 | 23.7 | — | 20 | 30 | 20 | 30 |
| 104 | 182 | 23.5 | (b-104) | 20 | 30 | 20 | 30 |
| 105 | 230 | 23.3 | (b-104) | 60 | 65 | 60 | 65 |
| 106 | 210 | 23.5 | (c-3) | 60 | 65 | 60 | 65 |
| 107 | 231 | 23.7 | (b-104) + (a-1) | 60 | 65 | 60 | 65 |
| 108 | 237 | 23.4 | (b-104) + (a-1) + (a-18) | 60 | 65 | 60 | 65 |
| 109 | 235 | 23.6 | (b-104) + (a-1) + (a-20) | 60 | 65 | 60 | 65 |
| 110 | 243 | 23.7 | (b-104) + (a-1) + (a-21) | 60 | 65 | 60 | 65 |
| 111 | 355 | 23.8 | (b-104) + (a-1) + (a-21) | 60 | 65 | 60 | 65 |
| 112 | 205 | 21.5 | (b-104) + (a-1) + (a-21) | 60 | 65 | 60 | 65 |
| 113 | 159 | 23.4 | (b-104) + (a-1) + (a-21) | 60 | 65 | 60 | 65 |

The development was done as follows by using an automatic processor FP-360B manufactured by Fuji Photo Film Co., Ltd. Note that the processor was remodeled so that the overflow solution of the bleaching bath was not carried over to the following bath, but all of it was discharged to a waste fluid tank. The FP-360B processor was loaded with evaporation compensation means described in Journal of Technical Disclosure No. 94-4992.

The processing steps and the processing solution compositions are presented below.

(Processing steps)

| Step | Time | Temperature | Replenishment rate* | Tank volume |
|---|---|---|---|---|
| Color development | 3 min 5 sec | 37.8° C. | 20 mL | 11.5 L |
| Bleaching | 50 sec | 38.0° C. | 5 mL | 5 L |
| Fixing (1) | 50 sec | 38.0° C. | — | 5 L |
| Fixing (2) | 50 sec | 38.0° C. | 8 mL | 5 L |
| Washing | 30 sec | 38.0° C. | 17 mL | 3 L |
| Stabilization (1) | 20 sec | 38.0° C. | — | 3 L |
| Stabilization (2) | 20 sec | 38.0° C. | 15 mL | 3 L |
| Drying | 1 min 30 sec | 60° C. | | |

*The replenishment rate was per 1.1 m of a 35-mm wide sensitized material (equivalent to one 24 Ex. 1)

The stabilizer and the fixing solution were counterflowed in the order of (2)→(1), and all of the overflow of the washing water was introduced to the fixing bath (2). Note that the amounts of the developer carried over to the bleaching step, the bleaching solution carried over to the fixing step, and the fixer carried over to the washing step were 2.5 mL, 2.0 mL and 2.0 mL per 1.1 m of a 35 mm wide sensitized material, respectively. Note also that each crossover time was 6 sec, and this time was included in the processing time of each preceding step.

The opening area of the above processor for the color developer and the bleaching solution were 100 $cm^2$ and 120 $cm^2$, respectively, and the opening areas for other solutions were about 100 $cm^2$.

The compositions of the processing solutions are presented below.

| (Color developer) | [Tank solution] (g) | [Replenisher] (g) |
|---|---|---|
| Diethylenetriamine pentaacetic acid | 3.0 | 3.0 |
| Disodium catecohl-3,5-disulfonate | 0.3 | 0.3 |
| Sodium sulfite | 3.9 | 5.3 |
| Potassium carbonate | 39.0 | 39.0 |
| Disodium-N,N-bis (2-sulfonatoethyl) hydroxylamine | 1.5 | 2.0 |
| Potassium bromide | 1.3 | 0.3 |
| Potassium iodide | 1.3 mg | — |
| 4-hydroxy-6-methyl-1,3,3a,7 tetrazaindene | 0.05 | — |
| Hydroxylamine sulfate | 2.4 | 3.3 |
| 2-methyl-4-[N-ethyl-N-(β-hydroxyethyl) amino] aniline sulfate | 4.5 | 6.5 |
| Water to make | 1.0 L | 1.0 L |

-continued

| (Color developer) | [Tank solution] (g) | [Replenisher] (g) |
|---|---|---|
| pH (adjusted by potassium hydroxide and surfuric acid) | 10.05 | 10.18 |

| (Bleaching solution) | [Tank solution] (g) | [Replenisher] (g) |
|---|---|---|
| Ferric ammonium 1,3-diaminopropanetetra acetate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water to make | 1.0 L | 1.0 L |
| pH (adjusted by ammonia water) | 4.6 | 4.0 |

(Fixer (1) Tank Solution)

A 5:95 mixture (v/v) of the above bleaching tank solution and the below fixing tank solution pH 6.8

| (Fixer (2)) | [Tank solution] (g) | [Replenisher] (g) |
|---|---|---|
| Ammonium thiosulfate (750 g/L) | 240 mL | 720 mL |
| Imidazole | 7 | 21 |
| Ammonium Methanthiosulfonate | 5 | 15 |
| Ammonium Methanesulfinate | 10 | 30 |
| Ethylenediamine tetraacetic acid | 13 | 39 |
| Water to make | 1.0 L | 1.0 L |
| pH (adjusted by ammonia water and acetic acid) | 7.4 | 7.45 |

(Washing Water)

Tap water was supplied to a mixed-bed column filled with an H type strongly acidic cation exchange resin (Amberlite IR-120B: available from Rohm & Haas Co.) and an OH type basic anion exchange resin (Amberlite IR-400) to set the concentrations of calcium and magnesium to be 3 mg/L or less. Subsequently, 20 mg/L of sodium isocyanuric acid dichloride and 150 mg/L of sodium sulfate were added. The pH of the solution ranged from 6.5 to 7.5.

| (Stabilizer) | common to tank solution and replenisher (g) |
|---|---|
| Sodium p-toluenesulfinate | 0.03 |
| Polyoxyethylene-p-monononyl phenylether (average polymerization degree 10) | 0.2 |
| 1,2-benzisothiazoline-3-on sodium | 0.10 |
| Disodium ethylenediamine tetraacetate | 0.05 |
| 1,2,4-triazole | 1.3 |

-continued

| (Stabilizer) | common to tank solution and replenisher (g) |
|---|---|
| 1,4-bis(1,2,4-triazole-1-ylmethyl) piperazine | 0.75 |
| Water to make | 1.0 L |
| pH | 8.5 |

Each of the samples 101 to 113 was wrought into 135-format and charged in a single-lens reflex camera. Portrait actual assessment photographing of a human object as main subject was performed with the camera in a portrait studio and daytime outdoors. With respect to all the samples, correct exposure photographing was effected by adjusting the camera diaphragm to compensate for any difference in ISO speed.

The samples after photographing were sequentially subjected to color negative development described above and printing in quarter size, and evaluated. The evaluation was performed on graininess (5 marks perfect), image bright acuity (5 marks perfect) and portraiture depending on the degree of background blurriness (3 marks perfect). The results are listed in Table 4.

TABLE 4

| Sample | ISO speed | Graininess | Image bright acuity | Portraiture depending on the degree of background blurriness | Overall evaluation | Remarks |
|---|---|---|---|---|---|---|
| 101 | 365 | 2.5 | 2.0 | 1.0 | 5.5 | Comp. |
| 102 | 221 | 2.5 | 2.5 | 2.5 | 7.5 | Comp. |
| 103 | 180 | 3.5 | 3.0 | 2.5 | 9.0 | Comp. |
| 104 | 182 | 4.0 | 3.0 | 2.5 | 9.5 | Comp. |
| 105 | 230 | 4.0 | 4.0 | 2.5 | 10.5 | Inv. |
| 106 | 210 | 4.0 | 4.0 | 2.5 | 10.5 | Inv. |
| 107 | 231 | 4.0 | 4.0 | 2.5 | 10.5 | Inv. |
| 108 | 237 | 4.5 | 4.0 | 2.5 | 11.0 | Inv. |
| 109 | 235 | 4.5 | 4.0 | 2.5 | 11.0 | Inv. |
| 110 | 243 | 4.5 | 4.0 | 2.5 | 11.0 | Inv. |
| 111 | 355 | 3.0 | 3.5 | 1.0 | 7.5 | Comp. |
| 112 | 205 | 4.5 | 4.5 | 2.5 | 11.5 | Inv. |
| 113 | 159 | 5.0 | 4.5 | 3.0 | 12.5 | Inv. |

As apparent from Table 4, prints excelling in not only graininess and image bright acuity but also portraiture can be obtained by the use of the samples of the present invention.

EXAMPLE 2

Samples 201, 202, 205, 210 and 212 were prepared by respectively changing the supports of the samples 101, 102, 105, 110 and 112 to a triacetylcellulose film support furnished with a 7 μm thick back layer consisting of a hydrophilic colloid layer. The samples were wrought into Brownie-format, used in the same photographing as in Example 1 and developed with the use of automatic processor FP-232B manufactured by Fuji Photo Film Co., Ltd. Thereafter, the same evaluation as in Example 1 was carried out. As demonstrated in Example 1, the photosensitive materials of the present invention produced favorable results.

At the observation of these samples after processing, although slight abrasion was observed on the samples 201 and 202, there was no abrasion on the other samples.

What is claimed is:

1. A silver halide color photosensitive material of less than 320 ISO speed, comprising a support and, superimposed thereon, at least two red-sensitive silver halide emulsion layers of different sensitivities, at least two green-sensitive silver halide emulsion layers of different sensitivities, at least one blue-sensitive silver halide emulsion layer and at least one nonsensitive layer, wherein silver halide tabular grains of 0.15 μm or less grain thickness are contained in an amount of 50% or more based on the total number of silver halide grains in respective layers with the highest speed among the green-sensitive silver halide emulsion layers and red-sensitive silver halide emulsion layers; wherein the total dry film thickness of the photosensitive material on the emulsion layer side thereof is 24 μm or less; and wherein the below defined compound (A) is contained in at least one silver halide emulsion layer or the nonsensitive layer of the photosensitive material Compound (A): heterocyclic compound having one or more heteroatoms, which heterocyclic compound is capable of substantially increasing the sensitivity of the silver halide color photosensitive material by addition thereof as compared with that exhibited when the compound is not added.

2. The silver halide color photosensitive material according to claim 1, wherein the total dry film thickness of the photosensitive material on the emulsion layer side thereof is 22 μm or less.

3. The silver halide color photosensitive material according to claim 1, wherein the coating amount of silver is 5.0 $g/m^2$ or less.

4. The silver halide color photosensitive material according to claim 1, wherein the support at its side opposite to the side having the emulsion layers is provided with at least one back layer containing a hydrophilic binder, the total dry thickness thereof being in the range of 6 to 15 μm.

5. The silver halide color photosensitive material according to claim 1, wherein the green-sensitive silver halide emulsion layers have a center-of-gravity sensitivity wavelength ($\lambda_G$) of spectral sensitivity distribution satisfying the relationship 520 nm$<\lambda_G\leqq$580 nm, and wherein the red-sensitive silver halide emulsion layers have a center-of-gravity wavelength ($\lambda_{-R}$) of spectral sensitivity distribution of intensity of interlayer effect exerted thereupon by other silver halide emulsion layers in the range of 500 nm to 600 nm, the center-of-gravity wavelength ($\lambda_{-R}$) satisfying the relationship 500 nm$<\lambda_{-R}<$560 nm, and wherein the difference of $\lambda_G-\lambda_{-R}$ is 5 nm or greater.

6. The silver halide color photosensitive material according to claim 1, wherein the compound (A) is a compound unreactive with developing agent oxidation products provided that when the compound (A) is a heterocyclic compound having one or two heteroatoms, and is a compound reactive with developing agent oxidation products provided that when the compound (A) is a heterocyclic compound having three or more heteroatoms.

7. The silver halide color photosensitive material according to claim 1, wherein the compound (A) is represented by the following general formula (I):

General formula (I)

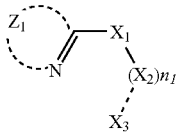

Where $Z_1$ represents a group for forming a heterocycle having one or two heteroatoms including the nitrogen atom of the formula; each of $X_1$ and $X_2$ independently represents a sulfur atom, an oxygen atom, a nitrogen atom (N(Va)) or a carbon atom (C(Vb)(Vc)), each of Va, Vb and Vc independently represents a hydrogen atom or a substituent; $n_1$ is 0, 1, 2 or 3, a plurality of $X_2$ may be the same or different when $n_1$ is 2 or greater; $X_3$ represents a sulfur atom, an oxygen atom or a nitrogen atom; and the bond between $X_2$ and $X_3$ is single or double, wherein $X_3$ may further have a substituent or a charge.

8. The silver halide color photosensitive material according to claim 1, wherein the compound (A) is represented by the following general formula (II):

General formula (II)

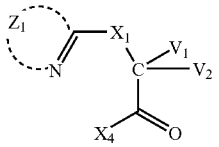

Where $Z_1$ represents a group for forming a heterocycle having one or two heteroatoms including the nitrogen atom of the formula; $X_1$ represents a sulfur atom, an oxygen atom, a nitrogen atom (N(Va)) or a carbon atom (C(Vb)(Vc)), each of Va, Vb and Vc independently represents a hydrogen atom or a substituent; $X_4$ represents a sulfur atom (S(Vd)), an oxygen atom (O(Ve)) or a nitrogen atom (N(Vf)(Vg)), each of Vd, Ve, Vf and Vg independently represents a hydrogen atom, a substituent or a negative charge; and each of $V_1$ and $V_2$ independently represents a hydrogen atom or a substituent.

9. The silver halide color photosensitive material according to claim 1, wherein the compound (A) is represented by the following general formula (M) or general formula (C):

General formula (M)

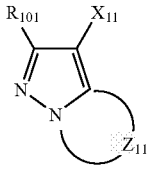

Where $R_{101}$ represents a hydrogen atom or a substituent; $Z_{11}$ represents a nonmetallic atom group required for forming a 5-membered azole ring containing 2 to 4 nitrogen atoms, which azole ring may have substituents (including a condensed ring); and $X_{11}$ represents a hydrogen atom or a substituent.

General Formula (C)

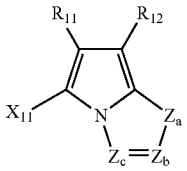

Where Za represents —NH— or —CH($R_3$)—; each of Zb and Zc independently represents —C($R_{14}$)═ or —N═, provided that when Za is —NH—, at least one of Zb and Zc is —N═ and that when Za is —CH($R_{13}$)—, both of Zb and Zc are —N═; each of $R_{11}$, $R_{12}$ and $R_{13}$ independently represents electron withdrawing groups whose Hammett substituent constant σp value is in the range of 0.2 to 1.0; $R_{14}$ represents a hydrogen atom or a substituent, provided that when there are two $R_{14}$'s in the formula, they may be identical with or different from each other; and $X_{11}$ represents a hydrogen atom or a substituent.

* * * * *